US006143482A

United States Patent [19]

Buitano et al.

[11] Patent Number: 6,143,482

[45] Date of Patent: Nov. 7, 2000

[54] PHOTOGRAPHIC FILM ELEMENT CONTAINING AN EMULSION WITH GREEN-RED RESPONSIVITY

[75] Inventors: Lois A. Buitano; Allan F. Sowinski; Steven G. Link, all of Rochester, N.Y.

[73] Assignee: Eastman Kodak Company, Rochester, N.Y.

[21] Appl. No.: 09/129,358

[22] Filed: Aug. 5, 1998

[51] Int. Cl.[7] ..... G03C 1/46

[52] U.S. Cl. ..... 430/506; 430/503; 430/505; 430/504; 430/551; 430/581; 430/583

[58] Field of Search ..... 430/503, 505, 430/504, 581, 583, 506

[56] References Cited

U.S. PATENT DOCUMENTS

| | | | |
|---|---|---|---|
| 5,037,728 | 8/1991 | Shiba et al. | 430/505 |
| 5,154,995 | 10/1992 | Kawai | 430/22 |
| 5,166,042 | 11/1992 | Nozawa | 430/551 |
| 5,169,273 | 12/1992 | Kawamura | 414/331 |
| 5,169,746 | 12/1992 | Sasaki | 430/504 |
| 5,180,657 | 1/1993 | Fukazawa et al. | 430/503 |
| 5,200,308 | 4/1993 | Ohtani et al. | 430/508 |
| 5,252,444 | 10/1993 | Yamada et al. | 430/503 |
| 5,344,750 | 9/1994 | Fujimoto et al. | 430/434 |
| 5,582,961 | 12/1996 | Giorgianni et al. | 430/508 |
| 5,609,978 | 3/1997 | Giorgianni et al. . | |
| 5,856,076 | 1/1999 | Siegel et al. . | |

FOREIGN PATENT DOCUMENTS

| | | |
|---|---|---|
| 0 434 044 A1 | of 0000 | European Pat. Off. . |
| 0409019A2 | 7/1990 | European Pat. Off. . |

*Primary Examiner*—Janet Baxter
*Assistant Examiner*—Amanda C. Walke
*Attorney, Agent, or Firm*—Edith A. Rice

[57] ABSTRACT

A photographic element comprises: a support and, coated on the support, a plurality of hydrophilic colloid layers, including radiation-sensitive silver halide emulsion layers, forming layer units for separately recording blue, green and red exposures, wherein, the red recording layer unit is comprised of at least one green-red sensitive emulsion having a peak dyed absorptance of between about 525 and about 600 nm, an overall half-peak absorptance bandwidth of between about 70 and about 150 nm, and a ratio of the bandwidths at 80% of peak absorptance to 50% of peak absorptance of greater than or equal to about 0.25.

In preferred embodiments of the invention, the photographic element is especially suited for more accurately recording scenes according to the human visual system.

23 Claims, 22 Drawing Sheets

PHOTOGRAPHIC FILM ELEMENT CONTAINING AN EMULSION WITH GREEN-RED RESPONSIVITY

FIELD OF THE INVENTION

The instant invention relates to a silver halide emulsion prepared for use in the red sensitive layer unit of a color photographic element. The element is particularly suitable for scanning, electronic manipulations, and reconversion to a viewable form that accurately records light according to the human visual system.

Definition of Terms

The term "E" is used to indicate exposure in lux-seconds.

The term "Status M density" is used to indicate image dye densities measured by a densitometer meeting photocell and filter specifications described in *SPSE Handbook of Photographic Science and Engineering,* W. Thomas, editor, John Wiley & Sons, New York, 1973, Section 15.4.2.6 Color Filters. The International Standard for Status M density is set out in "Photography—Density measurements—Part 3: Spectral conditions", Ref. No. ISO 5/3-1984 (E).

The term "gamma" is employed to indicate the incremental increase in image density ($\Delta D$) produced by a corresponding incremental increase in log exposure ($\Delta \log E$) and indicates the maximum gamma measured over an exposure range extending between a first characteristic curve reference point lying at a density of 0.15 above minimum density and a second characteristic curve reference point separated from the first reference point by 0.9 log E.

The term "coupler" indicates a compound that reacts with oxidized color developing agent to create or modify the hue of a dye chromophore.

In referring to blue, green and red recording dye image-forming layer units, the term "layer unit" indicates the hydrophilic colloid layer or layers that contain radiation-sensitive silver halide grains to capture exposing radiation and couplers that react upon development of the grains. The grains and couplers are usually in the same layer, but can be in adjacent layers.

The term "exposure latitude" indicates the exposure range of a characteristic curve segment over which instantaneous gamma ($\Delta D/\Delta \log E$) is at least 25 percent of gamma, as defined above. The exposure latitude of a color element having multiple color recording units is the exposure range over which the characteristic curves of the red, green, and blue color recording units simultaneously fulfill the aforesaid definition.

The term "colored masking coupler" indicates a coupler that is initially colored and that loses its initial color during development upon reaction with oxidized color developing agent.

The term "substantially free of colored masking coupler" indicates a total coating coverage of less than 0.09 millimole/$m^2$ of colored masking coupler.

The term "dye image-forming coupler" indicates a coupler that reacts with oxidized color developing agent to produce a dye image.

The term "development inhibitor releasing compound" or "DIR" indicates a compound that cleaves to release a development inhibitor during color development. As defined DIR's include couplers and other compounds that utilize anchimeric and timed releasing mechanisms.

In referring to grains and emulsions containing two or more halides, the halides are named in order of ascending concentrations.

The terms "high chloride" and "high bromide" in referring to grains and emulsions indicate that chloride or bromide, respectively, is present in a concentration of greater than 50 mole percent, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The terms "blue spectral sensitizing dye", "green spectral sensitizing dye", and "red spectral sensitizing dye" refer to a dye or combination of dyes that sensitize silver halide grains and, when adsorbed, have their peak absorption in the blue, green and red regions of the spectrum, respectively.

The term "half-peak bandwidth" in referring to a dye indicates the spectral region over which absorption exhibited by the dye is at least half its absorption at its wavelength of maximum absorption.

The term "overall half-peak bandwidth" indicates the spectral region over which a combination of spectral sensitizing dyes within a layer unit exhibits absorption that is at least half their combined maximum absorption at any single wavelength.

*Research Disclosure* is published by Kenneth Mason Publications, Ltd., Dudley House, 12 North St., Emsworth, Hampshire P010 7DQ, England.

BACKGROUND OF THE INVENTION

Color photographic elements are conventionally formed with superimposed blue, green, and red recording layer units coated on a support. The blue, green, and red recording layer units contain radiation-sensitive silver halide emulsions that form a latent image in response to blue, green, and red light, respectively. Additionally, the blue recording layer unit contains a yellow dye-forming coupler, the green recording layer unit contains a magenta dye-forming coupler, and the red recording layer unit contains a cyan dye-forming coupler.

Following imagewise exposure, a negative working photographic element is processed in a color developer that contains a color developing agent that is oxidized while selectively reducing to silver the latent image bearing silver halide grains. The oxidized color developing agent then reacts with the dye-forming coupler in the vicinity of the developed grains to produce an image dye. Yellow (blue-absorbing), magenta (green-absorbing) and cyan (red-absorbing) image dyes are formed in the blue, green, and red recording layer units, respectively. Subsequently the element is bleached (i.e., developed silver is converted back to silver halide) to eliminate neutral density attributable to developed silver and then fixed (i.e., silver halide is removed) to provide stability during subsequent room light handling.

When processing is conducted as noted above, negative dye images are produced. To produce corresponding positive dye images, and hence, to produce a visual approximation of the hues of the subject photographed, white light is typically passed through the color negative image to expose a second color photographic material having blue, green, and red recording layer units as described above, usually coated on a white reflective support. The second element is commonly referred to as a color print element. Processing of the color print element as described above produces a viewable positive image that approximates that of the subject originally photographed.

A positive working color photographic element is first developed in a black-and-white developer where the exposed crystals are selectively reduced to metallic silver. The unexposed silver is then fogged and reduced by a chromogenic color developer in a subsequent step to generate cyan, magenta, and yellow image dyes. The film is further bleached and fixed as with the negative working film. The positive working film thus forms dyes in the unexposed areas and renders a positive image of the scene, directly.

A problem with the accuracy of color reproduction delayed the commercial introduction of color negative elements. In color negative imaging, two dye image-forming coupler containing elements, a camera speed image capture and storage element and an image display, i.e. print element, are sequentially exposed and processed to arrive at a viewable positive image. Since the color negative element cascades its color errors forward to the color print element, the cumulative error in the final print is unacceptably large, absent some form of color correction. Even in color reversal materials which employ just one set of image dyes, color correction for the unwanted absorption of the imperfect image dyes is required to produce acceptable image color fidelity for direct viewing.

Color correction means, for color negative or color reversal elements, have relied on imagewise interlayer development modification effects during wet chemical processing called interlayer interimage effects. In the case of color negative elements, these effects are most commonly achieved with development inhibitor releasing (DIR) couplers that imagewise release development inhibitors to reduce the extent of development of the receiving silver halide grains, and with colored masking couplers. In the case of color reversal elements, these effects are usually achieved through imagewise interlayer silver halide emulsion development inhibition during the first black-and-white development, and possibly with DIR couplers during the second color development step.

Alternatively, instead of optical print-through exposure to create a color print, the color negative or color reversal element can be scanned to record the blue, green, and red densities in each picture element (pixel) of the exposed area. The color correction that is normally achieved by chemical interlayer interimage effects can be achieved by electronically manipulating stored image information as its image-bearing signal. One example of electronic color correction produced by scanning a processed photographic recording material and manipulating the resultant image-bearing electronic signals to achieve improved color rendition can be found in the KODAK Photo CD™ Imaging Workstation system. In addition, optical printing by passing light through the processed photographic recording material to expose a second light-sensitive material is no longer necessary. The light exposures necessary to write the color-corrected output onto a suitable display material such as silver halide color paper exposed by red, green, and blue light emitting lasers can be calculated and those device-dependent writing instructions can be transmitted to such alternate printers as their code values (specific instructions for producing the correct color hue and image dye amount). Other means of electronic printing include thermal dye transfer material, color electrophotographic media, or a three color cathode ray tube monitor.

It has been found unexpectedly that different or larger color corrections can be managed by electronic color correction than can be achieved through chemical interlayer interimage effects in color negative or color reversal films. This enhanced capability allows the possibility of producing better colorimetric matches between the original scene color content and the rendered image reproduction. In order to accomplish improved color reproduction, more accurate photographic recording material spectral sensitivity is required. In particular, the spectral sensitivity of a film optimally designed for scanning and electronic color correction must more closely approach that of the human visual system. To accurately record colors the way the human eye perceives them, a recording element must have spectral sensitivities that are linear transformations of the blue, green, and red cone responses of the human eye. Such linear transformations are known as color matching functions. Color matching functions for any set of real primary stimuli must have negative portions. Within the realm of known photographic mechanisms, it is not possible to produce a photographic element having spectral sensitivities whose response is negative.

Examples of spectral sensitivities that approximate color matching functions are those of MacAdam (Pearson and Yule, *J. Color Appearance,* 2, 30 (1973). Giorgianni et al, U.S. Pat. No. 5,582,961 and U.S. Pat. No. 5,609,978, the disclosures of which are herein incorporated by reference, describe related spectral sensitivities applied to non-tabular emulsions in color reversal film elements capable of forming image representations that correspond more closely to the calorimetric values of the original scene upon scanning and electronic conversion. A characteristic of these color matching functions is a broad response for the red recording layer unit that has significant sensitivity at wavelengths between about 530 nm and 640 nm. This type of response function closely resembles the green-red response of the human eye and visual system.

The red sensitivity of a multilayer film element is determined by the light absorption profile of the silver halide emulsions in the red sensitive layer unit attenuated by any light absorbing materials that lie above it in the top layers of the film, such as ultraviolet filter dyes, Lippmann emulsions, yellow filter layers, the blue sensitive emulsions, the yellow and magenta colored masking couplers in color negative films, and of course the green sensitive emulsions themselves. The light absorption of the emulsions used in the red sensitive layer unit is in turn determined by the composite absorption of the specific combination of spectral sensitizing dyes adsorbed to the surface of the silver halide crystals, since silver halide emulsions only have native (intrinsic) sensitivity to blue light. Red sensitive emulsions used in the red recording layer unit that are commonly found in the art are observed to employ two or three red sensitizing dyes, and they typically peak in dyed absorptance from about 600 nm to about 660 nm. Broad light absorptance to produce color reproduction accuracy in accord with human visual sensitivity was not sought.

Sasaki in U.S. Pat. No. 5,169,746 employs a blend of four spectral sensitizing dyes applied to a tabular grain silver iodobromide emulsion to obtain increased half-peak bandwidth, but green-red sensitivity is not provided since the maximum absorptance and sensitivity of such emulsions is more bathochromic than 600 nm. Ezaki et al U.S. Pat. No. 5,258,273 likewise produces broad half-peak bandwidth red sensitive emulsions using four spectral sensitizing dyes, but fails to achieve green-red sensitivity as the maximum emulsion response occurs at greater than 600 nm. Fukazawa et al in U.S. Pat. No. 5,180,657 demonstrates green-red sensitivity with a peak dyed emulsion response at about 590 nm, but only three spectral sensitizing dyes were used and consequently inadequate half-peak absorption bandwidth was achieved to provide color matching performance to mimic the human visual response. Fukazawa et al in European Patent Application EP 0 434 044 A1 uses as many as three spectral sensitizing dyes concurrently with a silver iodobromide emulsion to achieve spectral sensitivity as hypsochromic as about 580 nm, but low half-peak bandwidth resulted and more than one local maximum sensitivity was apparent. Shiba et al in U.S. Pat. No. 5,037,728 reveal the use of up to four dyes in combination; however the maximum sensitivity of the dyed emulsion falls at about 620 nm despite broad half-peak bandwidth performance. Yamada et al in U.S. Pat. No. 5,252,444 achieves high dyed emulsion half-peak bandwidth with merely two spectral sensitizing dyes, but continuous spectral response was absent with two local maximum sensitivities and principal response falling above 620 nm. Ohtani et al in U.S. Pat. No. 5,200,308 provide an emulsion employing three sensitizing dyes simultaneously to achieve high half-peak bandwidth, but the maximum absorption and sensitivity appear around 640 nm indicative of red, not green-red sensitivity.

Giorgianni et al '961 and '978 demonstrate a conventional, low aspect ratio silver iodobromide emulsion dyed with three J-aggregating cyanine dyes; green-red sensitivity with a high overall half-peak bandwidth was achieved, but the dyed emulsion disclosed produced multiple local absorption maxima again compromising the continuity of the green-red response. These maxima signify the lack of mixed aggregation of the sensitizing dyes, which has flawed the emulsion response with multiple discrete sensitivities. Their goal of significantly broad, unbroken red sensitivity that overlaps with green sensitivity to mimic the human visual system for improved color capture accuracy and reduced mixed illuminant sensitivity was not satisfied.

Problem to be Solved by the Invention

In order to achieve accurate color reproduction, the photographic element red sensitivity must meet certain requirements provided by dyed silver halide emulsions. The emulsions' material properties include the correct wavelength of maximum spectral absorptance and the requisite bandwidth of continuous absorption to confer the correct spectral responsivity to high-latitude photographic recording materials. The need for broad, and efficient, green-red spectral sensitizations of silver halide emulsions remains unsatisfied.

SUMMARY OF THE INVENTION

One aspect of this invention comprises a photographic element comprising:

a support and, coated on the support, a plurality of hydrophilic colloid layers, including radiation-sensitive silver halide emulsion layers, forming layer units for separately recording blue, green and red exposures, wherein, the red recording layer unit is comprised of at least one green-red sensitive emulsion having a peak dyed absorptance of between about 525 and about 600 nm, an overall half-peak absorptance bandwidth of between about 70 and about 150 nm, and a ratio of the bandwidths at 80% of peak absorptance to 50% of peak absorptance of greater than or equal to about 0.25.

In a preferred embodiment of the invention, the photographic element is capable of producing images suitable for electronic scanning wherein:

said layer units for separately recording blue, green and red exposures comprise:

a blue recording emulsion layer unit containing at least one dye-forming coupler capable of forming a first image dye;

a green recording emulsion layer unit containing at least one dye-forming coupler capable of forming a second image dye; and, a red recording emulsion layer unit containing at least one dye-forming coupler capable of forming a third image dye;

wherein said first, second, and third dye image-forming couplers are chosen such that the absorption half peak bandwidths of said image dyes are substantially non-coextensive.

Advantageous Effect of the Invention

When photographic recording materials according to the invention are prepared, a broad green-red spectral sensitivity results with significant sensitivity at wavelengths between 500–650 nm. In preferred embodiments of the invention, the broad red sensitivity is produced quite surprisingly without a multiplicity of individual peak maximum sensitivities being produced, which would have resulted in a discontinuous spectral response profile for the photographic element contrary to the human visual response. Elements in accord with the invention can achieve low color recording errors by accurately capturing scene green-red light providing the opportunity for improved hybrid photographic-electronic imaging system color reproduction fidelity.

DESCRIPTION OF PREFERRED EMBODIMENTS

Figure 1A:
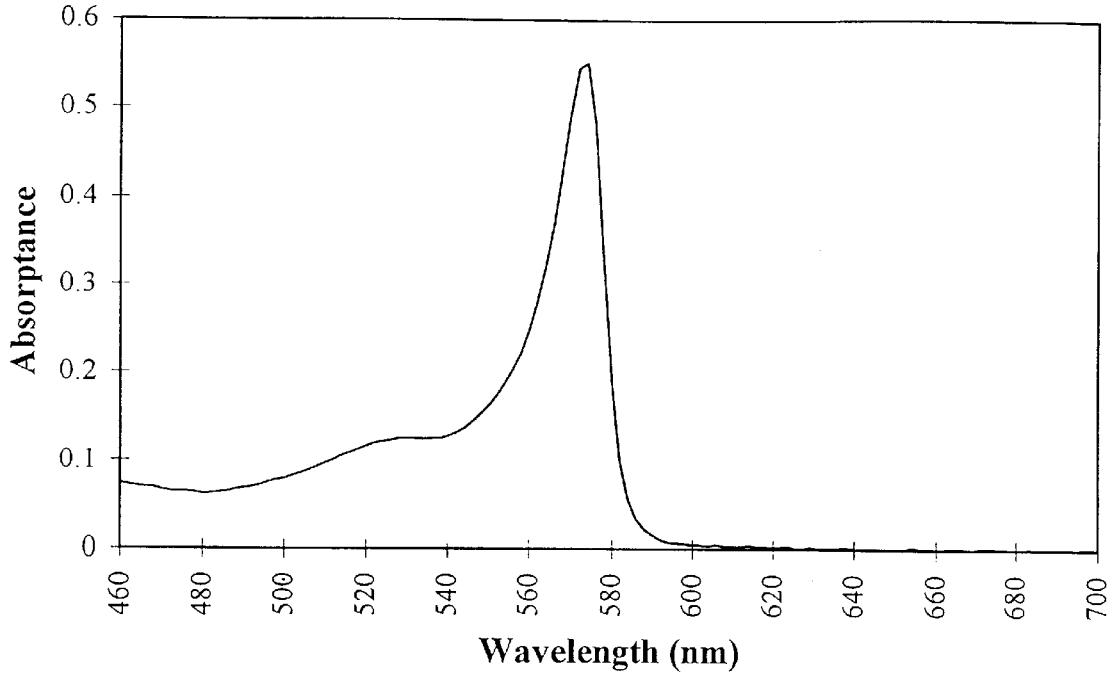
FIGS. 1A through 1F are absorption spectra of sample materials as described in Example I below.
Figure 1B:
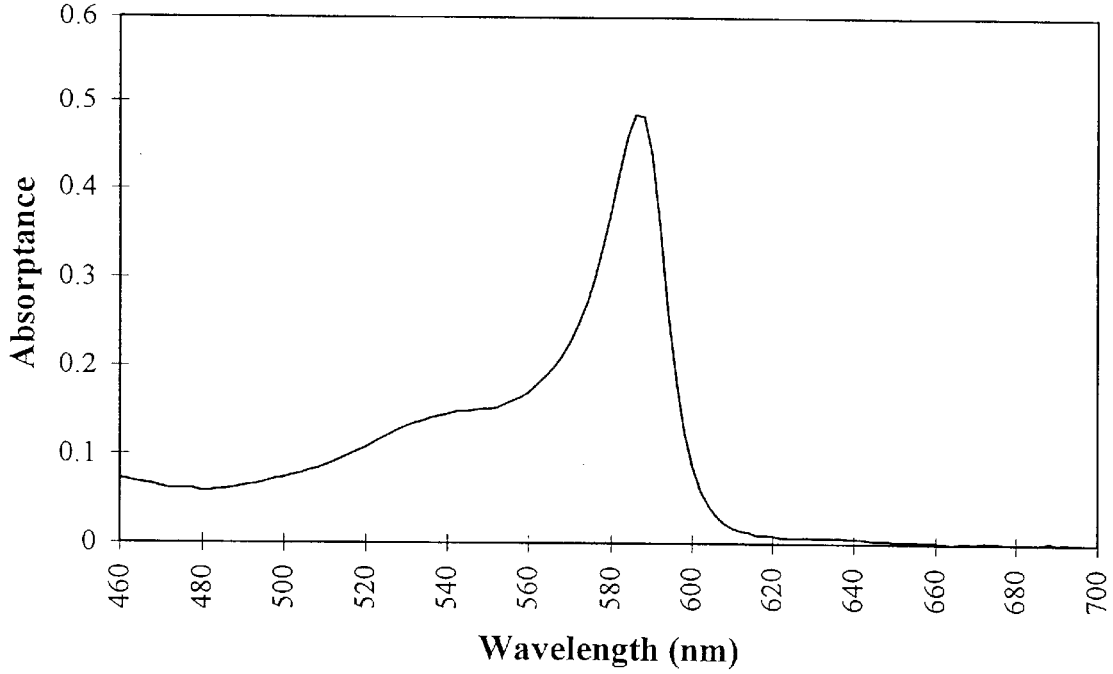
Figure 1C:
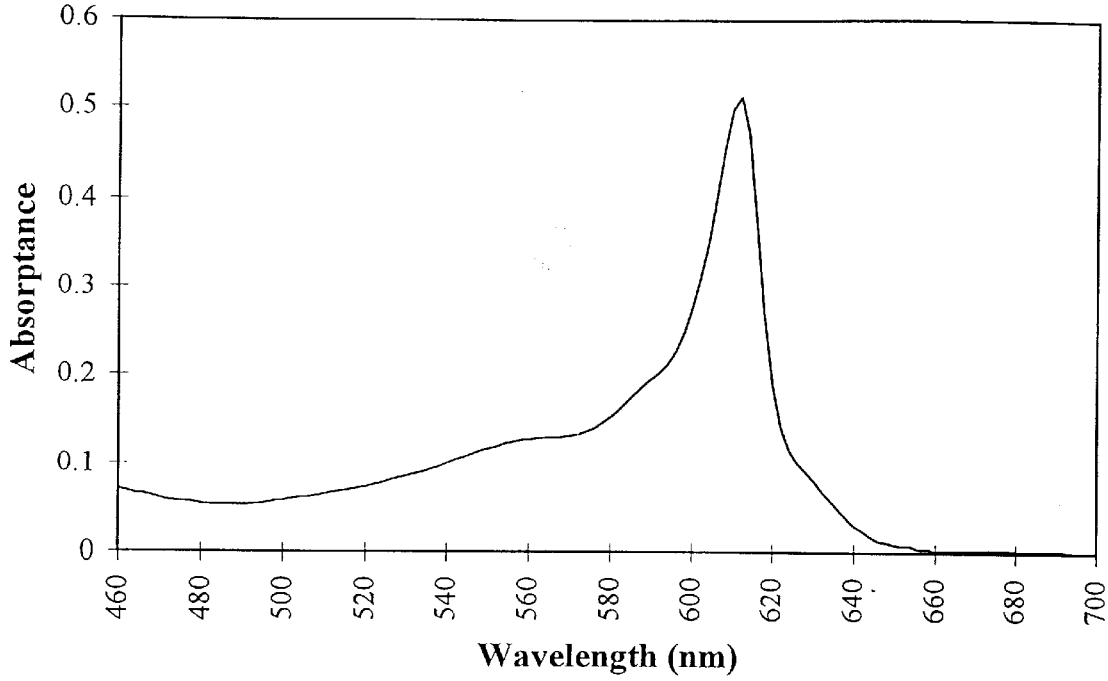
Figure 1D:
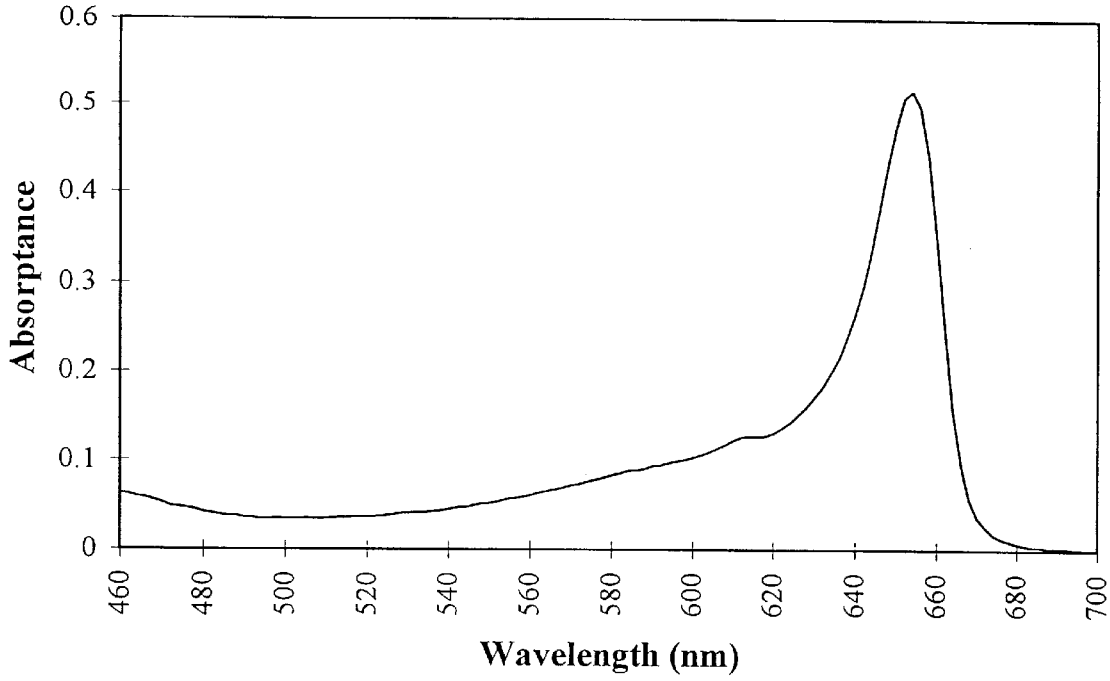
Figure 1E:
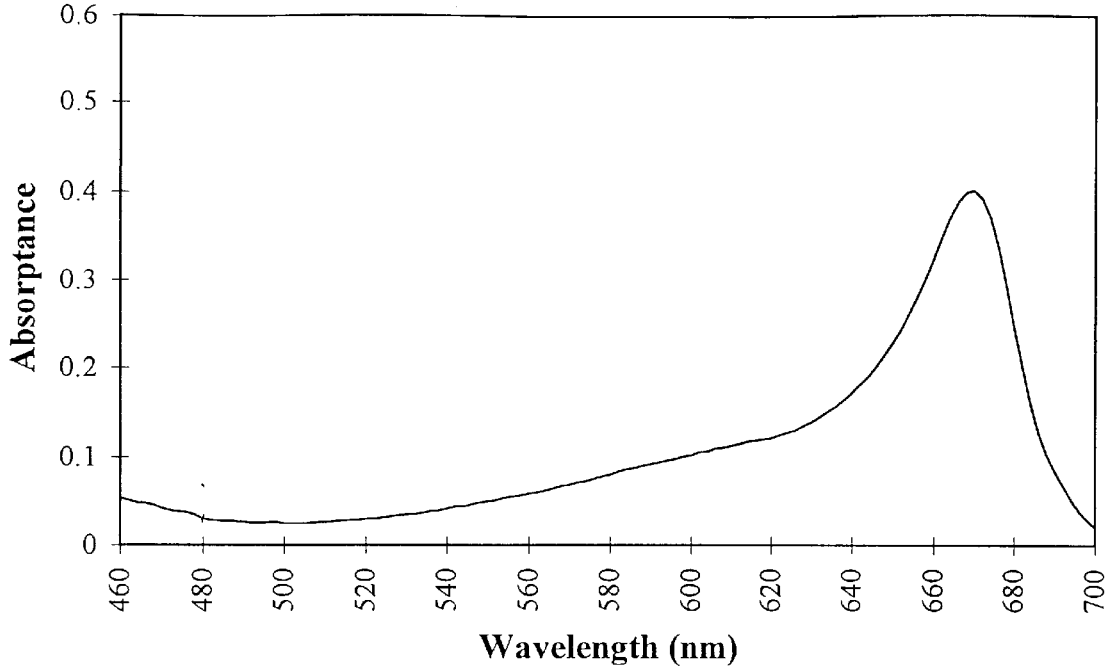
Figure 1F:
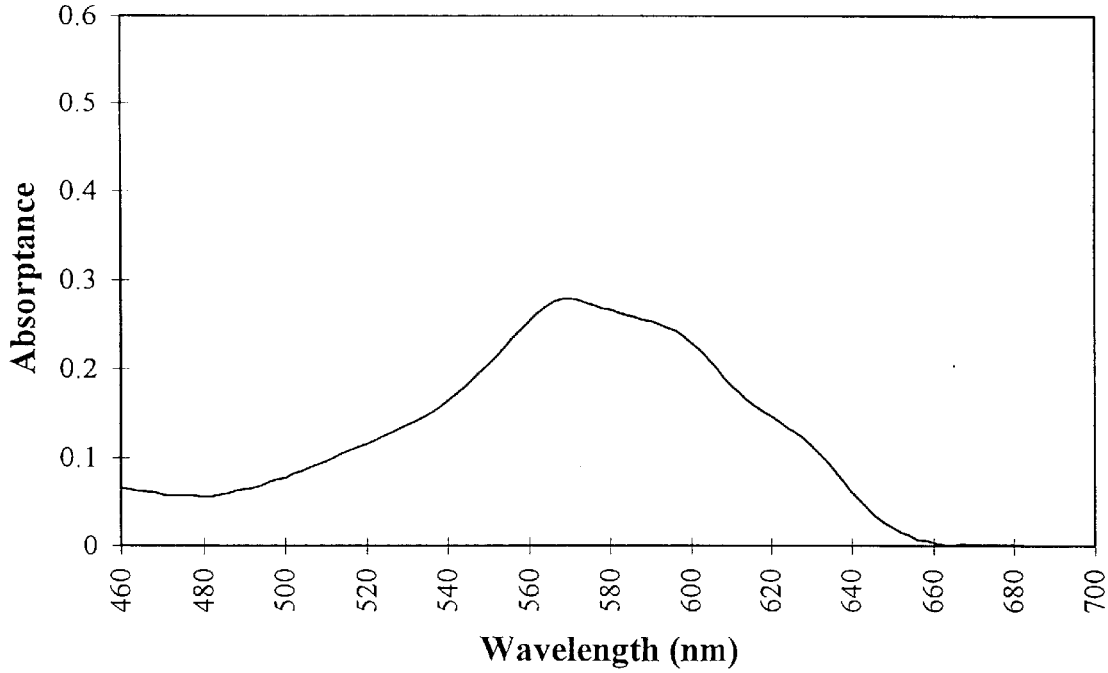

The spectral sensitivity distribution of a silver halide emulsion is a representation of how the emulsion converts photons of absorbed light to developable latent image. It is conveniently displayed as a graph of photographic sensitivity (speed) versus wavelength of visible light. The light actually absorbed by a dyed emulsion in a gelatin coating on a support can be measured spectrophotometrically. Since silver halide crystals scatter light, some light is transmitted by the coating, some light is reflected, and the remainder is absorbed. The absorptance of a coating of a silver halide emulsion is determined by measuring wavelength-by-wavelength the total amount of light transmitted, and the total amount of light reflected. The absorptance at each wavelength is then expressed as (1–T–R) where T is the amount of light transmitted and R is the amount of light reflected. The absorptance is plotted as the percent of light absorbed versus the wavelength. Silver halide also absorbs blue light, especially as the halide is comprised of increasing concentrations of iodide. An absorptance spectrum for sensitizing dyes on silver halide can be obtained by subtracting, wavelength by wavelength, the absorptance spectrum of an undyed emulsion from that of the dyed emulsion, both coated on a transparent support at an equal coverage of silver. This technique is necessary in the blue light absorbing region of the visible spectrum, but may be neglected in the minus blue or dyed absorption regions of the visible spectrum involving green and red light.

A combination of cyanine dyes on the surface of a silver halide emulsion is generally equally efficient at all wavelengths at converting absorbed photons to conduction band elections. Therefore, percent absorptance spectra can be used as a substitute for spectral sensitivity distribution. The close correspondence of the percent absorptance spectrum and the spectral sensitivity distribution is demonstrated in Example II.

In order to construct a film element with red, green and blue light recording layer units and to provide a red recording unit with spectral sensitivity that approaches color matching functions for the human eye, it is necessary to use a broader emulsion absorptance with a more hypsochromic maximum absorption in the green-red region of the spectrum than has been used in prior color photographic films. In particular, the red absorptance extends into the green region below 550 nm. Thus for the red recording layer unit, it is necessary to use silver halide emulsions that also have a combination of sensitizing dyes such that the peak absorptance of the emulsion in a single layer unit coating on a support lies between 525 nm and 600 nm, and the half-peak absorptance band-width is between 70 and 150 nm. To provide adequate spectral continuity of absorptance and avoid severe multiple discrete maxima, producing therefore sensitivity like color matching functions for the human visual response, the ratio of the bandwidths at 80% of peak absorptance and at 50% of the peak absorptance is greater than or equal to 0.25.

Preferably two or more sensitizing dyes are used in combination. Examples of employable sensitizing dyes include cyanine dyes, merocyanine dyes, complex cyanine dyes, holopolar cyanine dyes, hemicyanine dyes, styryl dyes, and hemioxonol dyes. The dyes are chosen such that the absorptance of the individual dyes on the silver halide emulsion are separated by more than 5 nm and together span the wavelength range of the broad absorptance desired. Particularly preferred are cyanine dyes having the general formula I shown below.

(I)

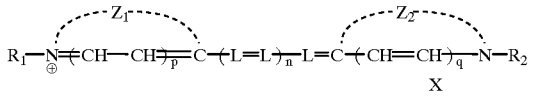

where R1 and R2 may be the same or different and each represents a 1 to 10 carbon alkyl group, or an aryl group. The alkyl or aryl group may be further substituted. Z1 and Z2 represent the atoms necessary to complete a 5 or 6 membered heterocyclic ring system. L is a methine group, p and q may be 0 or 1. n may be 0, 1, or 2. X is a counterion as necessary to balance the charge.

Preferred dyes have the formula II below.

(II)

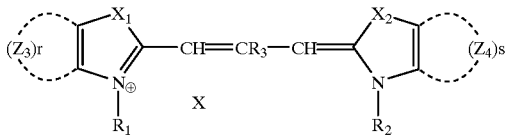

where R1, R2, and X have the same meaning as in formula I, R3 is a 1 to 6 carbon alkyl group or an aryl group, r and s can be 0 or 1, and Z3 and Z4 can be the atoms necessary to complete a fused benzene, naphthalene, pyridine, or pyrazine ring which can be further substituted. R3 is a 1–6 carbon alkyl group or an aryl group. X1and X2 can each individually be O, S, Se, Te, N—R4. R4 has the same meaning as R1 and R2. Furthermore, when r and s are 0, the five membered rings containing X1 and X2 may be further substituted at the 4 and/or 5 position.

Preferred dyes of formula II are those where X1 and X2 are O, S, Se, or N—R4. It is also preferred that one or both of r and s is equal to 1, and that at least one of R1 and R2 contains an acid solubilizing group. It will be recognized by those skilled in the art that as X1 and X2 are changed from O to N—R4 to S, to Se, the dyes will absorb light at longer wavelengths. Therefore, it is anticipated that a mixture of dyes used in the practice of this invention will typically utilize two or more carbocyanine dyes with a range of values for X1 and X2. It will also be recognized that to achieve the broad red absorptance described above, at least one of the dyes will have X1 and X2 both equal to S or Se, or one of the dyes will have p or q in formula I equal to 1.

When reference in this application is made to a particular moiety as a "group", this means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

Cyanine spectral sensitizing dyes that form J-aggregates are preferred for building the needed breadth of absorption with good quantum efficiency on silver halide emulsions of the invention; J-aggregating carbocyanine dyes are the most preferred dyes for the practice of this invention.

The silver halide emulsion may be sensitized by sensitizing dyes using any method known in the art. Dyes may be added to the silver halide emulsion singly or together, but since the desired all-positive color-matching-function spectral sensitivities are smooth curves with a single peak, it is preferred that the absorptance spectrum of the dyed silver halide emulsions should also have only a single peak. A highly preferred method of addition of the dyes to the silver halide is by premixing them as a solution in a suitable solvent, as a mixed dispersion in aqueous gelatin, or as a mixed liquid crystalline dispersion in water. Of course, green-red sensitized silver halide emulsions will be sensitized in accord with the requirements as described. The dye or dyes may be added to the silver halide emulsion grains and hydrophilic colloid at any time prior to or simultaneous with the application of a liquid coating solution comprised of the emulsion to a support. The sensitizing dye or dyes may be added prior to, during or following the chemical sensitization of the emulsion grains. With tabular silver halide emulsions, the dyes are preferably added to the grains before chemical sensitization.

Three or more sensitizing dyes are typically used to achieve the objectives of the invention. It is preferred to use four or five dyes to achieve the required half-peak bandwidth, but more dyes can be added as is useful. As many as seven dyes, or more, blended in the spectrochemical sensitization are contemplated to provide both breadth of sensitivity and high continuity of the spectral response. A combination of dyes is useful also for supersensitization as well as spectral response adjustment. Since the spectral absorption characteristics of a sensitizing dye on an emulsion will, to some extent, bear on the particular emulsion used as well as the other sensitizing dyes present on the same emulsion, the sensitizing dyes selected to sensitize the green-red light recording silver halide emulsion to within the required characteristics of the invention will be chosen with these characteristics in mind. Furthermore, other factors such as the order of addition, the silver ion potential (vAg), the emulsion surface and its halide type can be manipulated to achieve the desired spectral absorptances.

The light sensitive silver halide emulsion of the instant invention may contain a compound which is a dye having no spectral sensitization effect itself, or a compound substantially incapable of absorbing visible light in the spectral regions according to the invention, or which does absorb light in the spectral region of interest but is present in very low quantities but which exhibits a supersensitizing effect, such as compounds described in U.S. Pat. No. 3,615,641, the entire disclosure of which is incorporated herein by reference, or as disclosed in *Research Disclosure*, Vol. 389, September 1996, Item 38957. The silver halide emulsion of this invention may comprise a multilayer spectral sensitization system, such as that disclosed in U.S. Pat. No. 3,622,316, the entire disclosure of which is incorporated herein by reference.

Illustrations of useful spectral sensitizing dyes and techniques are provided by *Research Disclosure*, Item 38957, cited above, section V. Spectral sensitization and desensitization. More concrete examples of sensitizing dyes are disclosed, for example, in U.S. Pat. No. 4,617,257, U.S. Pat. No. 5,037,728, U.S. Pat. No. 5,166,042, and U.S. Pat. No. 5,180,657. Non-limiting examples of dyes which may be used in accordance with this invention are as follows:

SD-01

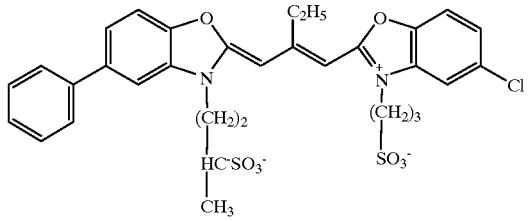

SD-02

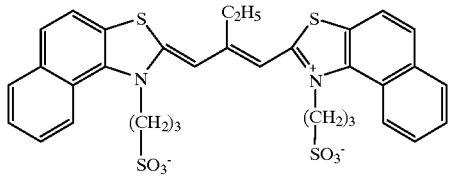

SD-03

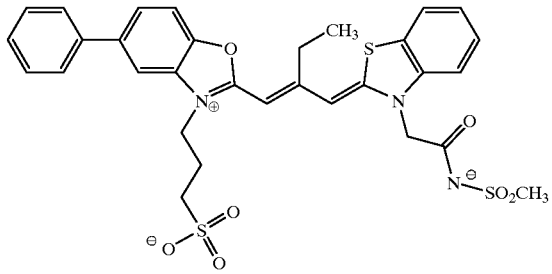

SD-04

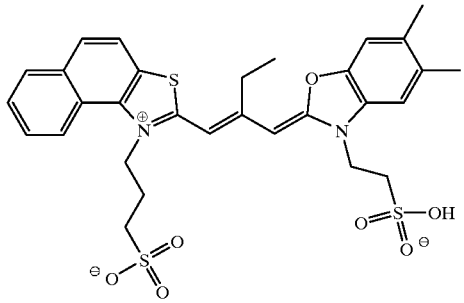

SD-05

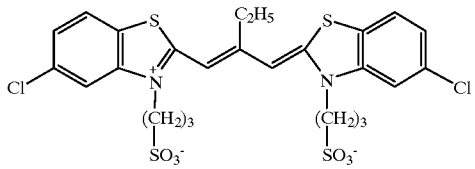

-continued
SD-06
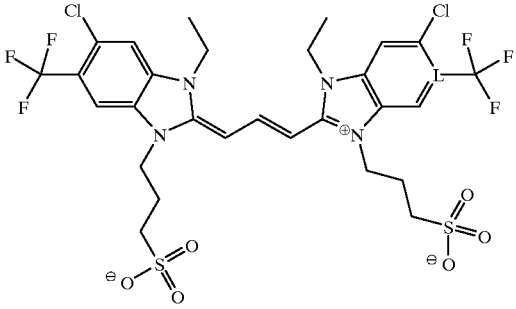
SD-07
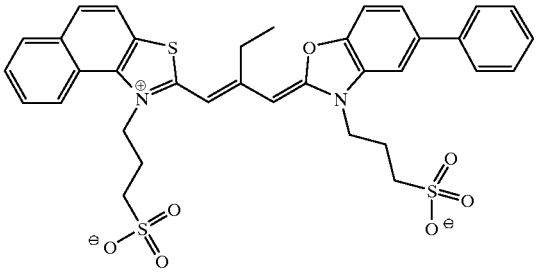
SD-08
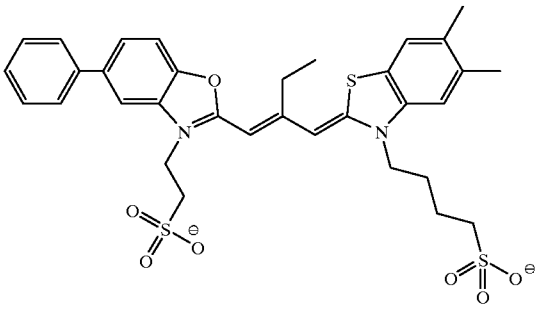
SD-09
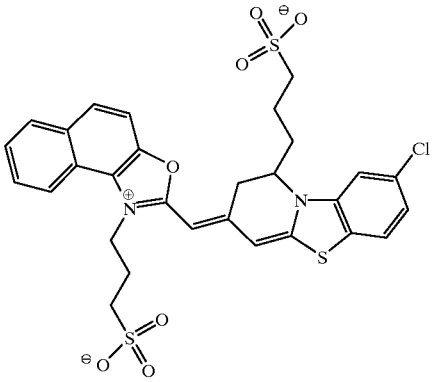
-continued
SD-10
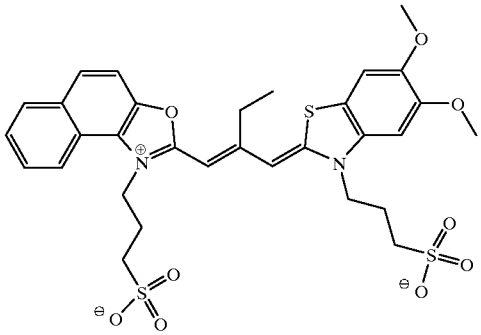
SD-11
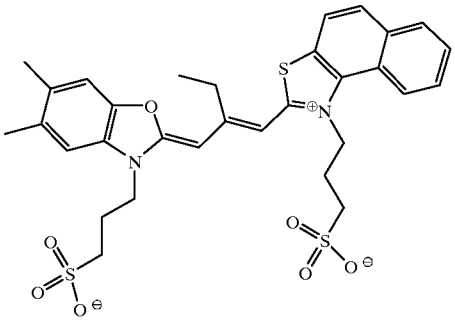
SD-12
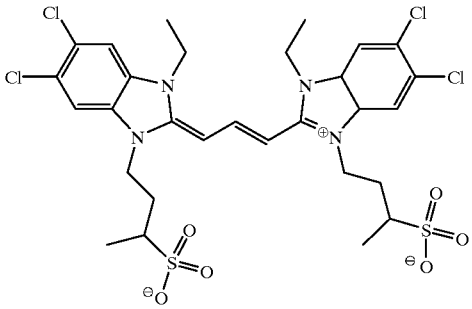
SD-13
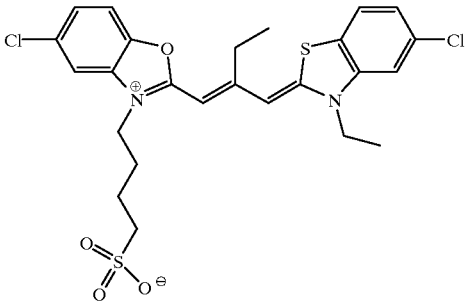
SD-14
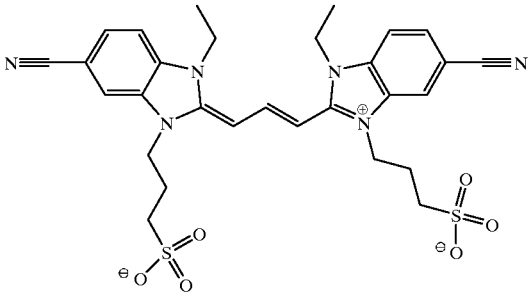

-continued

SD-15

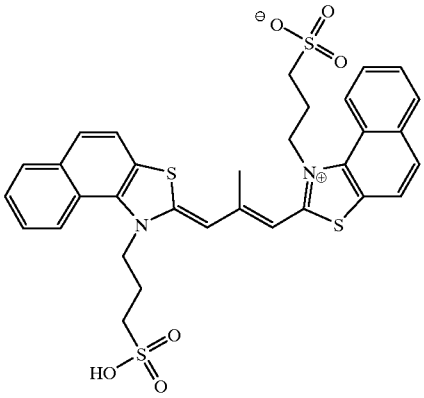

SD-16

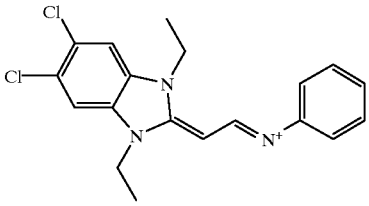

SD-17

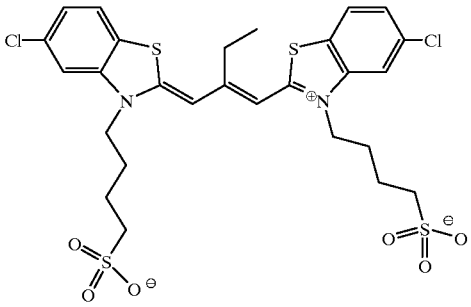

SD-18

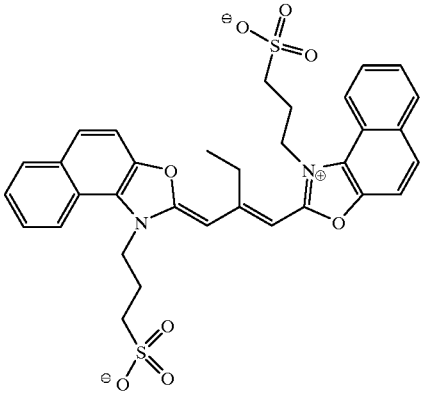

SD-19

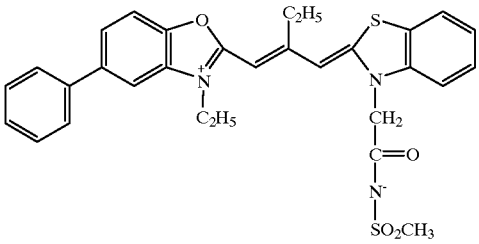

A typical color negative film construction useful in the practice of illustrated by the following:

| Element SCN-1 | |
|---|---|
| SOC | Surface Overcoat |
| BU | Blue Recording Layer Unit |
| IL1 | First Interlayer |
| GU | Green Recording Layer Unit |
| 1L2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. The element can contain additional layers, such as filter layers, interlayers, overcoat layers, subbing layers, antihalation layers and the like. Transparent and reflective support constructions, including subbing layers to enhance adhesion, are disclosed in *Research Disclosure,* Item 38957, cited above, XV. Supports. Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

The emulsion in BU is capable of forming a latent image when exposed to blue light. When the emulsion contains high bromide silver halide grains and particularly when minor (0.5 to 20, preferably 1 to 10, mole percent, based on silver) amounts of iodide are also present in the radiation-sensitive grains, the native sensitivity of the grains can be relied upon for absorption of blue light. Preferably the emulsion is spectrally sensitized with two or more blue spectral sensitizing dyes to achieve the required absorption breadth of color matching function spectral sensitivity which mimics human visual sensitivity. Tabular emulsions are preferred for providing dyed blue spectral sensitivity. The emulsions in GU and RU are spectrally sensitized with green and red spectral sensitizing dyes, respectively, in all instances, since silver halide emulsions have no native sensitivity to green and/or red (minus blue) light. The red unit emulsions of the invention preferably are comprised of at least four spectral sensitizing dyes. More preferably, at least five spectral sensitizing dyes are employed to achieve the required spectral breadth of responsivity to green-red light.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically preferred for the blue sensitive recording unit. The green sensitive recording unit is preferably comprised of tabular grains with an aspect ratio of less than or equal to 15. The grains preferably form surface latent images so that they produce negative images when processed in a surface developer in color negative film forms of the invention.

Illustrations of conventional radiation-sensitive silver halide emulsions are provided by *Research Disclosure*, Item 38957, cited above, I. Emulsion grains and their preparation. Chemical sensitization of the emulsions, which can take any conventional form, is illustrated in section IV. Chemical sensitization. Spectral sensitization and sensitizing dyes, which can take any conventional form, are illustrated by section V. Spectral sensitization and desensitization. The emulsion layers also typically include one or more antifoggants or stabilizers, which can take any conventional form, as illustrated by section VII. Antifoggants and stabilizers.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure*, Item 38957, cited above, X. Dye image formers and modifiers, B. Image-dye-forming couplers.

The invention is applicable to conventional color negative film or color reversal film constructions. The spectral sensitivities can also be employed in photothermographic elements, and in particular, camera speed photothermographic elements as known in the art. Specific examples of multicolor photothermographic elements are described by Levy et al. In U.S. patent application Ser. No. 08/740,110, filed Oct. 28, 1996, by Ishikawa et al in European Patent Application EP 0, 762,201 A1, and by Asami in U.S. Pat. No. 5,573,560, the disclosures of which are both incorporated by reference. The invention is also applicable to image transfer photothermographic elements such as disclosed in Ishikawa et al European Patent Application EP 0 800 114 A2. In a preferred embodiment, contrary to conventional color negative film constructions, RU, GU and BU are each substantially free of colored masking coupler. Preferably the layer units each contain less than 0.05 (most preferably less than 0.01) millimole/$m^2$ of colored masking coupler. No colored masking coupler is required in the color negative elements of this invention.

Development inhibitor releasing compound is incorporated in at least one and, preferably, each of the layer units in color negative film forms of the invention. DIR's are commonly employed to improve image sharpness and to tailor dye image characteristic curve shapes. The DIR's contemplated for incorporation in the color negative elements of the invention can release development inhibitor moieties directly or through intermediate linking or timing groups. The DIR's are contemplated to include those that employ anchimeric releasing mechanisms. Illustrations of development inhibitor releasing couplers and other compounds useful in the color negative elements of this invention are provided by *Research Disclosure*, Item 38957, cited above, X. Dye image formers and modifiers, C. Image dye modifiers, particularly paragraphs (4) to (11).

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

The layer unit comprised of the green-red sensitive emulsion of the invention is preferably subdivided into at least two, and more preferably three or more sub-unit layers. It is preferred that all light sensitive silver halide emulsions in the color recording unit have spectral sensitivity in the same region of the visible spectrum, that is, the green-red region. In this embodiment, while all silver halide emulsions incorporated in the unit have green-red spectral absorptance according to invention, it is expected that there are minor differences in spectral absorptance properties between them. In still more preferred embodiments, the sensitizations of the slower silver halide emulsions are specifically tailored to account for the green-red light shielding effects of the faster silver halide emulsions of the layer unit that reside above them, in order to provide an imagewise uniform spectral response by the photographic recording material as exposure varies with low to high light levels. Thus higher proportions of green light absorbing spectral sensitizing dyes may be desirable in the slower emulsions of the subdivided layer unit. It is also contemplated, however, that mixtures of conventional red sensitized silver halide emulsion and the green-red sensitized silver halide emulsion of the invention can be employed together within the same layer unit: in this circumstance, it is preferred that the most sensitive emulsion bear the green-red spectral sensitization of the invention and be located nearest the source of exposing radiation, while any slower emulsions provide red or other spectral responsivities and be located nearer the support and farther from the incident exposing radiation.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure*, Item 38957, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure*, Item 38957, VIII. Absorbing and scattering materials, B. Absorbing materials.

The antihalation layer unit AHU typically contains a processing solution removable or decolorizable light absorbing material, such as one or a combination of pigments and dyes. Suitable materials can be selected from among those disclosed in *Research Disclosure,* Item 38957, VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure*, Item 38957, IX. Coating physical property modifying addenda. The SOC overlying the emulsion layers additionally preferably contains an ultraviolet absorber, such as illustrated by *Research Disclosure*, Item 38957, VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form, with the exception that colored masking couplers would be absent; in preferred forms, development inhibitor releasing couplers would also be absent. In preferred embodiments, the color negative elements are intended for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma (ΔD÷Δ log E) by doubling changes in density (ΔD). Thus, gamma's as low as 1.0 or even 0.5 are contemplated and exposure latitudes of up to about 5.0 log E or higher are feasible.

EXAMPLES

The invention can be better appreciated by reference to the following specific embodiments. All coating coverages are reported in parentheses in terms of g/m2, except as otherwise indicated. Silver halide coating coverages are reported in terms of silver.

| Glossary of Acronyms | |
|---|---|
| HBS-1 | Tritolyl phosphate |
| HBS-2 | Di-n-butyl phthalate |
| HBS-3 | N-n-Butyl acetanilide |
| HBS-4 | Tris(2-ethylhexyl)phosphate |
| HBS-5 | Di-n-butyl sebacate |
| HBS-6 | N,N-Diethyl lauramide |
| HBS-7 | 1,4-Cyclohexylenedimethylene bis(2-ethylhexanoate) |
| H-1 | Bis(vinylsulfonyl)methane |

ST-1

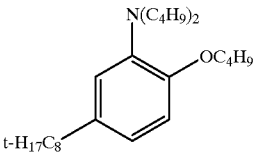

-continued

Glossary of Acronyms

C-1

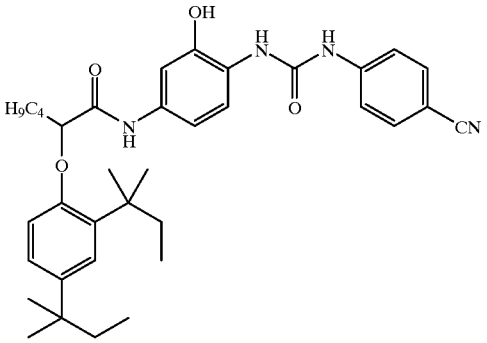

C-2

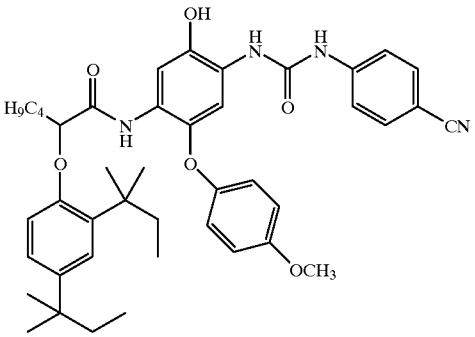

M-1

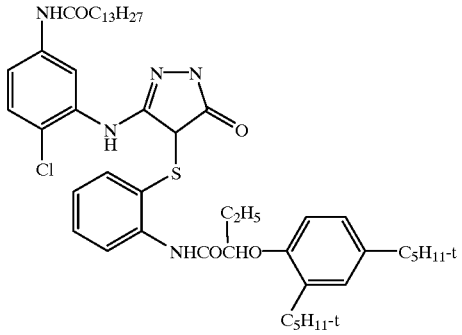

Y-1

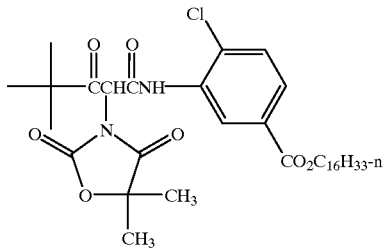

-continued
Glossary of Acronyms
D-1
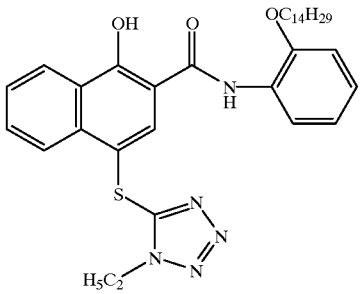
D-2
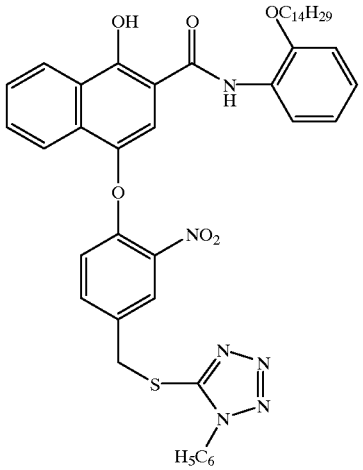
D-3
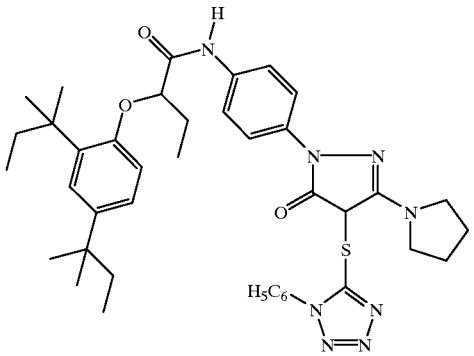
D-4
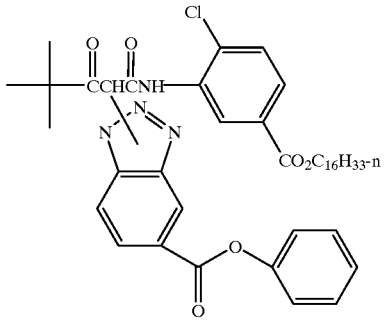
-continued
Glossary of Acronyms
D-5
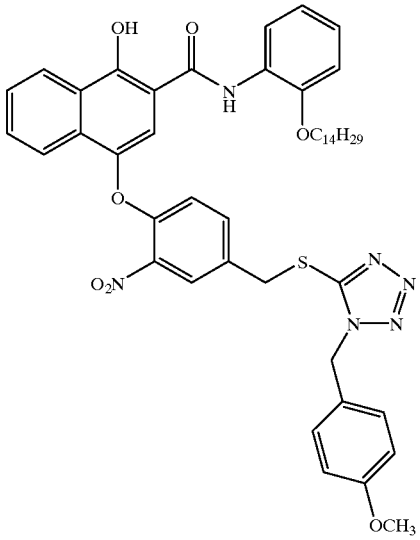
D-6
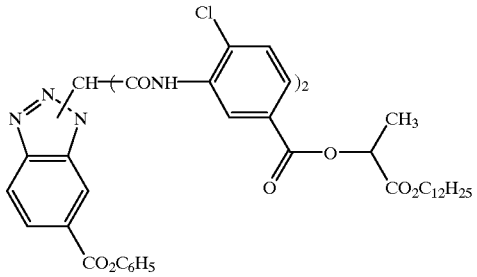
D-7
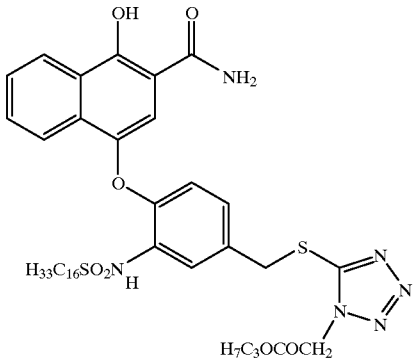
CM-1
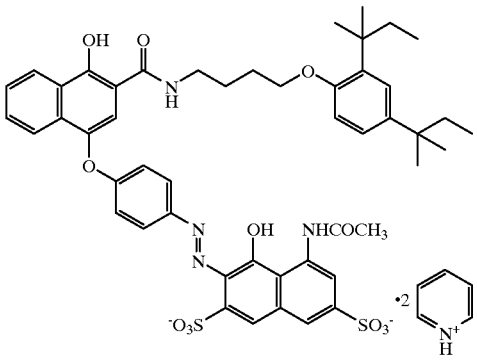

-continued
Glossary of Acronyms
MM-1
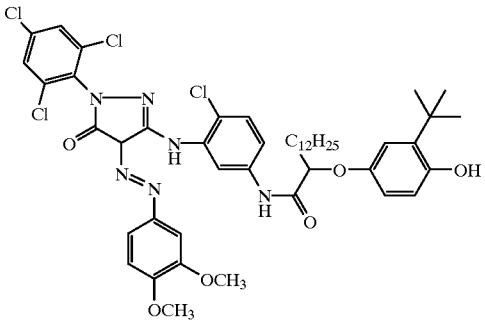
MM-2
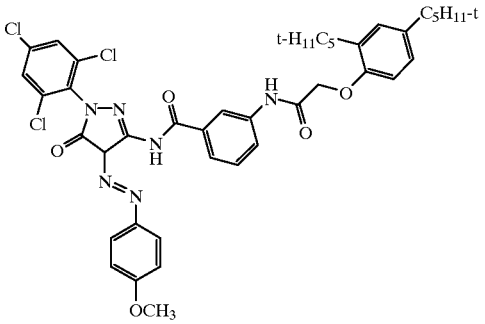
MD-1
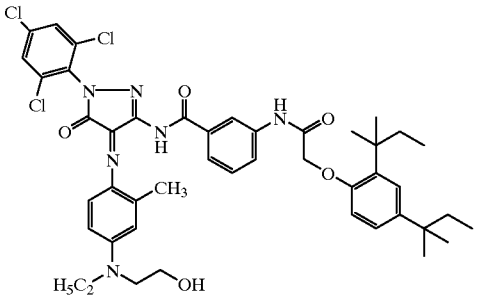
CD-1
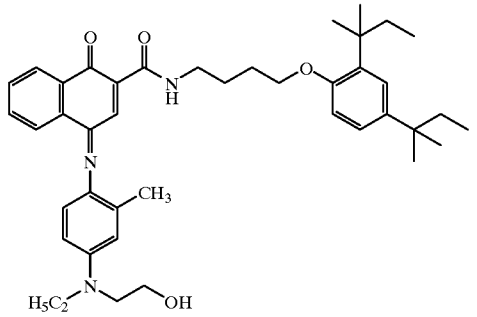
-continued
Glossary of Acronyms
B-1
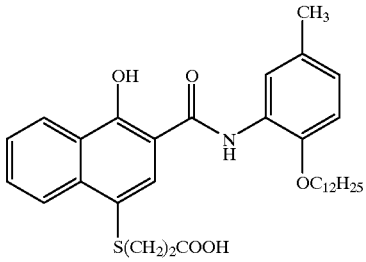
YD-1
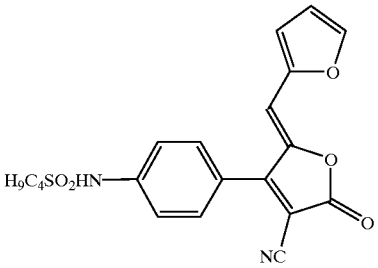
UV-1
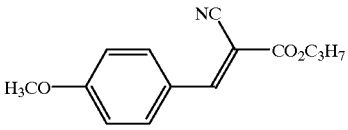
UV-2
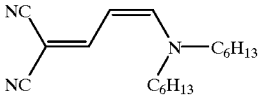
S-1
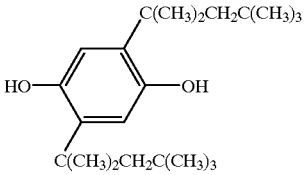
S-2
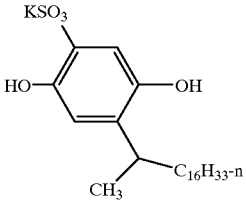

-continued

Glossary of Acronyms

S-3

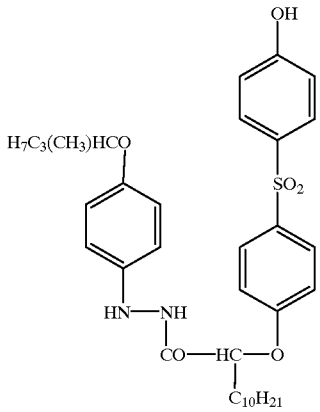

BS-1

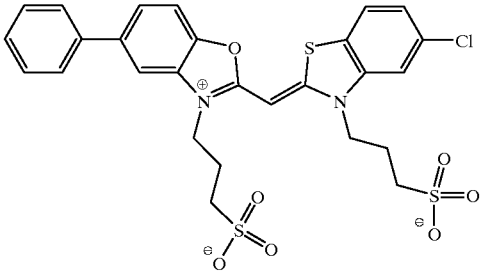

BS-2

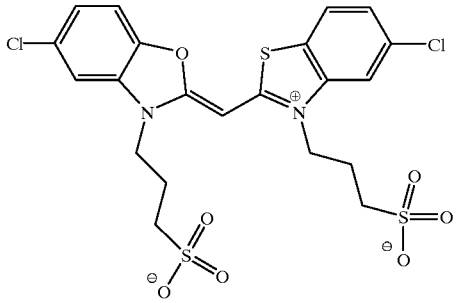

BS-3

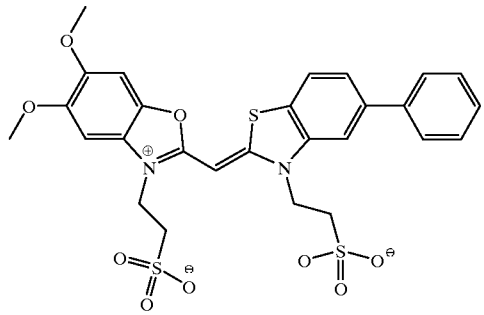

Example I

Component Properties

Photographic samples 101 through 106 were prepared. A silver iodobromide tabular grain with an iodide content of 3.9 mole percent, based on silver, was used. The mean equivalent circular diameter of the emulsion was 2.16 μm, the average thickness of the tabular grains was 0.116 μm, and the average aspect ratio of the tabular grains was 18.6. Tabular grains accounted for greater than 90% of the total grain projected area.

The emulsion was optimally sensitized using sodium thiocyanate, 3-(N-methylsulfonyl)carbamoylethylbenzothiazolium tetrafluoroborate, around 1.05 mmole of spectral sensitizing dye per mole of silver, sodium aurous (I) dithiosulfate dihydrate, and sodium thiosulfate pentahydrate. Following the chemical additions the emulsion was subjected to a heat treatment as is common in the art.

The sensitizing dyes used for the spectral sensitization are given in Table 1-1. The multiple dye sensitization, sample number 106, was accomplished by simultaneously adding the dyes. To accomplish this the dyes were first co-dissolved in a water and gelatin mixture prior to addition to the emulsion.

TABLE 1-1

| Sample Number (Inventive/ Comparative) | Method of Dye Addition | Dyes Used | Mole Ratio of Dye Component | Fig. Number |
|---|---|---|---|---|
| 101 (Comp) | single dye | SD-06 | 100 | 1A |
| 102 (Comp) | single dye | SD-03 | 100 | 1B |
| 103 (Comp) | single dye | SD-04 | 100 | 1C |
| 104 (Comp) | single dye | SD-05 | 100 | 1D |
| 105 (Comp) | single dye | SD-02 | 100 | 1E |
| 106 (Inv) | mixed | SD-06 | 40 | IF |
| | | SD-03 | 31 | |
| | | SD-04 | 18 | |
| | | SD-05 | 7 | |
| | | SD-02 | 4 | |

A transparent film support of cellulose triacetate with conventional subbing layers was provided for coating. The side of the support to be emulsion coated received an undercoat layer of gelatin (4.9). The reverse side of the support was comprised of dispersed carbon pigment in a non-gelatin binder (Rem Jet).

The coatings were prepared by applying the following layers in the sequence set out below to the support. Hardener H-1 was included at the time of the coating at 1.80 percent by weight of total gelatin, including the undercoat, but excluding the previously hardened gelatin subbing layer forming a part of the support. Surfactant was also added to the various layers as is commonly practiced in the art.

| | |
|---|---|
| Layer 1: Light-Sensitive Layer | |
| Sensitized Emulsion silver | (1.08) |
| Cyan dye forming coupler C-1 | (0.97) |
| HBS-2 | (0.97) |
| Gelatin | (3.23) |
| TAI | (0.017) |
| Layer 2: Gelatin Overcoat | |
| Gelatin | (4.30) |

The dispersed carbon pigment on the back of the coating was removed with methanol. The light transmittance and reflectance of the sample was measured using a spectrophotometer over the visible light range (360 to 700 nanometers) at two nanometer wavelength increments. The total reflectance (R) is the fraction of light reflected from the coating, measured with an integrating sphere which includes all light exiting the coating regardless of angle. The total transmittance (T) is the fraction of light transmitted through the coating regardless of angle. The total absorptance (A) of the coating is determined from the measured total reflectance and total transmittance using the equation A=1−T−R. FIGS. 1A through 1F show the absorption of Samples 101 through 106, respectively. The wavelength of peak light absorption and the half-peak bandwidth of the light absorption (difference in wavelengths at which absorptance is half of the peak value) were then determined from the sensitizing dye absorptance data. The wavelength of maximum peak light absorption (highest absorptance value) and the overall half-peak bandwidth (based on the maximum peak absorptance) of the sensitizing dye absorptance data of each sample is tabulated in Table 1-2. The bandwidth at 80 percent absorption is also tabulated, and the ratio of the bandwidth at 80 percent absorption to the bandwidth at 50 percent absorption (Ratio $BW_{80}/BW_{50}$) is calculated and tabulated in Table 1-2. If more than one peak was present, the location of the other peak is tabulated under Secondary Peaks. A peak wavelength is defined as a local maximum in absorption values, such that the absorptance 2 nm hypsochromic and 2 nm bathochromic of the peak wavelength arc lower than the peak absorptance.

This example demonstrates that single dye spectral sensitizations have narrow half-peak bandwidths, and that a combination of carbocyanine dyes, separated by more than 5 nm in peak absorptance can be mixed in proportions to yield a peak dye absorptance within the range of 525 to 600 nm and a half-peak bandwidth between 70 and 150 nm, and have a ratio of 80 percent bandwidth to 50 percent bandwidth of greater than 0.25.

TABLE 1-2

| Sample Number (Inventive/ Comparative) | Wavelength of Maximum Absorption (Primary Peak) (nm) | Bandwidth at 80% Absorption (nm) | Bandwidth at 50% Absorption (nm) | Ratio $BW_{80}/BW_{50}$ | Secondary Absorption Peaks (nm) |
|---|---|---|---|---|---|
| 101 (Comp) | 574 | 8 | 17 | 0.47 | 530 |
| 102 (Comp) | 586 | 10 | 22 | 0.45 | none |
| 103 (Comp) | 612 | 9 | 19 | 0.47 | none |
| 104 (Comp) | 654 | 12 | 21 | 0.57 | none |
| 105 (Comp) | 670 | 18 | 36 | 0.50 | none |
| 106 (Inv) | 570 | 48 | 92 | 0.52 | none |

Example II

This example serves to demonstrate the close correspondence of the absorptance spectrum and the spectral sensitivity of a spectrally dyed silver halide emulsion.

Photographic sample 201 and 202 were prepared as in Example I. A silver iodobromide tabular grain with an iodide content of 3.9 mole percent, based on silver. The mean equivalent circular diameter of the emulsion was 4.11 $\mu$m, the average thickness of the tabular grains was 0.128 $\mu$m, and the average aspect ratio of the tabular grains was 32.1. Tabular grains accounted for greater than 90% of the total grain projected area.

The emulsion was optimally sensitized using the same method as in Example I.

The sensitizing dyes used for the spectral sensitization are given in Table 2-1. Multiple dye sensitizations were accomplished by simultaneously adding the dyes to the emulsion during sensitization. To accomplish this the dyes were first co-dissolved in methanol solution prior to addition to the emulsion.

TABLE 2-1

| Sample Number (Inventive/ Comparative) | Method of Dye Addition | Dyes Used | Mole Ratio of Dye Component | Fig. Number |
|---|---|---|---|---|
| 201 (Comp) | mixed | SD-06 | 40 | 2A |
| | | SD-03 | 31 | |
| | | SD-04 | 18 | |
| | | SD-05 | 7 | |
| | | SD-02 | 4 | |
| 202 (Comp) | mixed | SD-12 | 55 | 2B |
| | | SD-11 | 35 | |
| | | SD-02 | 10 | |

Figure 2A:
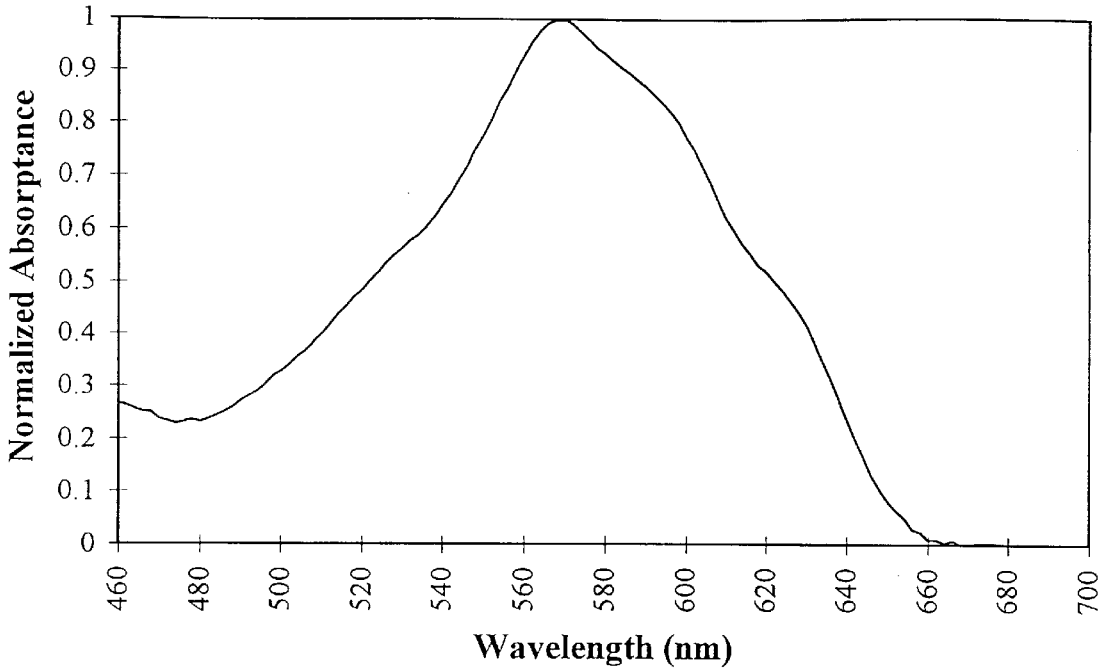
FIGS. 2A and 2B are absorption spectra of sample materials as described in Example II below.
Figure 2B:
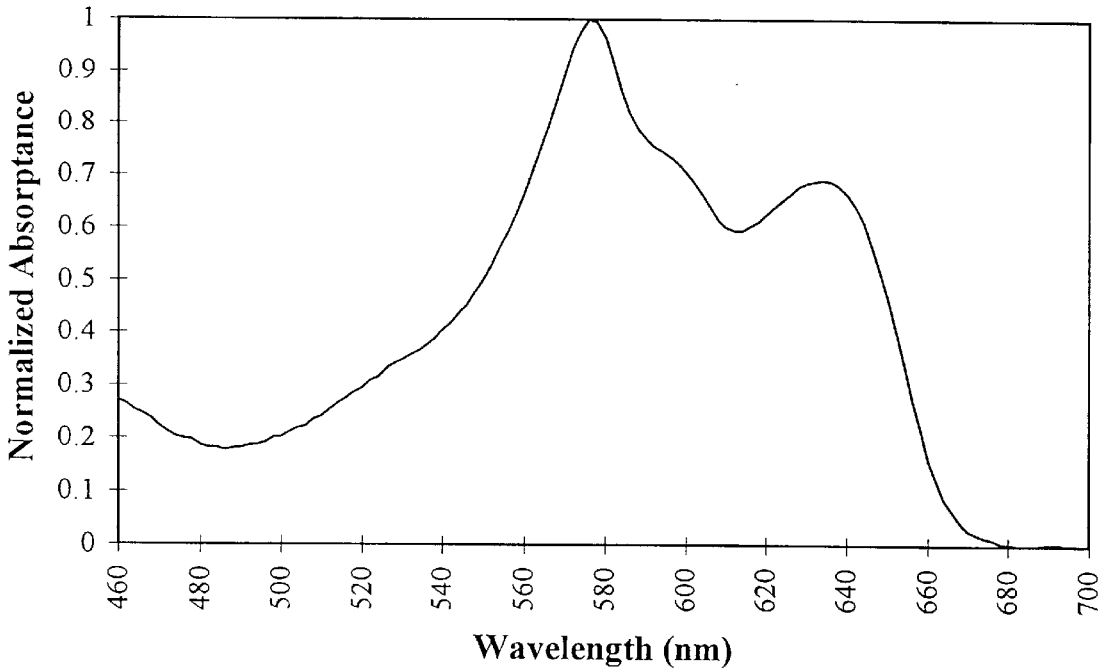

The absorptance of the coating was determined using a spectrophotometer as in Example I. The absorptance data in the dyed region was normalized by the peak absorption and the normalized absorptance was plotted versus the wavelength in FIGS. 2A and 2B.

The sensitivities over the visible spectrum of the samples 201 and 202 were determined in 10-nm increments using nearly monochromatic light of carefully calibrated output from 460 to 690 nm. The samples were individually exposed for 1/100 of a second to white light from a tungsten light source of 3200K color temperature that was filtered by a Daylight Va filter to 5500K and by a monochromator with a 4-nm bandpass resolution through a graduated 0–3.0 density step tablet to determine their speed. The samples were then processed using the KODAK Flexicolor C-4™ process, as described by *The British Journal of Photography Annual* of 1988, pp. 196–198, with fresh, unseasoned processing chemical solutions. Another description of the use of the Flexicolor C-41 process is provided by *Using Kodak Flexicolor Chemicals*, Kodak Publication No. Z-131, Eastman Kodak Company, Rochester, N.Y.

Figure 2C:
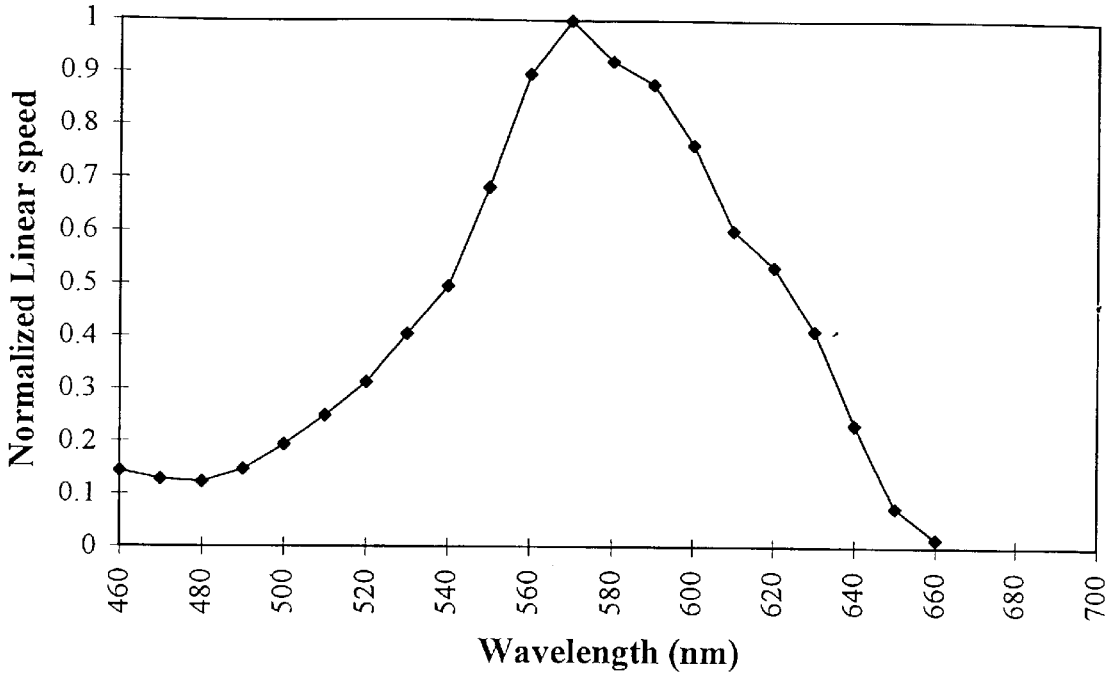
FIGS. 2C and 2D are linear speed versus wavelength plots of sample materials as described in Example II below.
Figure 2D:
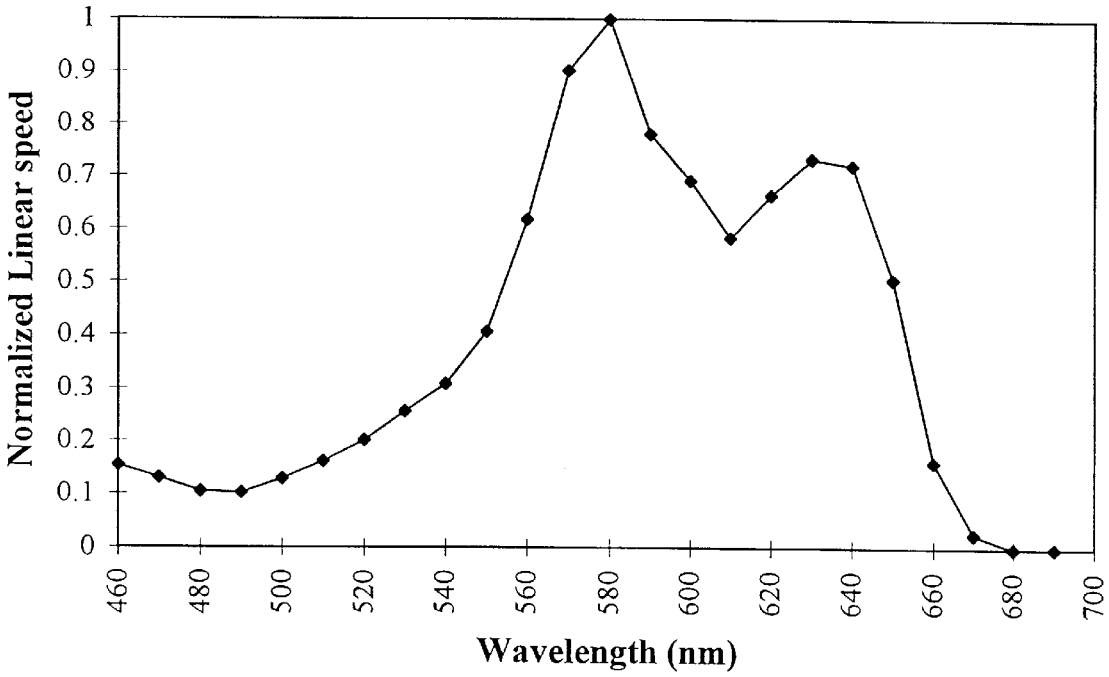
Figure 3A:
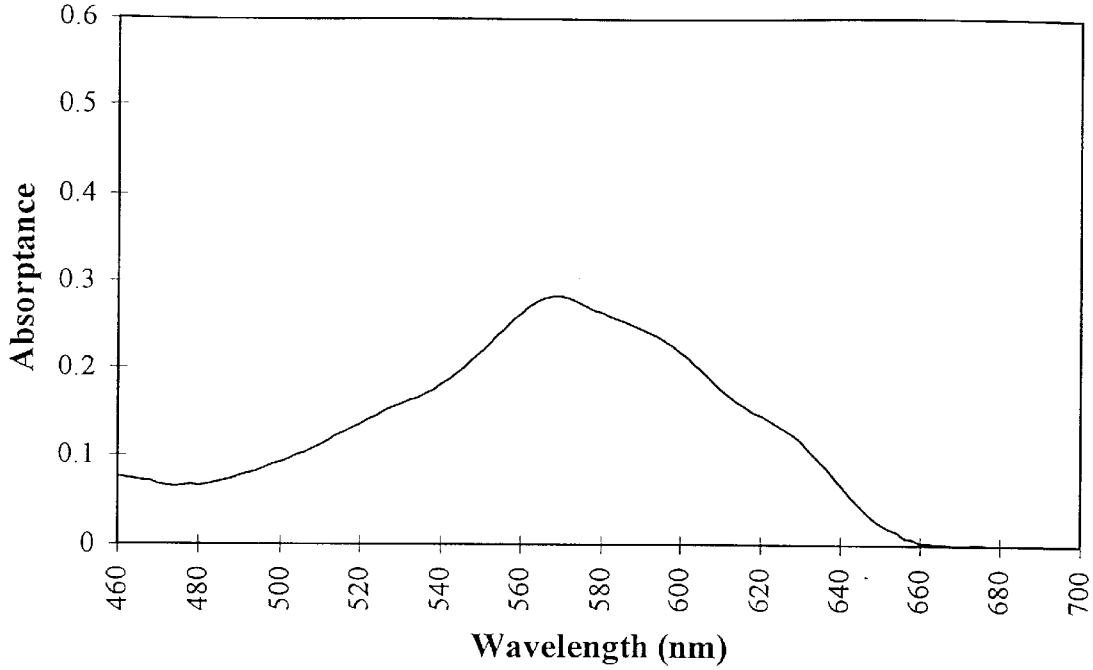
FIGS. 3A through 4G are absorption spectra of sample materials as described in Example III below.
Figure 3B:
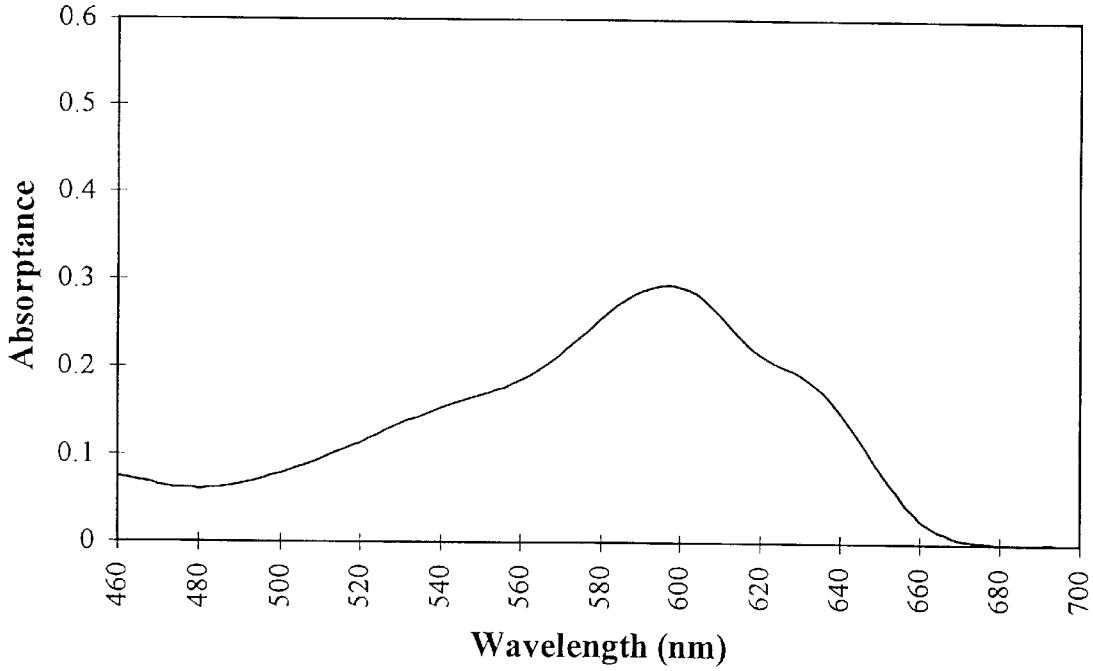
Figure 3C:
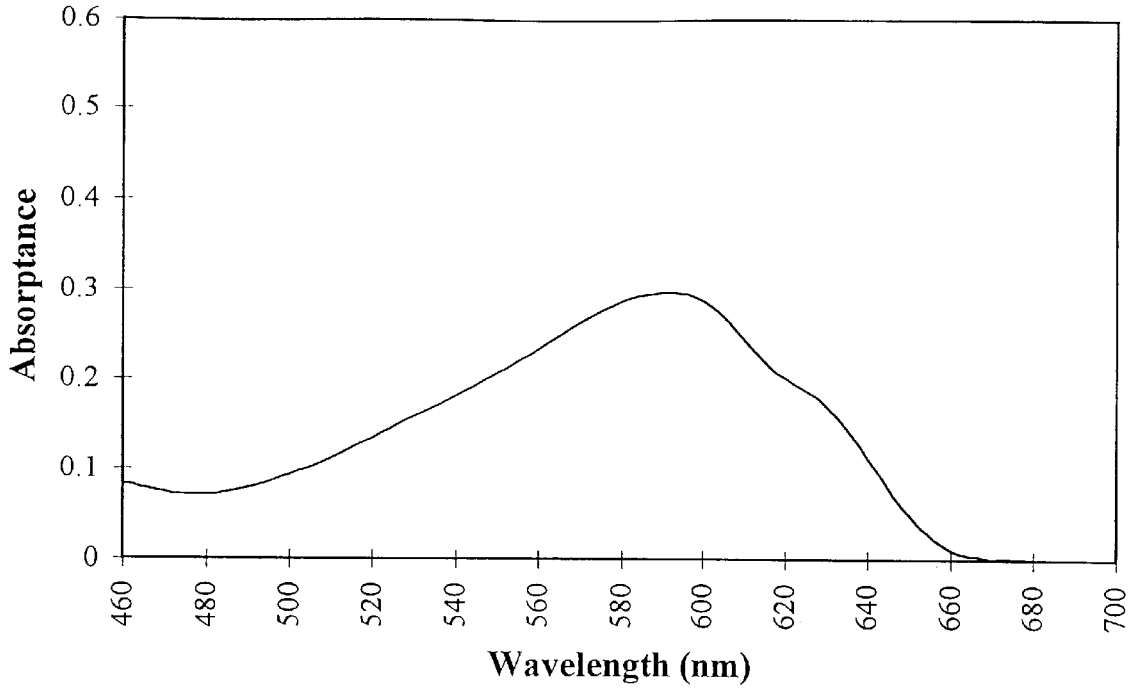
Figure 3D:
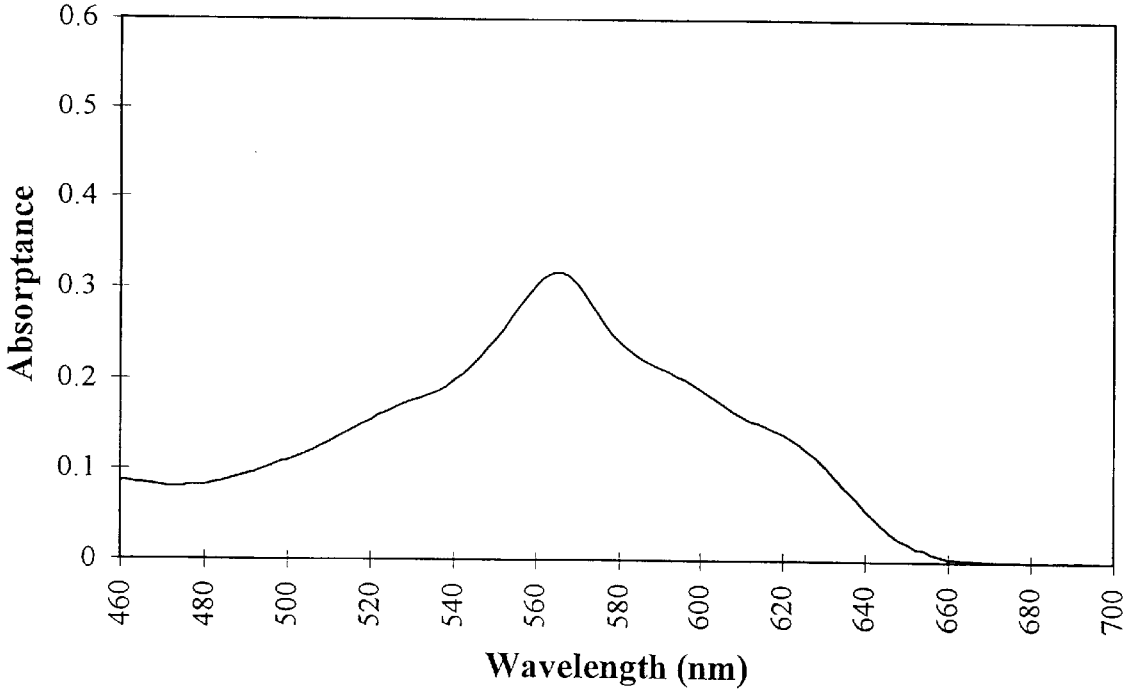
Figure 3E:
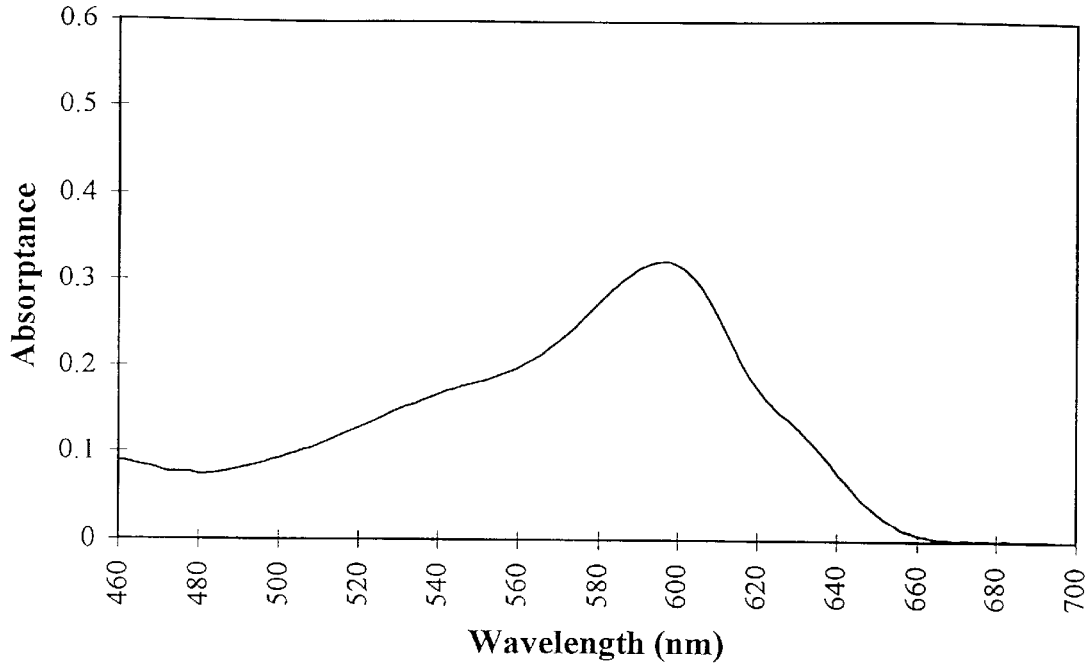
Figure 3F:
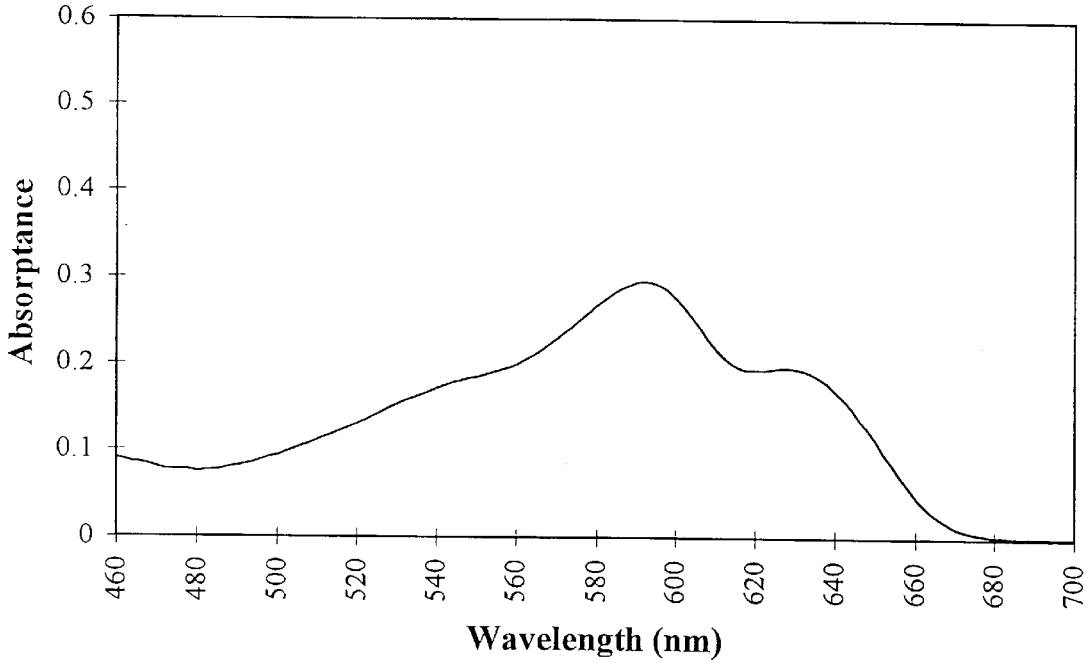
Figure 3G:
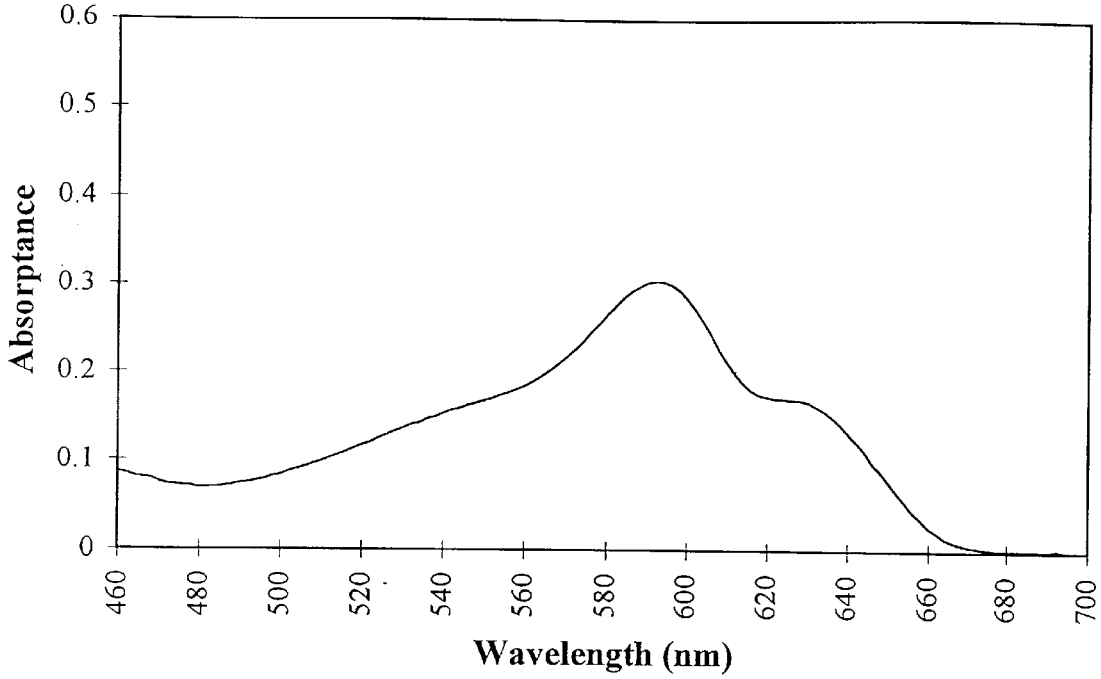
Figure 3H:
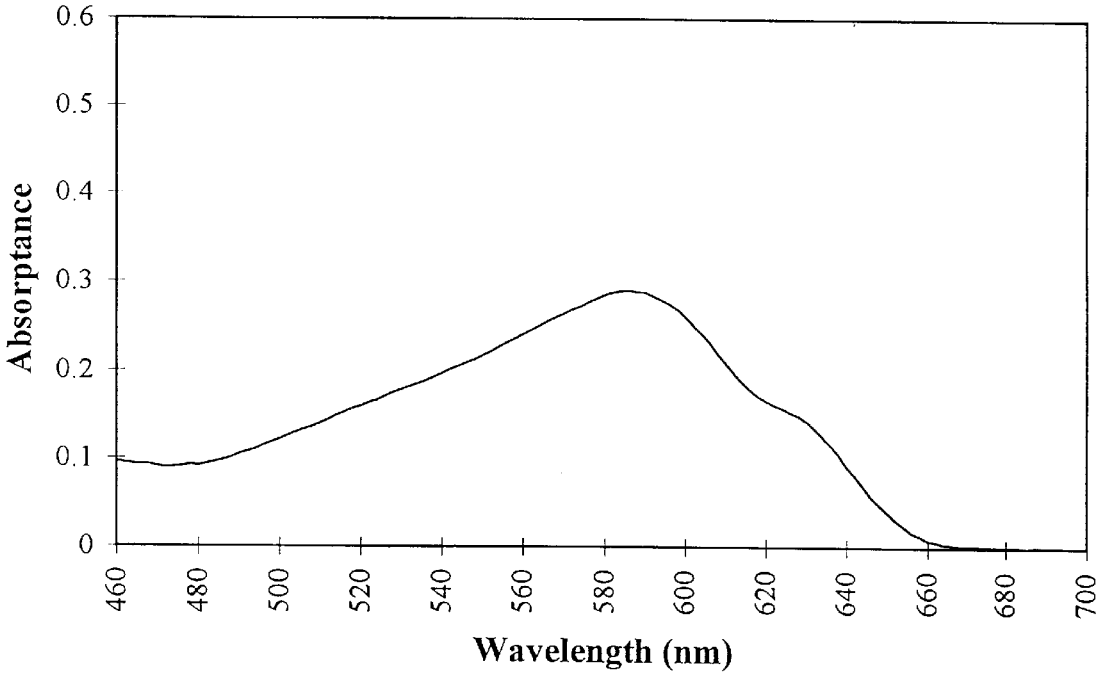
Figure 3I:
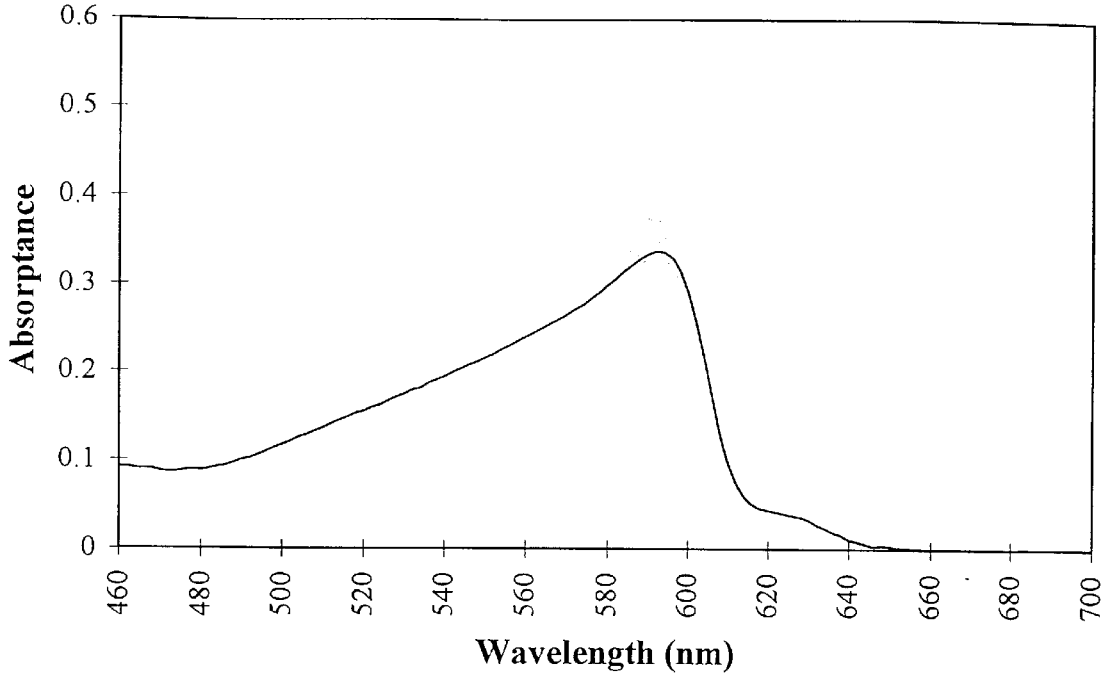
Figure 3J:
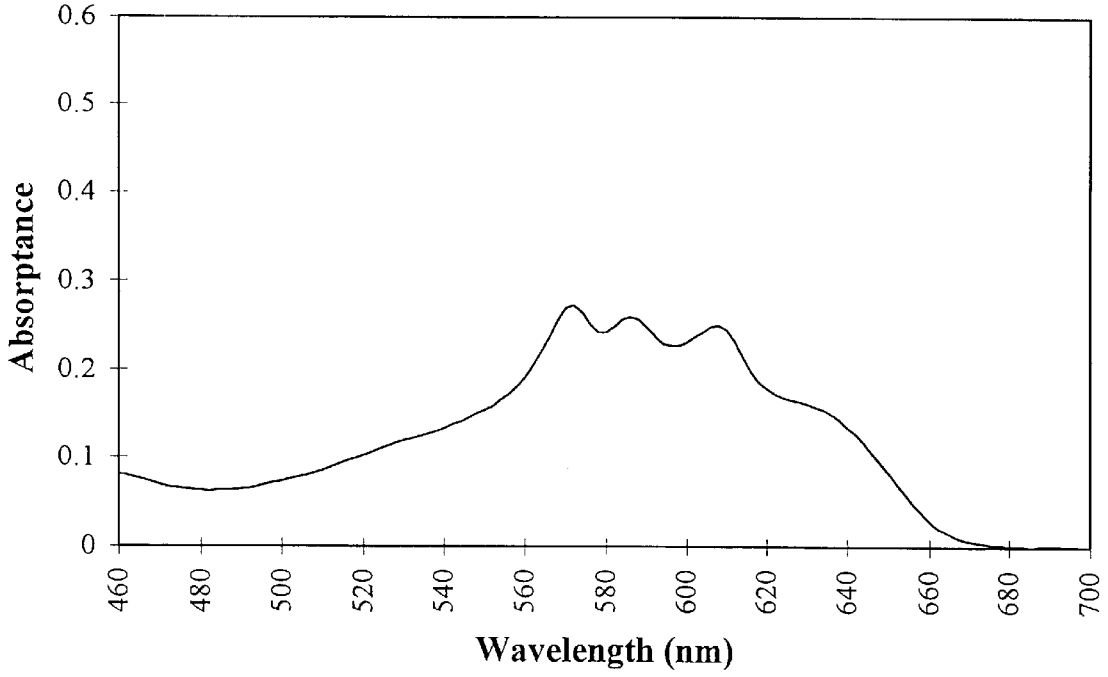
Figure 3K:
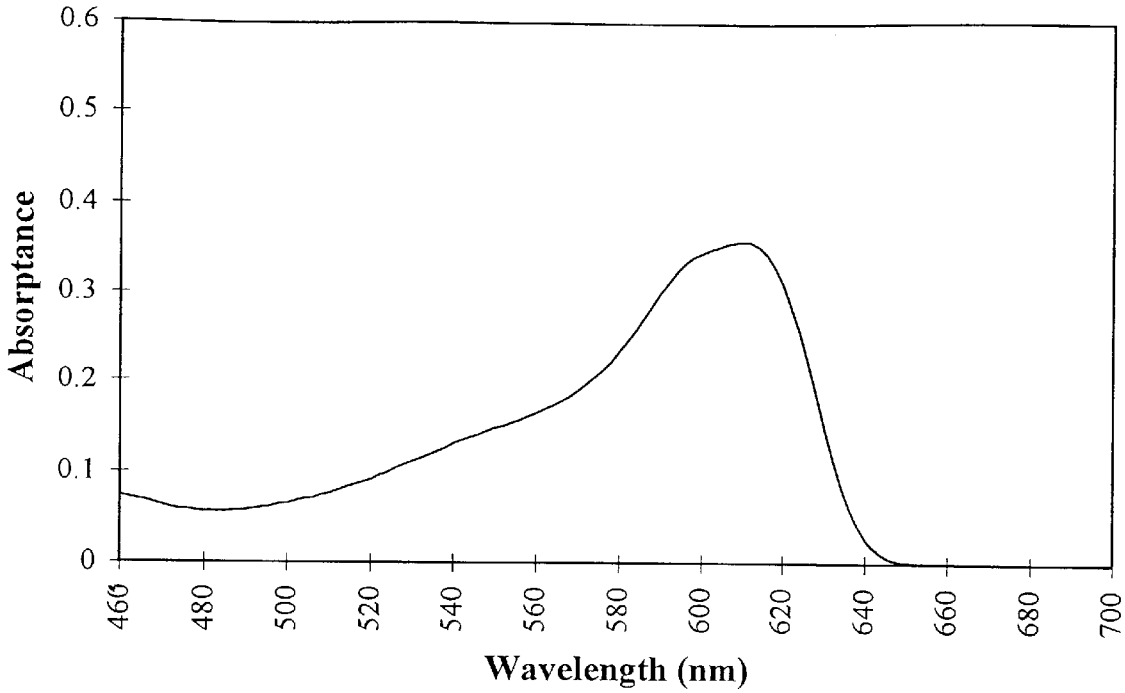
Figure 3L:
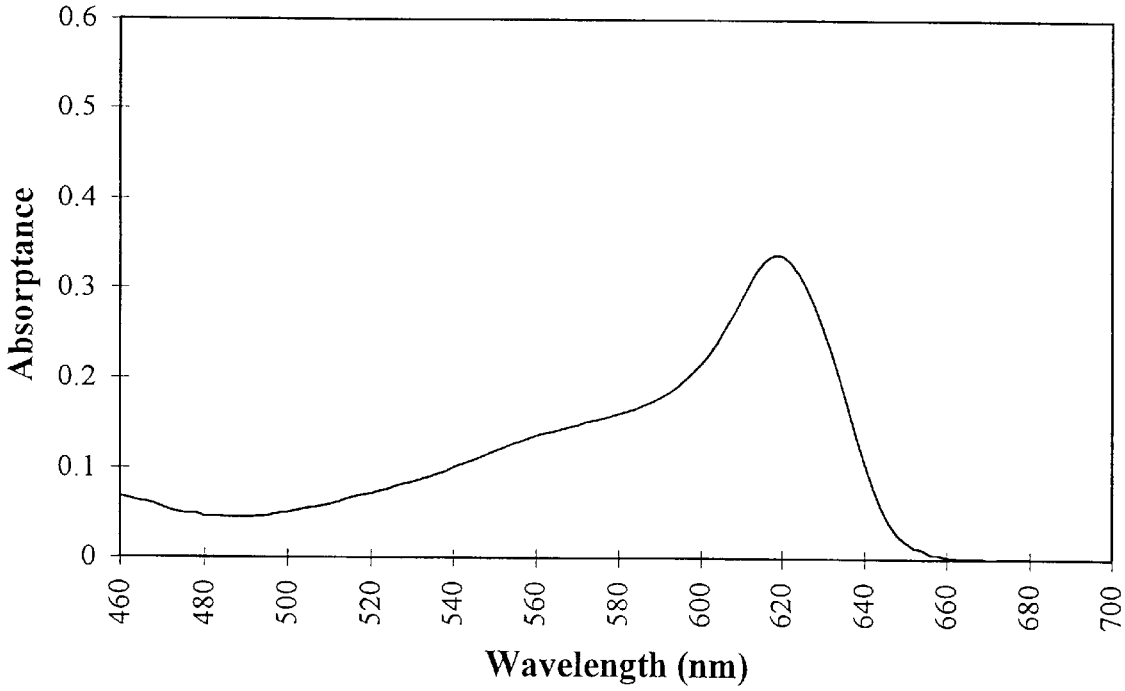
Figure 3M:
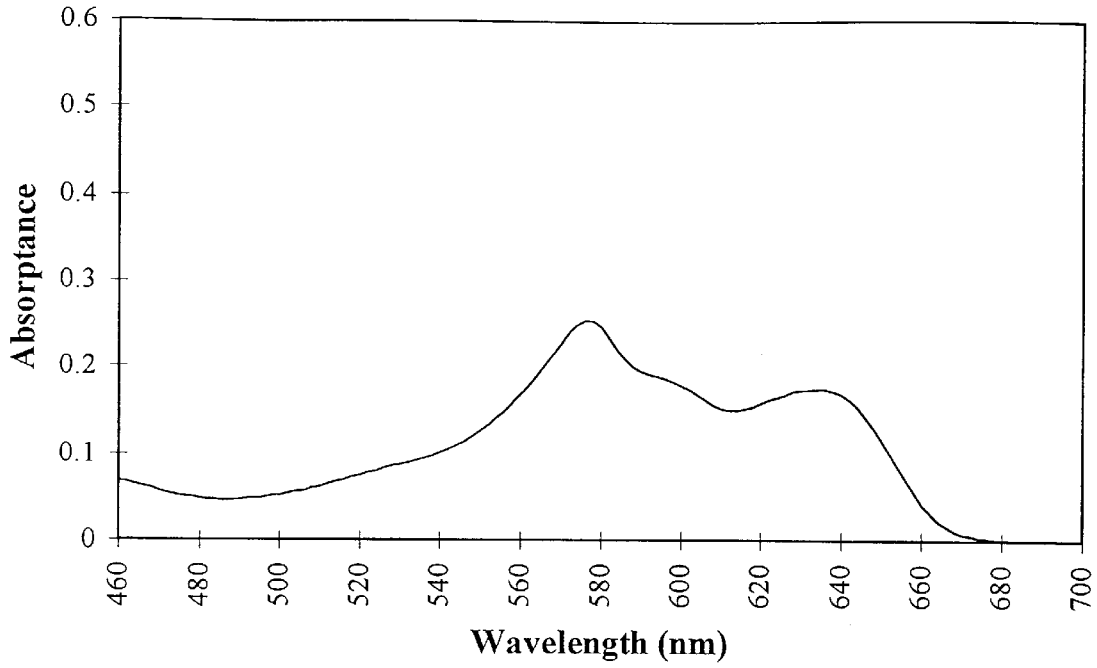
Figure 3N:
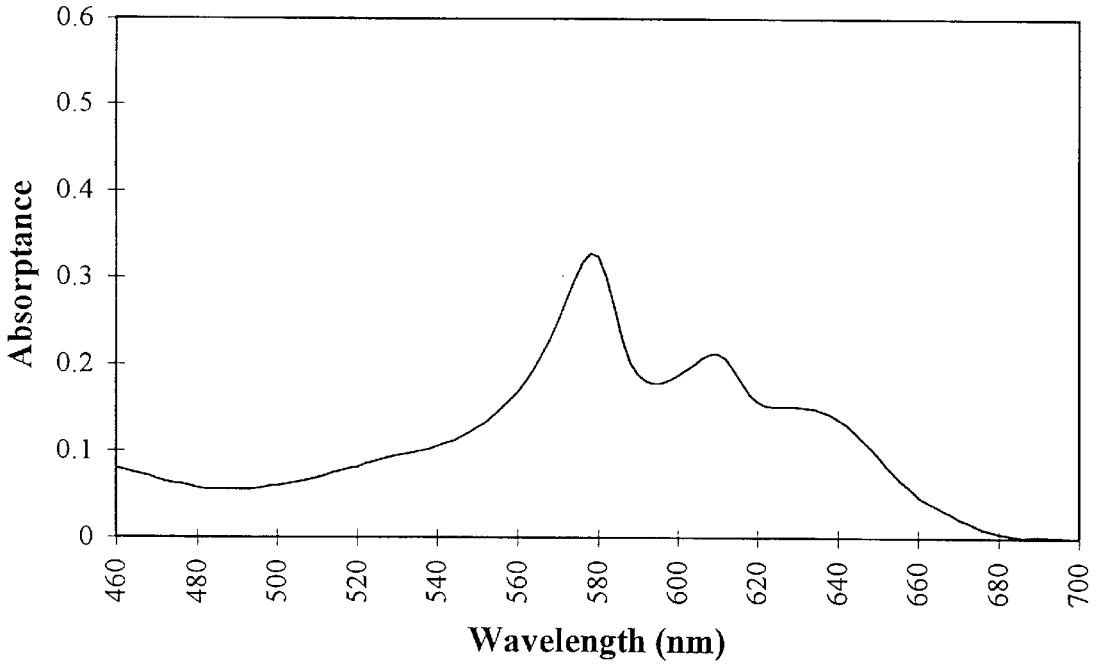
Figure 3O:
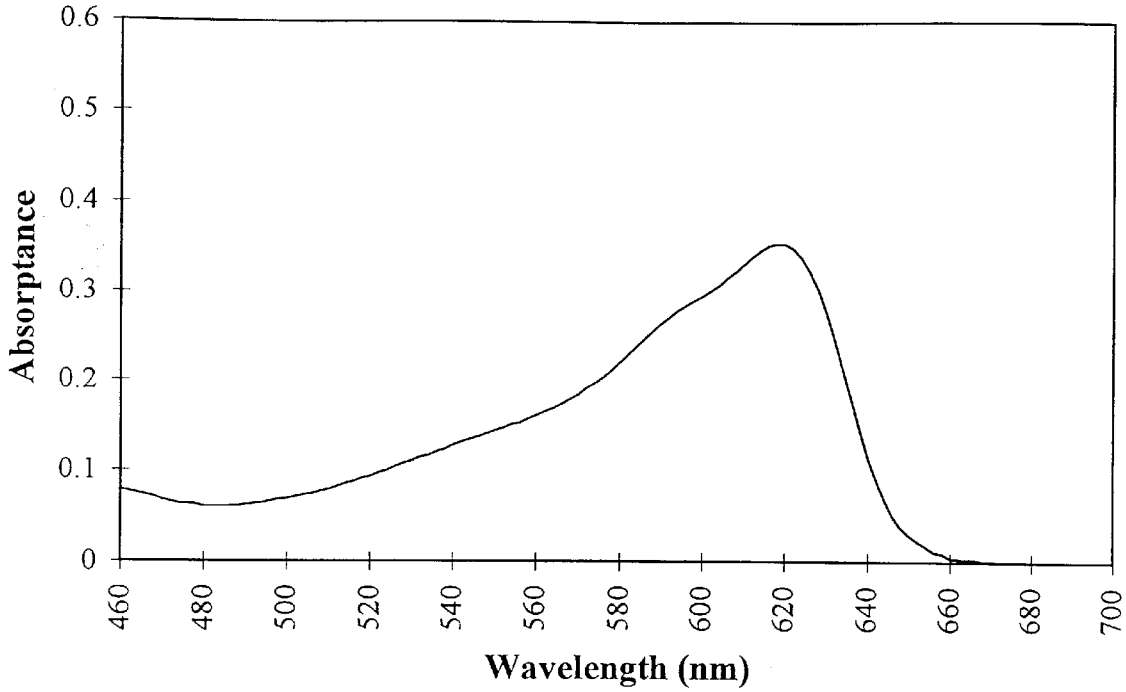
Figure 3P:
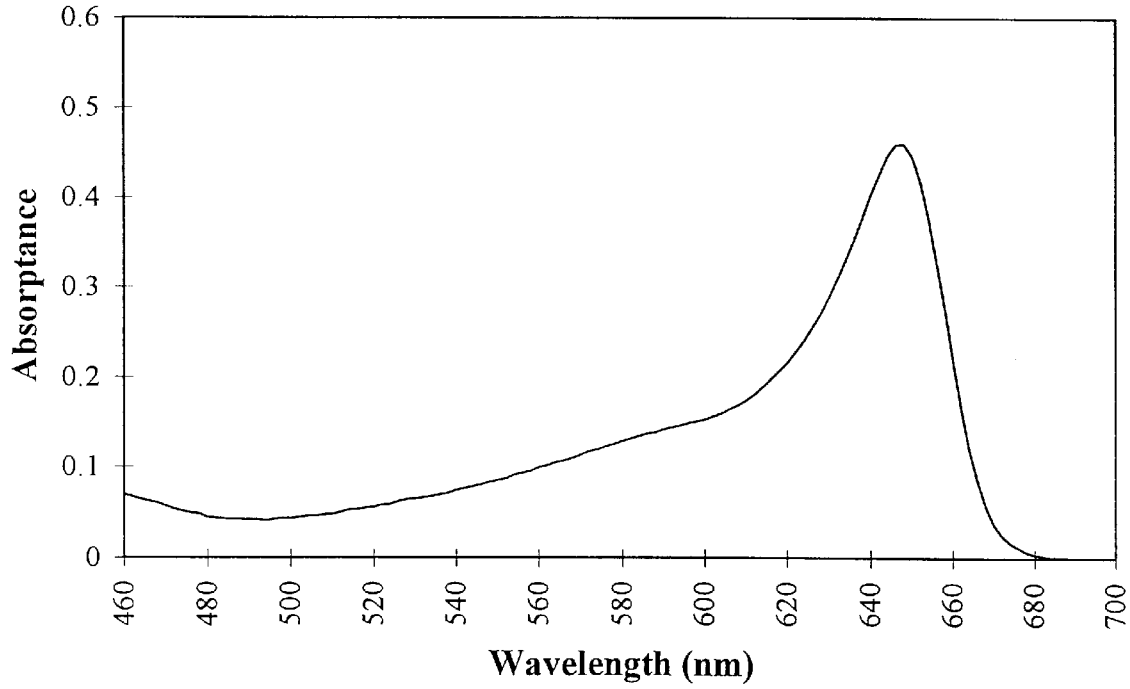
Figure 3Q:
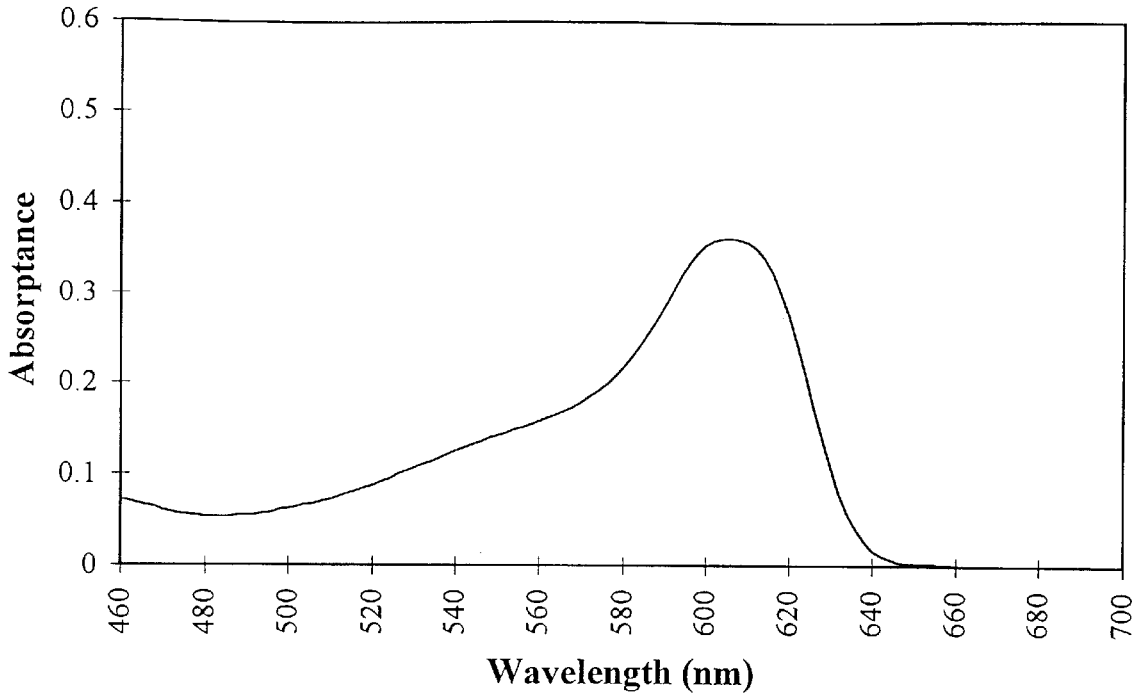
Figure 3R:
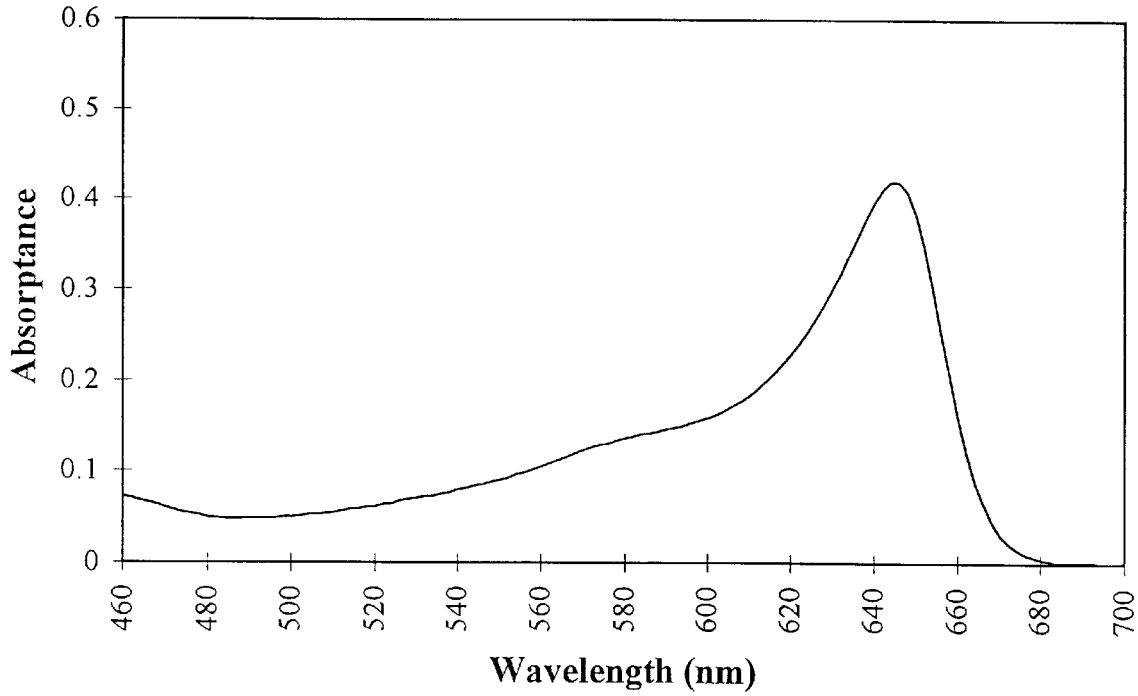
Figure 3S:
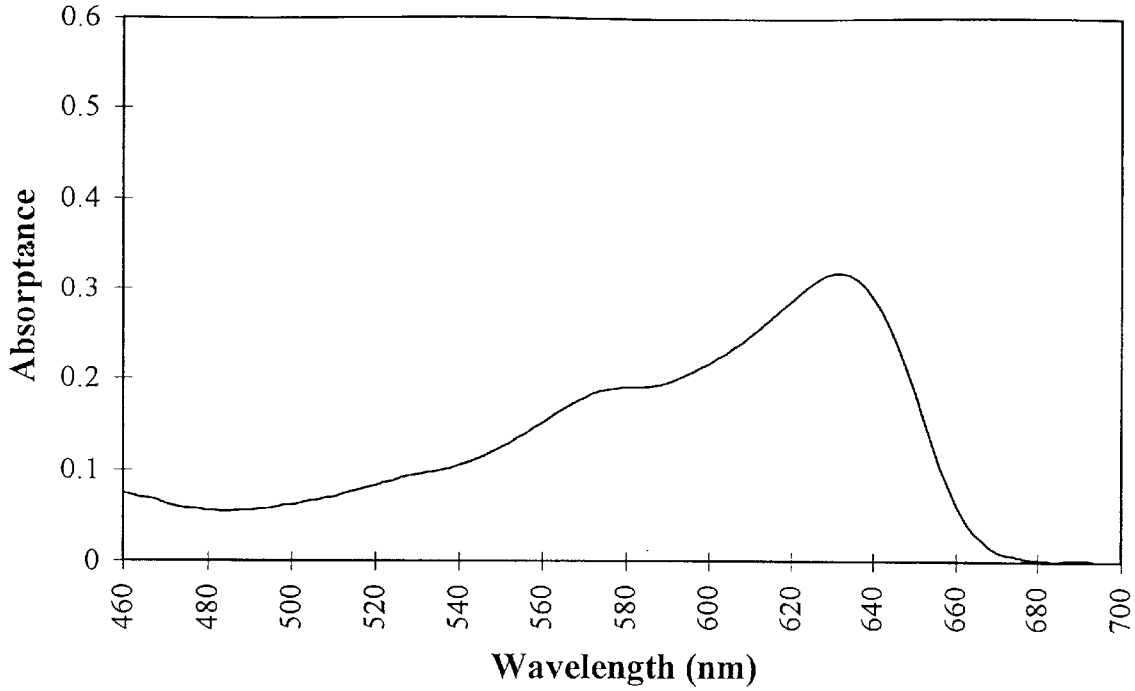
Figure 3T:
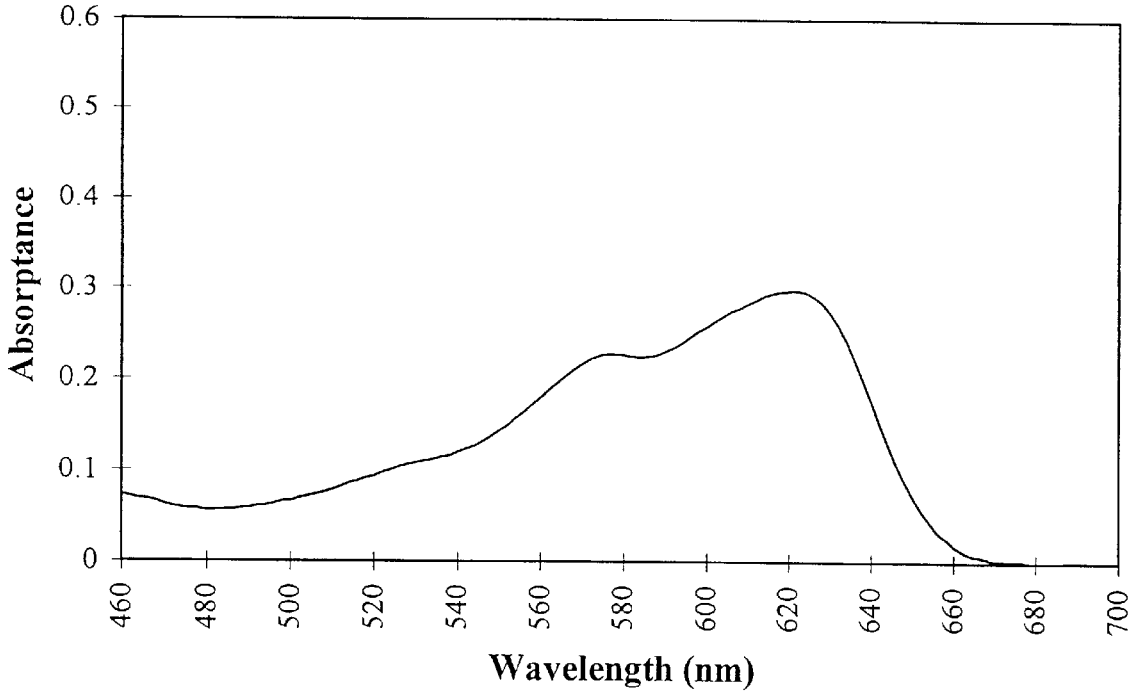
Figure 3U:
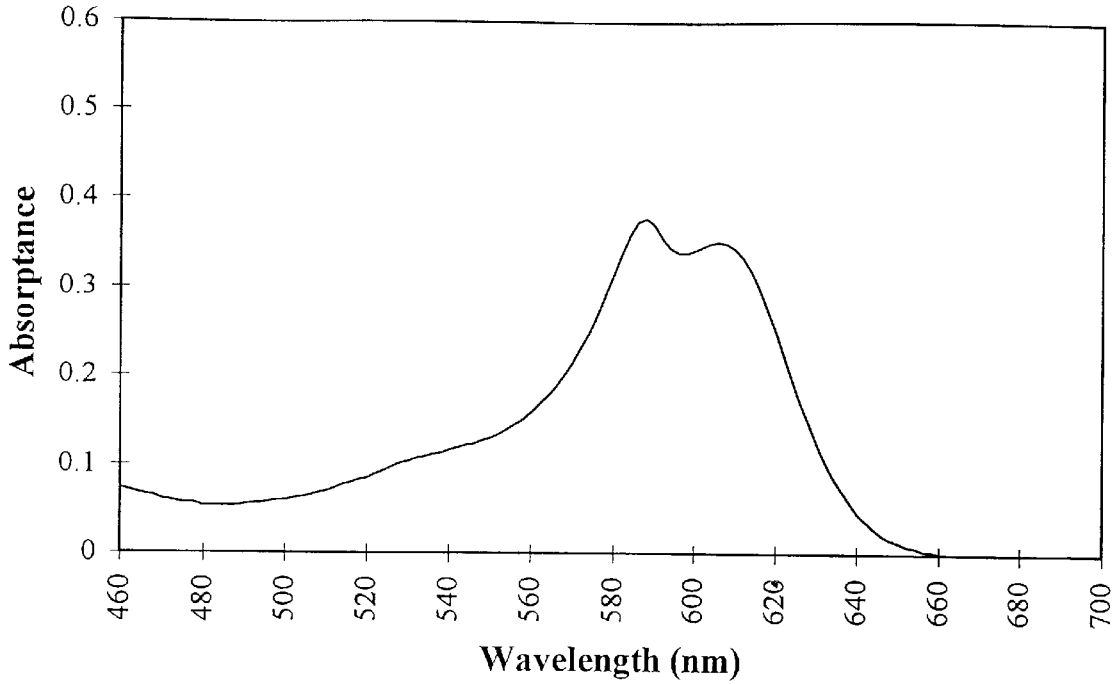
Figure 3V:
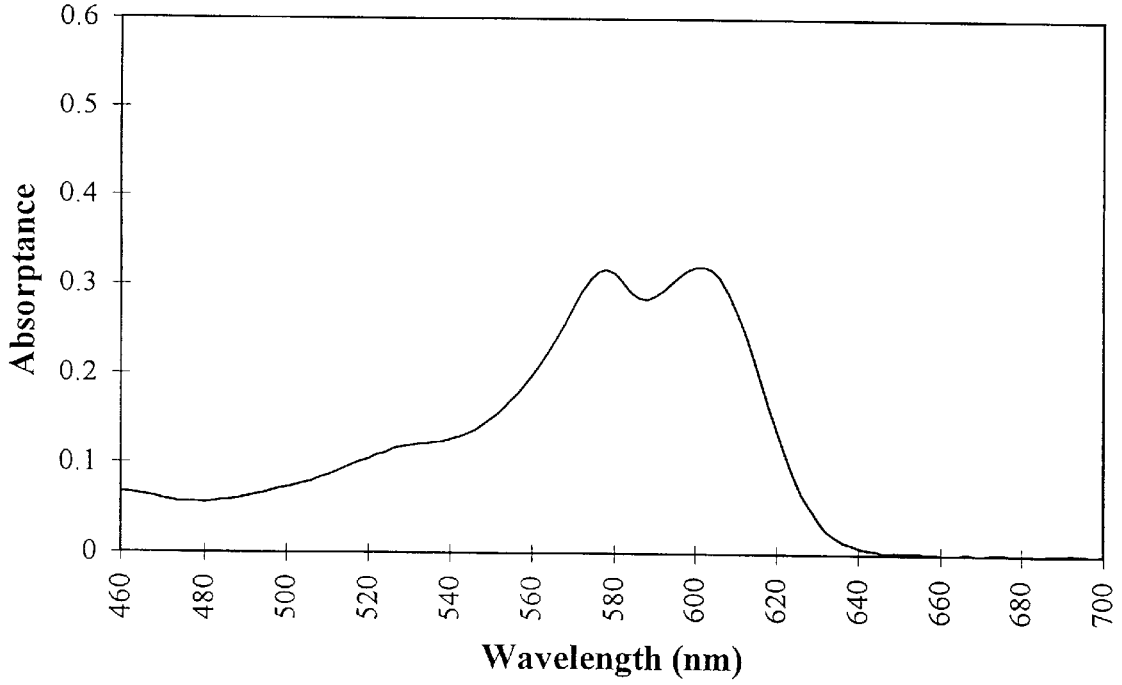
Figure 3W:
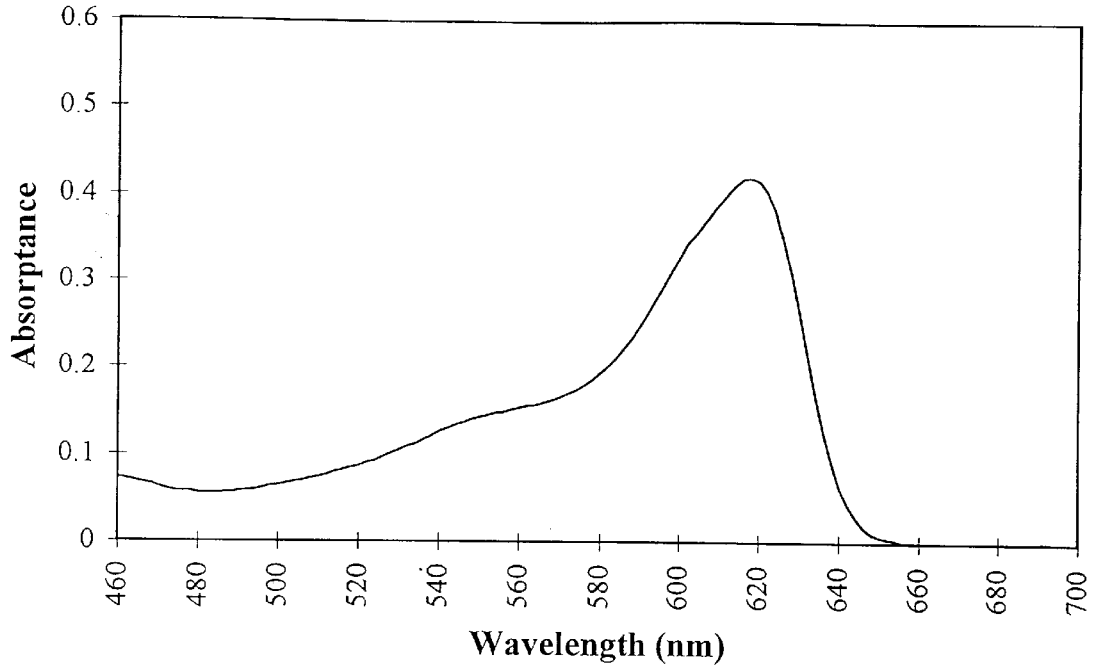
Figure 3X:
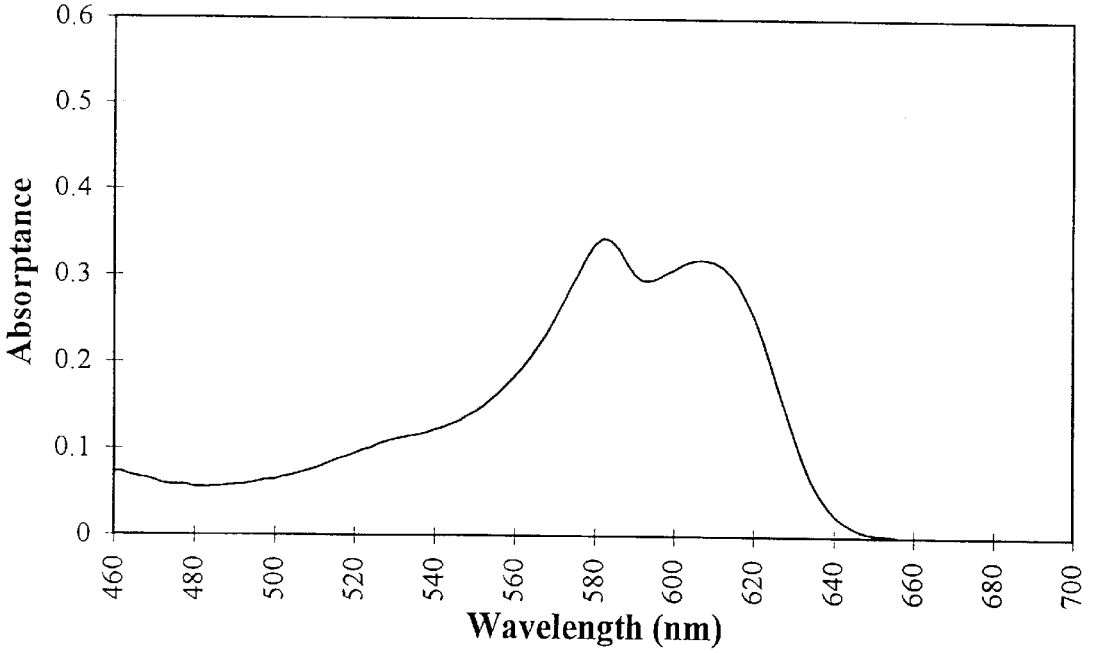
Figure 3Y:
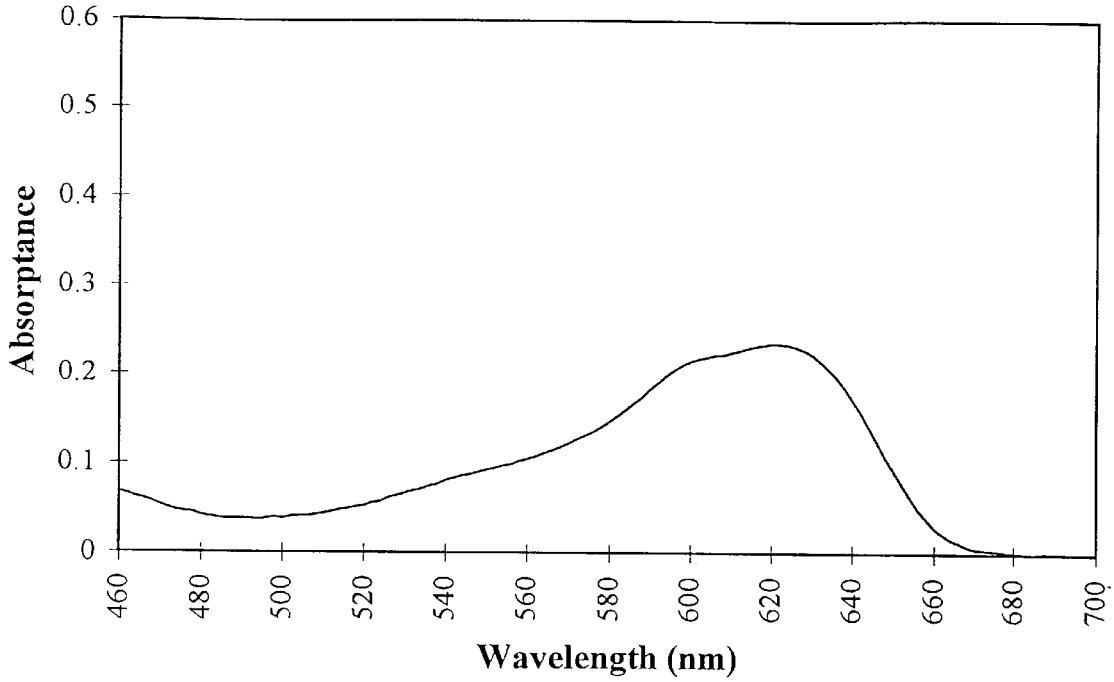
Figure 3Z:
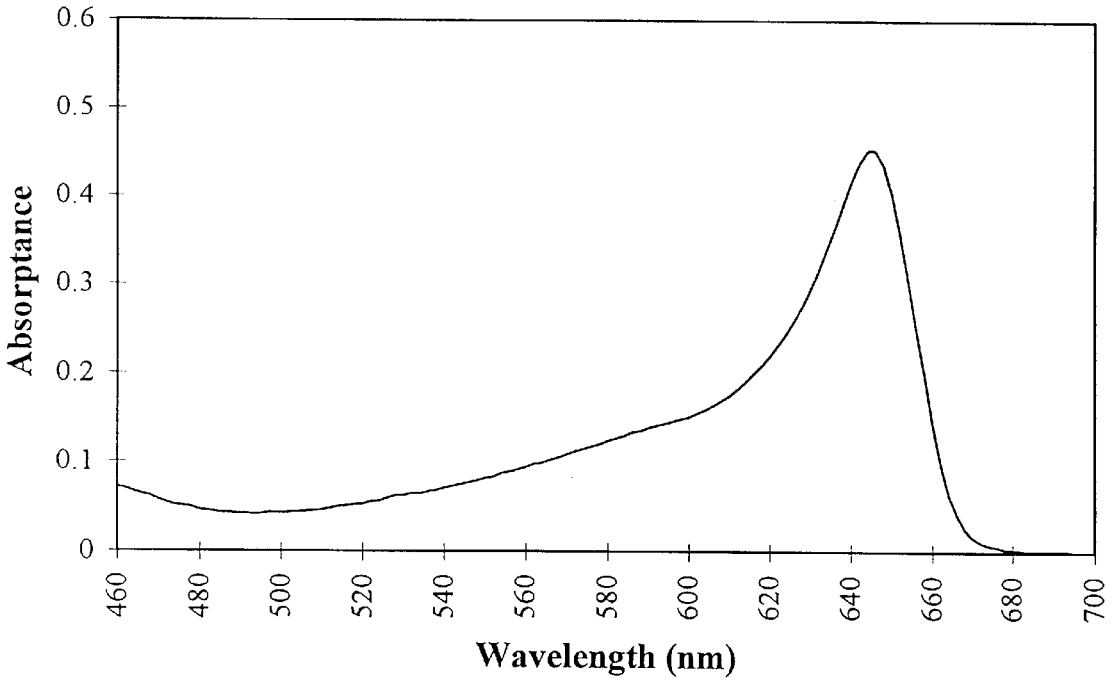
Figure 4A:
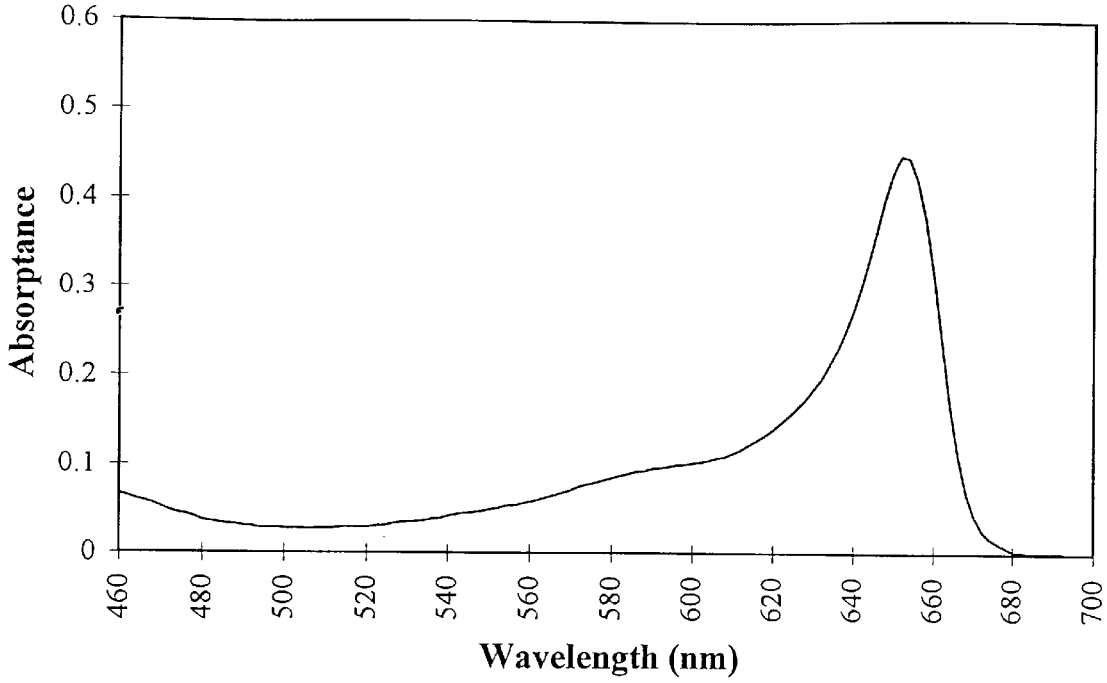
Figure 4B:
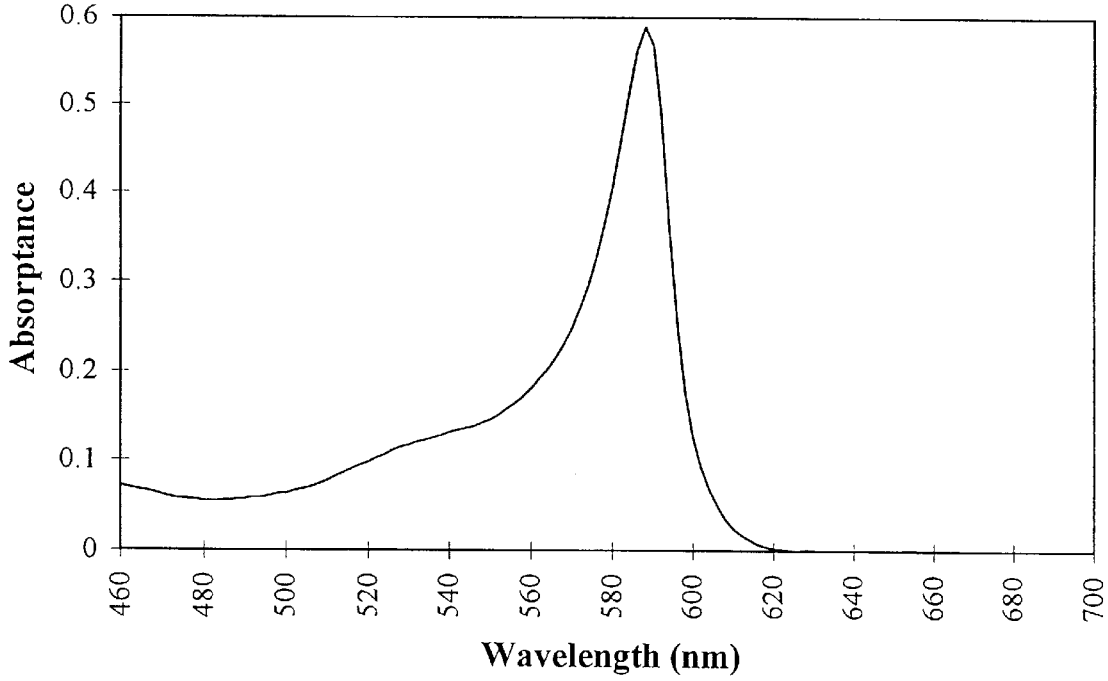
Figure 4C:
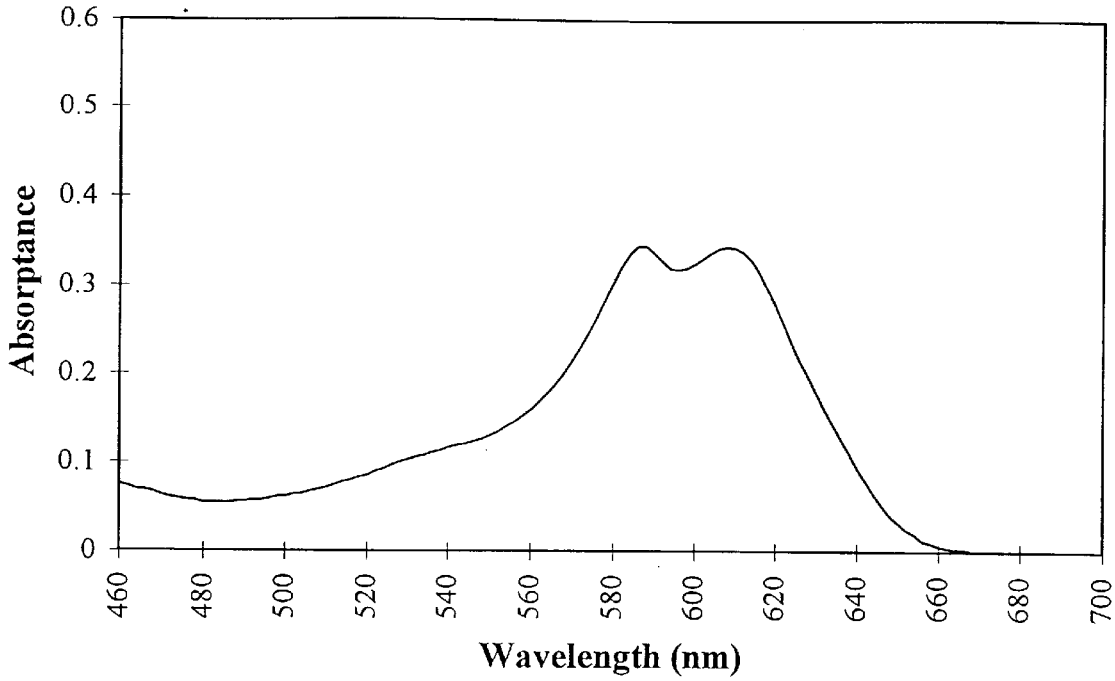
Figure 4D:
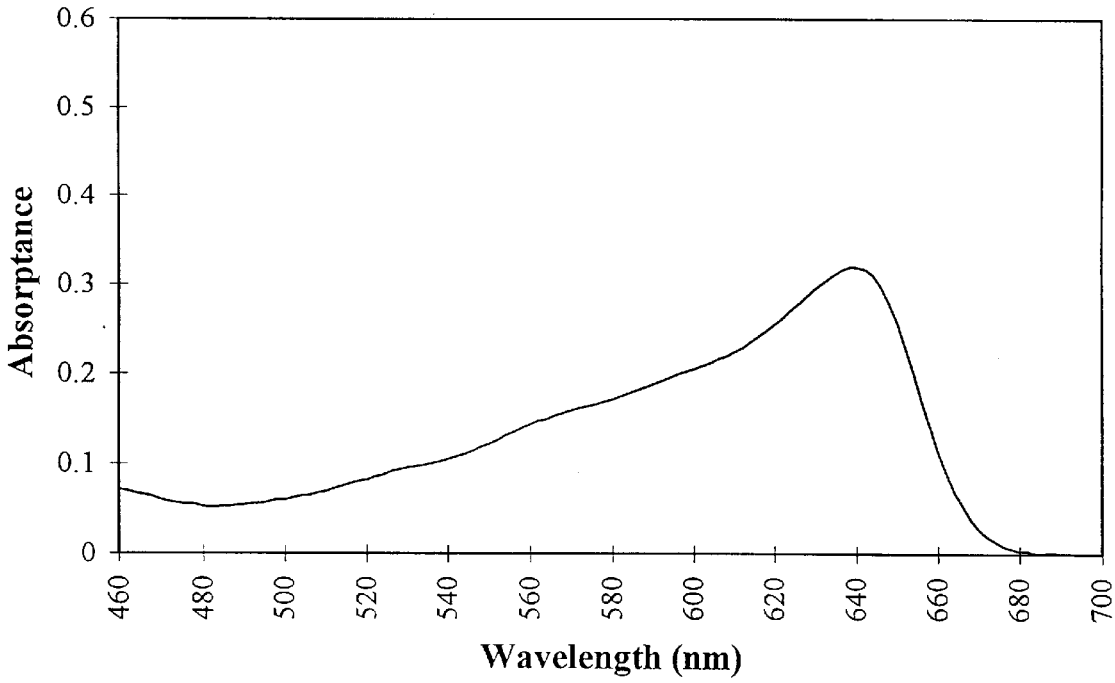
Figure 4E:
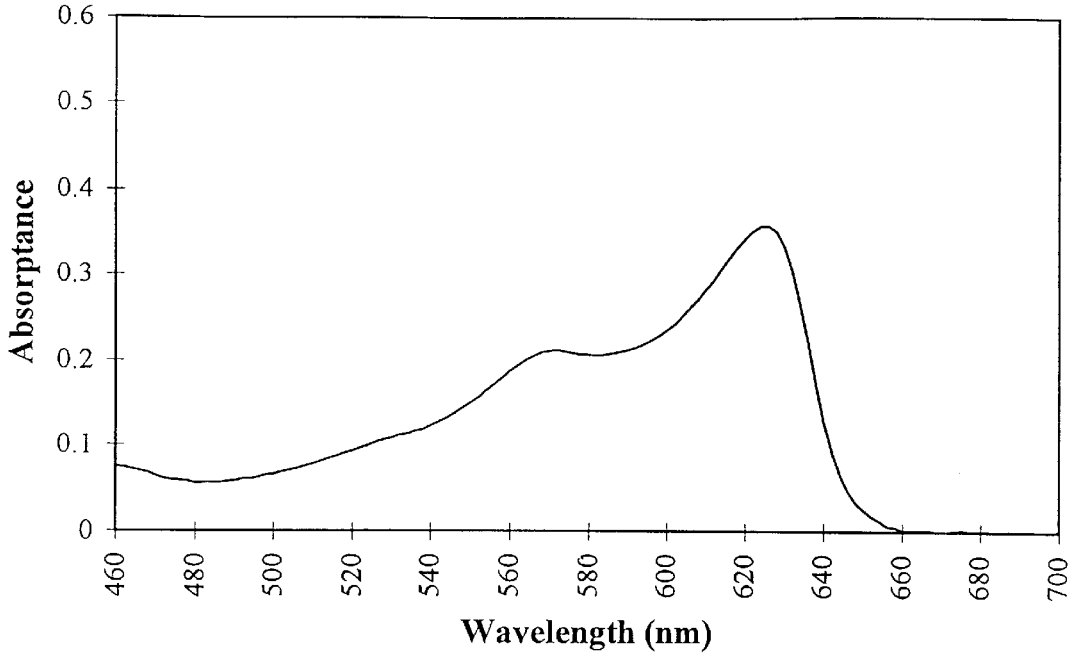
Figure 4F:
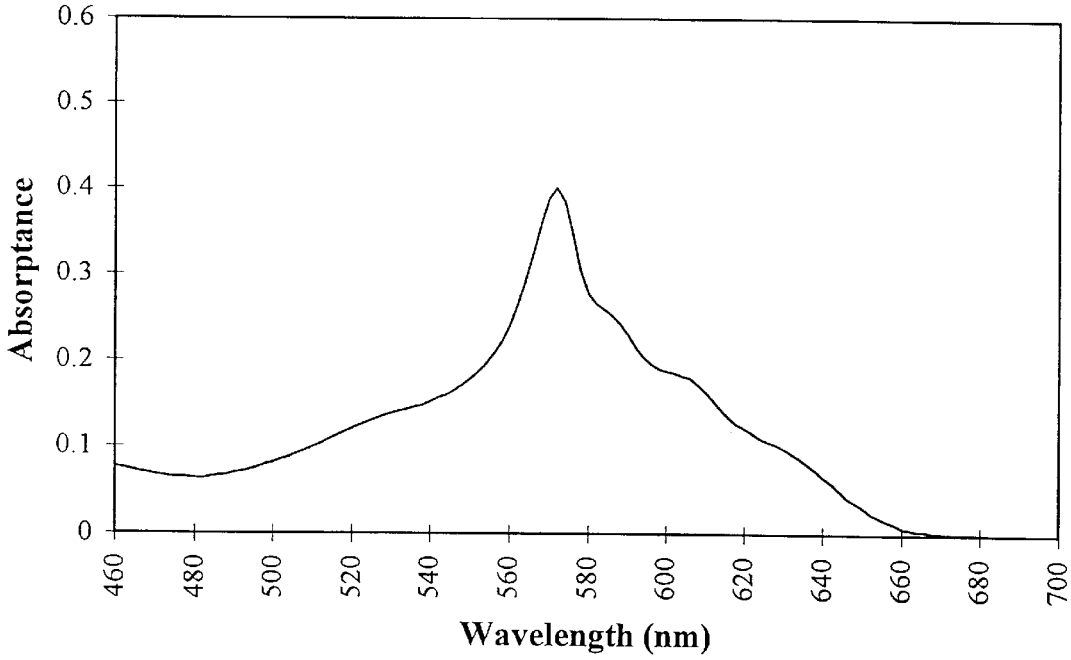
Figure 4G:
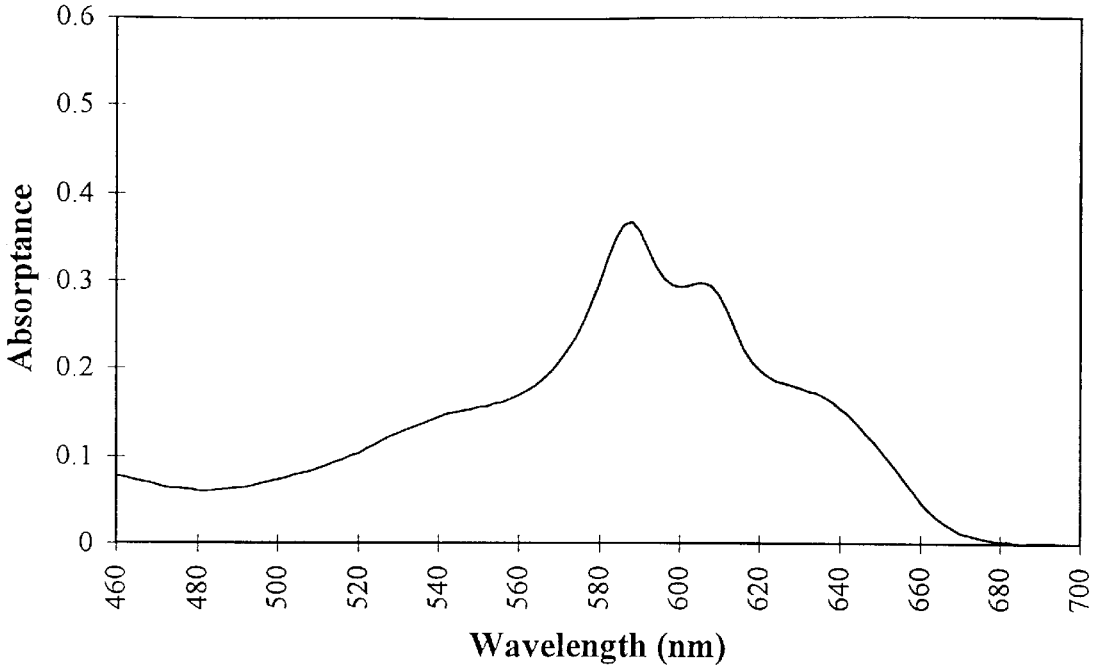

Following processing and drying, Samples 201–202 were subjected to Status M densitometry and their sensitometric performance over the range 460 to 690 nm was characterized. The exposure required to produce a density increase of 0.30 above minimum density was calculated for the samples at each 10-nm increment exposed, and the logarithmic speed- the logarithm of the reciprocal of the required exposure in ergs/square centimeter, was determined. The speed was then converted from logarithmic to linear space to correspond with the absorption measurements. The linear speed was normalized by the peak speed in the region 460 to 690 nm, and the normalized linear speed versus wavelength data is plotted in FIGS. 2C and 2D.

Comparing the Figures of the normalized absorptance versus wavelength data (FIGS. 2A and 2B) with the corresponding Figures of the normalized linear speed versus wavelength data (FIGS. 2C and 2D), it is clear that there is a direct relationship between the light absorbed by a dyed emulsion on a coating and the spectral sensitivity distribution, which is a measure of how the emulsion converts photons of absorbed light to a developable latent image, which is subsequently developed and converted to a dye image through chemical processing.

Example III

Photographic samples 301 through 333 were prepared. A silver iodobromide tabular grain with an iodide content of 3.9 mole percent, based on silver, was provided. The mean equivalent circular diameter of the emulsion was 2.16 $\mu$m, the average thickness of the tabular grains was 0.116 $\mu$m, and the average aspect ratio of the tabular grains was 18.6.

Tabular grains accounted for greater than 90 percent of the total grain projected area.

The emulsion was optimally sensitized using sodium thiocyanate, 3-(N-methylsulfonyl) carbamoylethylbenzothiazolium tetrafluoroborate, around 0.8 mmole of spectral sensitizing dye per mole of silver, sodium aurous(I) dithiosulfate dihydrate, and sodium thiosulfate pentahydrate. Following the chemical additions the emulsion was subjected to a heat treatment as is common in the art.

Sensitizing dyes SD-01 through SD-18 were used as given in Table 3-1. Dyes that were added simultaneously (mixed) were co-dissolved in methanol or co-mixed from gelatin dispersions prior to addition to the emulsion. Dyes that were added separately were added one at a time to the emulsion, in the order shown, with a 20 minute hold time between dye additions.

TABLE 3-1

| Sample Number (Inventive/ Comparative) | Method of Dye Addition | Dyes Used | Mole Ratio of Dye Component | Fig. Number |
|---|---|---|---|---|
| 301 (Inv) | mixed | SD-06 | 40 | 3A |
| | | SD-03 | 31 | |
| | | SD-04 | 18 | |
| | | SD-05 | 7 | |
| | | SD-02 | 4 | |
| 302 (Inv) | mixed | SD-03 | 52 | 3B |
| | | SD-04 | 30 | |
| | | SD-05 | 11 | |
| | | SD-02 | 7 | |
| 303 (Inv) | mixed | SD-06 | 20 | 3C |
| | | SD-03 | 41.5 | |
| | | SD-04 | 24 | |
| | | SD-05 | 9 | |
| | | SD-02 | 5.5 | |
| 304 (Inv) | mixed | SD-01 | 5 | 3D |
| | | SD-06 | 50 | |
| | | SD-03 | 20 | |
| | | SD-04 | 11 | |
| | | SD-05 | 9 | |
| | | SD-02 | 5 | |
| 305 (Inv) | mixed | SD-03 | 60 | 3E |
| | | SD-04 | 30 | |
| | | SD-05 | 7.5 | |
| | | SD-02 | 2.5 | |
| 306 (Inv) | mixed | SD-03 | 55 | 3F |
| | | SD-04 | 30 | |
| | | SD-05 | 5 | |
| | | SD-02 | 10 | |
| 307 (Inv) | mixed | SD-03 | 57.5 | 3G |
| | | SD-04 | 30 | |
| | | SD-05 | 5 | |
| | | SD-02 | 7.5 | |
| 308 (Inv) | mixed | SD-18 | 30 | 3H |
| | | SD-03 | 36.4 | |
| | | SD-04 | 21 | |
| | | SD-05 | 8 | |
| | | SD-02 | 4.6 | |
| 309 (Inv) | mixed | SD-18 | 33.3 | 3I |
| | | SD-03 | 33.3 | |
| | | SD-04 | 33.3 | |
| 310 (Inv) | separately | SD-06 | 20 | 3J |
| | | SD-03 | 41.5 | |
| | | SD-04 | 24 | |
| | | SD-05 | 9 | |
| | | SD-02 | 5.5 | |
| 311 (Comp) | mixed | SD-08 | 45 | 3K |
| | | SD-09 | 40 | |
| | | SD-05 | 15 | |
| 312 (Comp) | mixed | SD-08 | 45 | 3L |
| | | SD-10 | 40 | |
| | | SD-05 | 15 | |

TABLE 3-1-continued

| Sample Number (Inventive/ Comparative) | Method of Dye Addition | Dyes Used | Mole Ratio of Dye Component | Fig. Number |
|---|---|---|---|---|
| 313 (Comp) | mixed | SD-12 | 55 | 3M |
| | | SD-11 | 35 | |
| | | SD-02 | 10 | |
| 314 (Comp) | separately | SD-12 | 55 | 3N |
| | | SD-11 | 35 | |
| | | SD-02 | 10 | |
| 315 (Comp) | mixed | SD-09 | 37.6 | 3O |
| | | SD-08 | 37.6 | |
| | | SD-05 | 23.5 | |
| | | SD-02 | 1.3 | |
| 316 (Comp) | mixed | SD-09 | 10.7 | 3P |
| | | SD-08 | 10.7 | |
| | | SD-05 | 74.7 | |
| | | SD-02 | 3.9 | |
| 317 (Comp) | mixed | SD-09 | 44.4 | 3Q |
| | | SD-08 | 44.4 | |
| | | SD-05 | 11.2 | |
| 318 (Comp) | mixed | SD-13 | 32.5 | 3R |
| | | SD-14 | 3.25 | |
| | | SD-05 | 57.6 | |
| | | SD-02 | 6.65 | |
| 319 (Comp) | mixed | SD-13 | 25 | 3S |
| | | SD-14 | 25 | |
| | | SD-05 | 45 | |
| | | SD-02 | 5 | |
| 320 (Comp) | mixed | SD-13 | 20.2 | 3T |
| | | SD-14 | 40.4 | |
| | | SD-05 | 35.4 | |
| | | SD-02 | 4 | |
| 321 (Comp) | mixed | SD-13 | 82.5 | 3U |
| | | SD-05 | 13.4 | |
| | | SD-15 | 4.1 | |
| 322 (Comp) | mixed | SD-14 | 79.4 | 3V |
| | | SD-05 | 20.6 | |
| 323 (Comp) | mixed | SD-09 | 79.4 | 3W |
| | | SD-05 | 20.6 | |
| 324 (Comp) | mixed | SD-13 | 40.2 | 3X |
| | | SD-14 | 39.2 | |
| | | SD-05 | 20.6 | |
| 325 (Comp) | mixed | SD-07 | 83.3 | 3Y |
| | | SD-05 | 16.7 | |
| 326 (Comp) | mixed | SD-16 | 9.3 | 3Z |
| | | SD-09 | 18.2 | |
| | | SD-05 | 70.7 | |
| | | SD-02 | 1.8 | |
| 327 (Comp) | mixed | SD-16 | 9.1 | 4A |
| | | SD-07 | 18.3 | |
| | | SD-05 | 70.8 | |
| | | SD-02 | 1.8 | |
| 328 (Comp) | mixed | SD-14 | 48 | 4B |
| | | SD-13 | 52 | |
| 329 (Comp) | mixed | SD-13 | 80 | 4C |
| | | SD-05 | 16 | |
| | | SD-02 | 4 | |
| 330 (Comp) | mixed | SD-14 | 33.3 | 4D |
| | | SD-05 | 60 | |
| | | SD-02 | 6.7 | |
| 331 (Comp) | mixed | SD-14 | 47.6 | 4E |
| | | SD-17 | 52.4 | |
| 332 (Comp) | separately | SD-06 | 40 | 4F |
| | | SD-03 | 31 | |
| | | SD-04 | 18 | |
| | | SD-05 | 7 | |
| | | SD-02 | 4 | |
| 333 (Comp) | separately | SD-03 | 52 | 4G |
| | | SD-04 | 30 | |
| | | SD-05 | 11 | |
| | | SD-02 | 7 | |

Samples 301 through 333 were coated and evaluated similar to sample 101 in Example I. The resultant data are tabulated in Table 3-2. The data illustrate examples of the invention, with wavelength of maximum absorption less than 600 nm, half-peak bandwidths greater than 70 nm, and ratios of bandwidths at 80% peak absorptance to 50% of peak absorptance of greater than 0.25.

TABLE 3-2

| Sample Number (Inventive/ Comparative) | Wavelength of Maximum Absorption (Primary Peak) (nm) | Bandwidth at 80% Absorption (nm) | Bandwidth at 50% Absorption (nm) | Ratio $BW_{80}/BW_{50}$ | Secondary Absorption Peaks (nm) |
|---|---|---|---|---|---|
| 301 (Inv) | 570 | 46 | 100 | 0.46 | none |
| 302 (Inv) | 597 | 40 | 104 | 0.38 | none |
| 303 (Inv) | 592 | 49 | 109 | 0.45 | none |
| 304 (Inv) | 566 | 26 | 88 | 0.30 | none |
| 305 (Inv) | 596 | 33 | 86 | 0.38 | none |
| 306 (Inv) | 592 | 35 | 116 | 0.30 | 628 |
| 307 (Inv) | 592 | 30 | 97 | 0.31 | none |
| 308 (Inv) | 586 | 50 | 117 | 0.43 | none |
| 309 (Inv) | 592 | 29 | 79 | 0.37 | none |
| 310 (Inv) | 572 | 50 | 99 | 0.51 | 586, 608 |
| 311 (Comp) | 610 | 34 | 62 | 0.55 | none |
| 312 (Comp) | 618 | 21 | 51 | 0.41 | none |
| 313 (Comp) | 576 | 21 | 99 | 0.21 | 634 |
| 314 (Comp) | 578 | 13 | 59 | 0.22 | 610 |
| 315 (Comp) | 618 | 33 | 69 | 0.48 | none |
| 316 (Comp) | 648 | 18 | 37 | 0.49 | none |
| 317 (Comp) | 606 | 29 | 56 | 0.52 | none |
| 318 (Comp) | 645 | 18 | 41 | 0.44 | none |
| 319 (Comp) | 632 | 32 | 90 | 0.36 | 580 |
| 320 (Comp) | 622 | 42 | 90 | 0.47 | 576 |
| 321 (Comp) | 588 | 37 | 59 | 0.63 | 606 |
| 322 (Comp) | 602 | 43 | 65 | 0.66 | 578 |
| 323 (Comp) | 618 | 26 | 48 | 0.54 | none |
| 324 (Comp) | 582 | 45 | 68 | 0.66 | 606 |
| 325 (Comp) | 620 | 47 | 80 | 0.59 | none |
| 326 (Comp) | 645 | 16 | 37 | 0.43 | none |
| 327 (Comp) | 652 | 14 | 27 | 0.52 | none |
| 328 (Comp) | 588 | 9 | 21 | 0.43 | none |
| 329 (Comp) | 586 | 43 | 67 | 0.64 | 608 |
| 330 (Comp) | 640 | 30 | 86 | 0.35 | none |
| 331 (Comp) | 626 | 22 | 80 | 0.28 | 572 |
| 332 (Comp) | 572 | 11 | 40 | 0.28 | none |
| 333 (Comp) | 588 | 19 | 60 | 0.32 | 606 |

Example IV

Plural Emulsion Layer Blue, Green, and Red Recording Layer Unit Elements

Component Properties

Red Light Sensitive Emulsions

Silver iodobromide tabular grain emulsions K, L, M, and N were provided having the significant grain characteristics set out in Table 4-1 below. Tabular grains accounted for greater than 70 percent of total grain projected area in all instances. Each of Emulsions K through M were optimally sulfur and gold sensitized. In addition, these emulsions were optimally spectrally sensitized with SD-06, SD-03, SD-04, SD-05, and SD-02 in a40:31:18:7:4 molar ratio. Emulsions K through N were subsequently coated and evaluated like photographic sample 101. The wavelength of peak light absorption for all emulsions was around 570 nm, and the half-peak absorption bandwidth was over 100 nm.

TABLE 4-1

Emulsion size and iodide content

| Emulsion | Average grain ECD (μm) | Average grain thickness, (μm) | Average Aspect Ratio | Average Iodide Content (mol %) |
|---|---|---|---|---|
| K | 2.16 | 0.116 | 18.6 | 3.9 |
| L | 1.31 | 0.096 | 13.6 | 3.7 |
| M | 0.90 | 0.123 | 7.3 | 3.7 |
| N | 0.52 | 0.119 | 4.4 | 3.7 |

Green Light-Sensitive Emulsions

Silver iodobromide tabular grain emulsions O, P, Q, R, S, T, and U were provided having the significant grain characteristics set out in 4-2 below. Tabular grains accounted for greater than 70 percent of total grain projected area in all instances. Each of Emulsions O through U were optimally sulfur and gold sensitized. In addition, emulsions O through S were optimally spectrally sensitized with SD-19 and SD-01 in a one to four and a half molar ratio of dye. Emulsion T was optimally sulfur and gold sensitized and spectrally sensitized with SD-19 and SD-01 in a one to 7.8 molar ratio. Emulsion U was optimally sulfur and gold sensitized and spectrally sensitized with SD-19 and SD-01 in a one to six molar ratio. Emulsion O through U were subsequently coated and evaluated like photographic sample 101. The wavelength of peak light absorption for all emulsions was around 545 nm, and the wavelength at half of the maximum absorption on the bathochromic side was around 575 nm for all emulsions.

TABLE 4-2

Emulsion size and iodide content

| Emulsion | Average grain ECD (μm) | Average grain thickness, (μm) | Average Aspect Ratio | Average Iodide Content (mol %) |
|---|---|---|---|---|
| O | 1.40 | 0.298 | 4.7 | 3.6 |
| P | 1.10 | 0.280 | 3.9 | 3.6 |
| Q | 0.90 | 0.123 | 7.3 | 3.7 |
| R | 0.52 | 0.119 | 4.4 | 3.7 |
| S | 5.08 | 0.65 | 78.1 | 1.1 |
| T | 1.94 | .056 | 34.6 | 4.8 |
| U | 1.03 | .057 | 18.0 | 4.8 |

Blue Light Sensitive Emulsions

Silver iodobromide tabular grain emulsions V, W, X, and Y were provided having the significant grain characteristics set out in Table 4-2 below. Tabular grains accounted for greater than 70 percent of total grain projected area in all instances. Each of Emulsions V through Y were optimally sulfur and gold sensitized. In addition, these emulsions were optimally spectrally sensitized with BS-1, BS-2, and BS-3 in a 45:32:23 molar ratio.

TABLE 4-3

Emulsion size and iodide content

| Emulsion | Average grain ECD (μm) | Average grain thickness, (μm) | Average Aspect Ratio | Average Iodide Content (mol %) |
|---|---|---|---|---|
| V | 4.11 | 0.128 | 32.1 | 3.9 |
| W | 2.16 | 0.116 | 18.6 | 3.9 |

TABLE 4-3-continued

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| X | 1.31 | 0.096 | 13.6 | 3.7 |
| Y | 0.52 | 0.119 | 4.4 | 3.7 |

Red Light Sensitive Emulsions

Silver iodobromide tabular grain emulsions AA, BB, CC, and DD were provided having the significant grain characteristics set out in Table 4-4 below. Tabular grains accounted for greater than 70 percent of total grain projected area in all instances. Each of Emulsions AA through DD were optimally sulfur and gold sensitized. In addition, these emulsions were optimally spectrally sensitized with SD-04 and SD-05 in a 2:1 molar ratio. Emulsions AA through DD were subsequently coated and evaluated like photographic sample 101. The wavelength of peak light absorption for all emulsions was around 628 nm, and the half-peak absorption bandwidth was around 44 nm.

TABLE 4-4

| Emulsion size and iodide content | | | | |
|---|---|---|---|---|
| Emulsion | Average grain ECD (μm) | Average grain Average grain thickness, (μm) | Average Aspect Ratio | Average Iodide Content (mol %) |
| AA | 0.66 | 0.120 | 5.5 | 4.1 |
| BB | 0.55 | 0.083 | 6.6 | 1.5 |
| CC | 1.30 | 0.120 | 10.8 | 4.1 |
| DD | 2.61 | 0.117 | 22.3 | 3.7 |

Green Light-Sensitive Emulsions

Silver iodobromide tabular grain emulsions EE, FF, GG, and HH were provided having the significant grain characteristics set out in Table 4-5 below. Tabular grains accounted for greater than 70 percent of total grain projected area in all instances. Each of Emulsions EE through HH were optimally sulfur and gold sensitized. In addition, emulsions EE through HH were optimally spectrally sensitized with SD-19 and SD-01 in a one to four and a half molar ratio of dye. Emulsions EE through HH were subsequently coated and evaluated like photographic sample 101. The wavelength of peak light absorption for all emulsions was around 545 nm, and the wavelength at half of the maximum absorption on the bathochromic side was about 575 nm for all emulsions.

TABLE 4-5

| Emulsion size and iodide content | | | | |
|---|---|---|---|---|
| Emulsion | Average grain ECD (μm) | Average grain Average grain thickness, (μm) | Average Aspect Ratio | Average Iodide Content (mol %) |
| EE | 1.22 | 0.111 | 11.0 | 4.1 |
| FF | 2.49 | 0.137 | 18.2 | 4.1 |
| GG | 0.81 | 0.120 | 6.8 | 2.6 |
| HH | 0.92 | 0.115 | 8.0 | 4.1 |

Blue Light Sensitive Emulsions

Silver iodobromide tabular grain emulsions II, JJ, and KK were provided having the significant grain characteristics set out in Table 4-6 below. Tabular grains accounted for greater than 70 percent of total grain projected area in all instances. Emulsion LL, a thick conventional grain was also provided. Each of Emulsions II through LL were optimally sulfur and gold sensitized. In addition, these emulsions were optimally spectrally sensitized with BS-1 and BS-2 in a one to one molar ratio.

TABLE 4-6

| Emulsion size and iodide content | | | | |
|---|---|---|---|---|
| Emulsion | Average grain ECD (μm) | Average grain Average grain thickness, (μm) | Average Aspect Ratio | Average Iodide Content (mol %) |
| II | 0.55 | 0.083 | 6.6 | 1.5 |
| JJ | 1.25 | 0.137 | 9.1 | 4.1 |
| KK | 0.77 | 0.140 | 5.5 | 1.5 |
| LL | 1.04 | Not applicable | Not applicable | 9.0 |

Color Negative Element Properties

The suffix (c) designates control or comparative color negative films, while the suffix (e) indicates example color negative films.

All coating coverages are reported in parenthesis in terms of g/m$^2$, except as otherwise indicated. Silver halide coating coverages are reported in terms of silver.

The slower, mid-speed, and faster emulsion layers within each of the blue (BU), green (GU), and red (RU) recording layer units are indicated by the prefix S, M, and F, respectively.

Sample 401c (Comparative Control)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

Layer 1: AHU

| | |
|---|---|
| Black colloidal silver sol | (0.107) |
| UV-1 | (0.075) |
| UV-2 | (0.075) |
| Oxidized developer scavenger S-1 | (0.161) |
| Compensatory printing density cyan dye CD-1 | (0.034) |
| Compensatory printing density magenta dye MD-1 | (0.013) |
| Compensatory printing density yellow dye MM-2 | (0.095) |
| HBS-1 | (0.105) |
| HBS-2 | (0.433) |
| HBS-4 | (0.013) |
| Disodium salt of 3,5-disulfocatechol | (0.215) |
| Gelatin | (2.152) |

Layer 2: SRU

This layer was comprised of a blend of a lower and higher (lower and higher grain ECD) sensitivity, red-sensitized tabular silver iodobromide emulsions respectively.

| | |
|---|---|
| Emulsion BB, silver content | (0.355) |
| Emulsion AA, silver content | (0.328) |
| Bleach accelerator releasing coupler B-1 | (0.075) |
| Development inhibitor releasing coupler D-5 | (0.015) |
| Cyan dye forming coupler C-1 | (0.359) |
| HBS-2 | (0.405) |
| HBS-6 | (0.098) |
| TAI | (0.011) |
| Gelatin | (1.668) |

Layer 3: MRU

| | |
|---|---|
| Emulsion CC, silver content | (0.355) |
| Bleach accelerator releasing coupler B-1 | (0.005) |
| Development inhibitor releasing coupler D-5 | (0.016) |
| Cyan dye forming magenta colored coupler CM-1 | (0.059) |
| Cyan dye forming coupler C-1 | (0.207) |
| HBS-2 | (0.253) |
| HBS-6 | (0.007) |
| TAI | (0.019) |
| Gelatin | (1.291) |

Layer 4: FRU

| | |
|---|---|
| Emulsion DD, silver content | (1.060) |
| Bleach accelerator releasing coupler B-1 | (0.005) |
| Development inhibitor releasing coupler D-5 | (0.027) |
| Development inhibitor releasing coupler D-1 | (0.048) |
| Cyan dye forming magenta colored coupler CM-1 | (0.022) |
| Cyan dye forming coupler C-1 | (0.323) |
| HBS-1 | (0.194) |
| HBS-2 | (0.274) |
| HBS-6 | (0.007) |
| TAI | (0.010) |
| Gelatin | (1.291) |

Layer 5: Interlayer

| | |
|---|---|
| Oxidized developer scavenger S-1 | (0.086) |
| HBS-4 | (0.129) |
| Gelatin | (0.538) |

Layer 6: SGU

This layer was comprised of a blend of a lower and higher (lower and higher grain ECD) sensitivity, green-sensitized tabular silver iodobromide emulsions respectively.

| | |
|---|---|
| Emulsion GG, silver content | (0.251) |
| Emulsion HH, silver content | (0.110) |
| Magenta dye forming yellow colored coupler MM-1 | (0.054) |
| Magenta dye forming coupler M-1 | (0.339) |
| Stabilizer ST-1 | (0.034) |
| HBS-1 | (0.413) |
| TAI | (0.006) |
| Gelatin | (1.184) |

Layer 7: MGU

This layer was comprised of a blend of a lower and higher (lower and higher grain ECD) sensitivity, green-sensitized tabular silver iodobromide emulsions.

| | |
|---|---|
| Emulsion HH, silver content | (0.091) |
| Emulsion EE, silver content | (1.334) |
| Development inhibitor releasing coupler D-6 | (0.032) |
| Magenta dye forming yellow colored coupler MM-1 | (0.118) |
| Magenta dye forming coupler M-1 | (0.087) |
| Oxidized developer scavenger S-2 | (0.018) |
| HBS-1 | (0.315) |
| HBS-2 | (0.032) |
| Stabilizer ST-1 | (0.009) |
| TAI | (0.023) |
| Gelatin | (1.668) |

Layer 8: FGU

| | |
|---|---|
| Emulsion FF, silver content | (0.909) |
| Development inhibitor releasing coupler D-3 | (0.003) |
| Development inhibitor releasing coupler D-7 | (0.032) |
| Oxidized developer scavenger S-2 | (0.023) |
| Magenta dye forming yellow colored coupler MM-1 | (0.054) |
| Magenta dye forming coupler M-1 | (0.113) |
| HBS-1 | (0.216) |
| HBS-2 | (0.064) |
| Stabilizer ST-1 | (0.011) |
| TAI | (0.011) |
| Gelatin | (1.405) |

Layer 9: Yellow Filter Layer

| | |
|---|---|
| Yellow filter dye YD-1 | (0.054) |
| Oxidized developer scavenger S-1 | (0.086) |
| HBS-4 | (0.129) |
| Gelatin | (0.538) |

Layer 10: SBU

This layer was comprised of a blend of a lower, medium, and higher (lower, medium, and higher grain ECD) sensitivity, blue-sensitized tabular silver iodobromide emulsions.

| | |
|---|---|
| Emulsion II, silver content | (0.140) |
| Emulsion KK, silver content | (0.247) |
| Emulsion JJ, silver content | (0.398) |
| Development inhibitor releasing coupler D-5 | (0.027) |
| Development inhibitor releasing coupler D-4 | (0.054) |
| Yellow dye forming coupler Y-1 | (0.915) |
| Cyan dye forming coupler C-1 | (0.027) |
| Bleach accelerator releasing coupler B-1 | (0.011) |
| HBS-1 | (0.538) |
| HBS-2 | (0.108) |
| HBS-6 | (0.014) |
| TAI | (0.014) |
| Gelatin | (2.119) |

Layer 11: FBU

This layer was comprised of a blue-sensitized tabular silver iodobromide emulsion containing 9.0 M % iodide, based on silver.

| | |
|---|---|
| Emulsion LL, silver content | (0.699) |
| Unsensitized silver bromide Lippmann emulsion | (0.054) |
| Yellow dye forming coupler Y-l | (0.473) |
| Development inhibitor releasing coupler D-4 | (0.086) |
| Bleach accelerator releasing coupler B-1 | (0.005) |
| HBS-1 | (0.280) |
| HBS-6 | (0.007) |
| TAI | (0.012) |
| Gelatin | (1.183) |

Layer 12: Ultraviolet Filter Layer

| | |
|---|---|
| Dye UV-1 | (0.108) |
| Dye UV-2 | (0.108) |
| Unsensitized silver bromide Lippmann emulsion | (0.215) |
| HBS-1 | (0.151) |
| Gelatin | (0.699) |

Layer 13: Protective Overcoat Layer

| | |
|---|---|
| Polymethylmethacrylate matte beads | (0.005) |
| Soluble polymethylmethacrylate matte beads | (0.108) |
| Silicone lubricant | (0.039) |
| Gelatin | (0.882) |

This film was hardened at the time of coating with 1.80% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 402e (Invention)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

Layer 1: AHU

| | |
|---|---|
| Black colloidal silver sol | (0.151) |
| UV-1 | (0.075) |
| UV-2 | (0.107) |
| Oxidized developer scavenger S-1 | (0.161) |
| Compensatory printing density cyan dye CD-1 | (0.016) |
| Compensatory printing density magenta dye MD-1 | (0.038) |
| Compensatory printing density yellow dye MM-2 | (0.285) |
| HBS-1 | (0.105) |
| HBS-2 | (0.341) |
| HBS-4 | (0.038) |
| HBS-7 | (0.011) |
| Disodium salt of 3,5-disulfocatechol | (0.228) |
| Gelatin | (2.044) |

Layer 2: SRU

This layer was comprised of a blend of a lower and higher (lower and higher grain ECD) sensitivity, red-sensitized tabular silver iodobromide emulsions.

| | |
|---|---|
| Emulsion M, silver content | (0.430) |
| Emulsion N, silver content | (0.323) |
| Bleach accelerator releasing coupler B-1 | (0.057) |
| Oxidized developer scavenger S-3 | (0.183) |
| Development inhibitor releasing coupler D-7 | (0.013) |
| Cyan dye forming coupler C-1 | (0.344) |
| Cyan dye forming coupler C-2 | (0.038) |
| HBS-2 | (0.026) |
| HBS-5 | (0.118) |
| HBS-6 | (0.120) |
| TAI | (0.012) |
| Gelatin | (1.679) |

Layer 3: MRU

| | |
|---|---|
| Emulsion L, silver content | (1.076) |
| Bleach accelerator releasing coupler B-1 | (0.022) |
| Development inhibitor releasing coupler D-1 | (0.011) |
| Development inhibitor releasing coupler D-7 | (0.013) |
| Oxidized developer scavenger S-3 | (0.183) |
| Cyan dye forming coupler C-1 | (0.086) |
| Cyan dye forming coupler C-2 | (0.086) |
| HBS-1 | (0.044) |
| HBS-2 | (0.026) |
| HBS-5 | (0.097) |
| HBS-6 | (0.074) |
| TAI | (0.017) |
| Gelatin | (1.291) |

Layer 4: FRU

| | |
|---|---|
| Emulsion K, silver content | (1.291) |
| Development inhibitor releasing coupler D-1 | (0.011) |
| Development inhibitor releasing coupler D-7 | (0.011) |
| Oxidized developer scavenger S-1 | (0.014) |
| Cyan dye forming coupler C-1 | (0.065) |
| Cyan dye forming coupler C-2 | (0.075) |
| HBS-1 | (0.044) |
| HBS-2 | (0.022) |
| HBS-4 | (0.021) |
| HBS-5 | (0.161) |
| TAI | (0.021) |
| Gelatin | (1.076) |

Layer 5: Interlayer

| | |
|---|---|
| Oxidized developer scavenger S-1 | (0.086) |
| HBS-4 | (0.129) |
| Gelatin | (0.538) |

Layer 6: SGU

This layer was comprised of a blend of a lower and higher (lower and higher grain ECD) sensitivity, green-sensitized tabular silver iodobromide emulsions.

| | |
|---|---|
| Emulsion U, silver content | (0.161) |
| Emulsion R, silver content | (0.269) |
| Bleach accelerator releasing coupler B-1 | (0.012) |
| Development inhibitor releasing coupler D-7 | (0.011) |
| Oxidized developer scavenger S-3 | (0.183) |
| Magenta dye forming coupler M-1 | (0.301) |
| Stabilizer ST-1 | (0.060) |
| HBS-1 | (0.241) |
| HBS-2 | (0.022) |
| HBS-6 | (0.061) |
| TAI | (0.003) |
| Gelatin | (1.106) |

Layer 7: MGU

| | |
|---|---|
| Emulsion T, silver content | (0.968) |
| Bleach accelerator releasing coupler B-1 | (0.005) |
| Development inhibitor releasing coupler D-1 | (0.011) |
| Development inhibitor releasing coupler D-7 | (0.011) |
| Oxidized developer scavenger S-1 | (0.011) |
| Oxidized developer scavenger S-3 | (0.183) |
| Magenta dye forming coupler M-1 | (0.113) |
| Stabilizer ST-1 | (0.023) |

-continued

| | |
|---|---|
| HBS-1 | (0.133) |
| HBS-2 | (0.022) |
| HBS-4 | (0.016) |
| HBS-6 | (0.053) |
| TAI | (0.016) |
| Gelatin | (1.399) |

Layer 8: FGU

| | |
|---|---|
| Emulsion S, silver content | (0.968) |
| Development inhibitor releasing coupler D-1 | (0.009) |
| Development inhibitor releasing coupler D-7 | (0.011) |
| Oxidized developer scavenger S-1 | (0.011) |
| Magenta dye forming coupler M-1 | (0.097) |
| Stabilizer ST-1 | (0.029) |
| HBS-1 | (0.112) |
| HBS-2 | (0.022) |
| HBS-4 | (0.016) |
| TAI | (0.018) |
| Gelatin | (1.399) |

Layer 9: Yellow Filter Layer

| | |
|---|---|
| Yellow filter dye YD-1 | (0.032) |
| Oxidized developer scavenger S-1 | (0.086) |
| HBS-4 | (0.129) |
| Gelatin | (0.646) |

Layer 10: SBU

This layer was comprised of a blend of a lower, medium, and higher (lower, medium, and higher grain ECD) sensitivity, blue-sensitized tabular silver iodobromide emulsions.

| | |
|---|---|
| Emulsion W, silver content | (0.398) |
| Emulsion X, silver content | (0.247) |
| Emulsion Y, silver content | (0.215) |
| Bleach accelerator releasing coupler B-1 | (0.003) |
| Development inhibitor releasing coupler D-7 | (0.011) |
| Oxidized developer scavenger S-3 | (0.183) |
| Yellow dye forming coupler Y-1 | (0.710) |
| HBS-2 | (0.022) |
| HBS-5 | (0.151) |
| HBS-6 | (0.050) |
| TAI | (0.014) |
| Gelatin | (1.872) |

Layer 11: FBU

| | |
|---|---|
| Emulsion V, silver content | (0.699) |
| Bleach accelerator releasing coupler B-1 | (0.005) |
| Development inhibitor releasing coupler D-7 | (0.013) |
| Yellow dye forming coupler Y-1 | (0.140) |
| HBS-2 | (0.026) |
| HBS-5 | (0.118) |
| HBS-6 | (0.007) |
| TAI | (0.011) |
| Gelatin | (1.291) |

Layer 12: Protective Overcoat Layer

| | |
|---|---|
| Polymethylmethacrylate matte beads | (0.005) |
| Soluble polymethylmethacrylate matte beads | (0.054) |
| Unsensitized silver bromide Lippmann emulsion | (0.215) |
| Dye UV-1 | (0.108) |
| Dye UV-2 | (0.216) |
| Silicone lubricant | (0.040) |
| HBS-1 | (0.151) |
| HBS-7 | (0.108) |
| Gelatin | (1.237) |

This film was hardened at the time of coating with 1.75% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 403e (Invention) color photographic recording material for color negative development was prepared exactly as above in Sample 402e, except where noted below.

Layer 6: SGU Changes

| | |
|---|---|
| Emulsion U | (0.000) |
| Emulsion Q | (0.161) |

Layer 7: MGU Changes

| | |
|---|---|
| Emulsion T | (0.000) |
| Emulsion P | (0.968) |

Layer 8: FGU Changes

| | |
|---|---|
| Emulsion S | (0.000) |
| Emulsion O | (0.968) |

In order to establish the utility of the photographic recording materials, each of the color negative film samples 401–403 samples was exposed to white light from a tungsten source filtered by a Daylight Va filter to 5500K at 1/500th of a second through 1.2 inconel neutral density and a 0–4 log E graduated tablet with 0.20 density increment steps. The color reversal film, KODAK EKTACHROME™ ELITE II 100 Film (designated Sample 601), was exposed by white light from another tungsten source filtered to 5500K and through a 0–4 density step tablet for 1/5 of a second, in order to optimally determine the characteristic curve of the photographic recording material. The exposed film samples were processed through the KODAK FLEXICOLOR™ C-41 Process. The film samples were then subjected to Status M densitometry and the characteristic curves and photographic performance metrics were determined.

Gamma (γ) for each color record is the maximum slope of the characteristic curve between a point on the curve lying at a density of 0.15 above minimum density ($D_{min}$) and a point on the characteristic curve at 0.9 log E higher exposure level, where E is exposure in lux-seconds. The gamma for each Sample's characteristic curve color records was determined by measuring the indicated curve segments with a Kodak Model G gradient meter. The exposure latitude, indicating the exposure range of a characteristic curve segment over which the instantaneous gamma was at least 25% of the gamma as defined above, was also determined. The observed values of gamma and latitude are reported in Table 4-7.

TABLE 4-7

| | Status M Gamma | | | Latitude (log E) | | |
|---|---|---|---|---|---|---|
| Sample | R | G | B | R | G | B |
| 1. 401c | 0.67 | 0.63 | 0.77 | 3.4+ | 3.4+ | 3.4+ |
| 2. 402e | 0.71 | 0.36 | 0.90 | 3.2+ | 3.6+ | 3.1 |
| 4. 403e | 0.67 | 0.66 | 0.83 | 3.4+ | 3.2 | 3.2 |
| 5. 601c | 1.52 | 2.26 | 1.92 | 2.3 | 2.3 | 2.6 |

The sensitivities over the visible spectrum of the individual color units of the photographic recording materials, Samples 401–403, were determined in 5-nm increments using nearly monochromatic light of carefully calibrated output from 360 to 715 nm. Photographic recording materials Samples 401–403 were individually exposed for 1/100 of a second to white light from a tungsten light source of 3000K color temperature that was filtered by a Daylight Va filter to 5500K and by a monochromator with a 4-nm bandpass resolution through a graduated 0–4.0 density step tablet with 0.3-density step increments to determine their speed. The samples were then processed using the KODAK Flexicolor C-41™ process.

Following processing and drying, Samples 401–403 were subjected to Status M densitometry and their sensitometric performance over the visible spectrum was characterized. The exposure required to produce a density increase of 0.15 above $D_{min}$ was determined for the color recording units at each 5-nm increment exposed. Speed is reported as the logarithm of the reciprocal of the required exposure in ergs/square centimeter, multiplied by 100, for the red sensitive units in Table 4-8.

The spectral sensitivity response of the photographic recording materials was also used to determine the relative colorimetric accuracy of color negative materials Samples 401–403 in recording a particular diverse set of 200 different color patches according to the method disclosed by Giorgianni et al, in U.S. Pat. No. 5,582,961. The computed color error variance is included in Table 4-8. This error value relates to the color difference between the CIELAB space coordinates of the specified set of test colors and the space coordinates resulting from a specific transformation of the test colors as rendered by the film. In particular, the test patch input spectral reflectance values for a given light source are convolved with the sample photographic materials' spectral sensitivity response to estimate calorimetric recording capability. It should be noted that the computed color error is sensitive to the responses of all three input color records, and an improved response by one record may not overcome the responses of one or two other limiting color records. A color error difference of at least 1 unit corresponds to a significant difference in color recording accuracy.

In Table 4-8 the comparative samples have been assigned a (c) suffix while the samples satisfying invention requirements have been assigned an (e) suffix. When FRU spectral sensitizing dye overall half-peak dyed absorptance bandwidth is at least 70 nm, and more preferably greater than 90 nm, FRU emulsion dyed λmax is between 525–600 nm, the dyed absorptance ratio of 80% bandwidth divided by 50% bandwidth is at least 0.25, and colored masking couplers are absent, a color error substantially lower than the value of 10, provided by a contemporary color negative film intended for optical printing, results. This marked reduction in color error variance is indicative of much higher color recording fidelity in the color negative films containing the FRU emulsion of the invention than for the conventional color negative film intended for optical printing, such Sample 401c. This demonstrates that the samples satisfying the requirements of the invention are better suited for providing image records of the incident light for digital image manipulation that better match human visual perception.

TABLE 4-8

| Sample | Fast layer RU emulsion | FRU emulsion dyed absorptance λmax (nm) | FRU emulsion dyed 50% band-width (nm) | FRU emulsion dyed 80% band-width/ dyed 50% band-width | Colored masking Couplers | RU λmax (nm) | RU Speed at λmax | Color error |
|---|---|---|---|---|---|---|---|---|
| 401c | DD | 628 | 44 | 0.48 | YES | 625 | 265.1 | 10.0 |
| 402e | K | 570 | 100 | 0.46 | NO | 595 | 239.1 | 3.5 |
| 403e | K | 570 | 100 | 0.46 | NO | 595 | 249.7 | 3.0 |

The invention has been described in detail with particular reference to preferred embodiments thereof, but it will be understood that variations and modifications can be effected within the spirit and scope of the invention.

What is claimed is:

1. A photographic element comprising:

a support and, coated on the support, a plurality of hydrophilic colloid layers, including radiation-sensitive silver halide emulsion layers, forming layer units for separately recording blue, green and red exposures, wherein, the red recording layer unit is comprised of at least one green-red sensitive emulsion having a peak dyed absorptance of between about 525 and about 600 nm, an overall half-peak absorptance bandwidth of between about 70 and about 150 nm, and a ratio of the bandwidths at 80% of peak absorptance to 50% of peak absorptance of greater than or equal to about 0.25;

wherein the photographic element is a color negative film and each recording layer unit is substantially free of color masking couplers.

2. A photographic element according to claim 1 capable of producing images suitable for electronic scanning, wherein, said layer units for separately recording blue, green and red exposures comprise:

a blue recording emulsion layer unit containing at least one dye-forming coupler capable of forming a first image dye;

a green recording emulsion layer unit containing at least one dye-forming coupler capable of forming a second image dye; and, a red recording emulsion layer unit containing at least one dye-forming coupler capable of forming a third image dye;

wherein said first, second, and third dye image-forming couplers are chosen such that the absorption half peak bandwidths of said image dyes are substantially non-coextensive:

wherein the photographic element is a color negative film and each recording layer unit is substantially free of color masking couplers.

3. A photographic element according to claim 1, wherein the green-red sensitive emulsion has a peak dyed absorptance between about 525 and about 597 nm.

4. A photographic element according to claim 1, wherein the green-red sensitive emulsion has a peak dyed absorptance between about 525 and about 595 nm.

5. A photographic element according to claim 1, wherein green-red sensitive emulsion has a half-peak absorptance greater than or equal to about 74 nm.

6. A photographic element according to claim 1, wherein green-red sensitive emulsion has a half-peak absorptance greater than or equal to about 78 nm.

7. A photographic element according to claim 1, wherein the green-red sensitive emulsion has a ratio of the bandwidths at 80% of peak absorptance to 50% of peak absorptance between about 0.27 and about 0.95.

8. A photographic element according to claim 1, wherein the green-red sensitive emulsion has a ratio of the bandwidths at 80% of peak absorptance to 50% of peak absorptance between about 0.27 and about 0.90.

9. A photographic element according to claim 1, wherein where the green-red sensitive emulsion comprises tabular grains having an aspect ratio of greater than or equal to 2.

10. A photographic element according to claim 1, wherein the green-red sensitive emulsion contains three or more sensitizing dyes.

11. A photographic element according to claim 10, wherein at least one of said sensitizing dyes is a cyanine dye.

12. A photographic element according to claim 11, wherein the cyanine sensitizing dye is of general formula I:

(I)

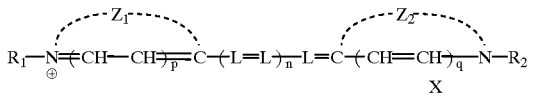

where R1 and R2 are the same or different and each represents an alkyl group or an aryl group; Z1 and Z2 represent the atoms necessary to complete a 5 or 6 membered heterocyclic ring system; p and q are 0 or 1; L is a methine group; n is 0, 1, or 2; and X is a counterion as necessary to balance the charge.

13. A photographic element according to claim 12, wherein the cyanine dye is of formula II:

(II)

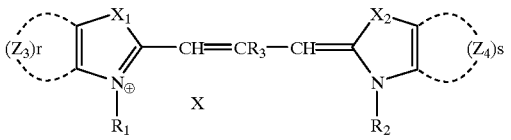

where R1 and R2 are the same or different and each represents a 1 to 10 carbon alkyl group or an aryl group; R3 is a 1 to 6 carbon alkyl group or an aryl group; r and s are 0 or 1; Z3 and Z4 are the atoms necessary to complete a fused benzene, naphthalene, pyridine, or pyrazine ring; X1 and X2 are each individually O, S, Se, Te, N—R4, where R4 is a 1 to 10 carbon alkyl group or an aryl group; and X is a counterion as necessary to balance the charge.

14. A photographic element according to claim 13, wherein r and s are each 0 and the five membered rings containing X1 and X2 are further substituted at the 4 and/or 5 position.

15. A photographic element according to claim 13, wherein X1 and X2 are O, S, Se, or N—R4, where R4 is a 1 to 10 carbon alkyl group or an aryl group.

16. A photographic element according to claim 13, wherein at least one of r and s is equal to 1.

17. A photographic element according to claim 13, wherein at least one of R1 and R2 contains an acid solubilizing group.

18. A photographic element according to claim 10, wherein at least one of the dyes is selected from:

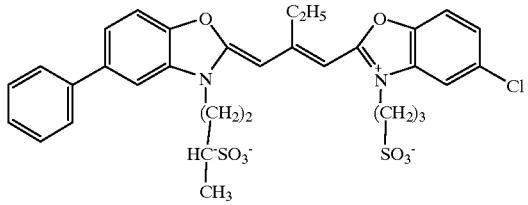

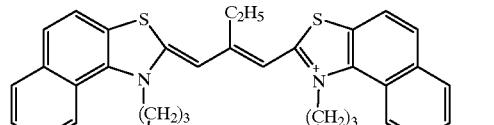

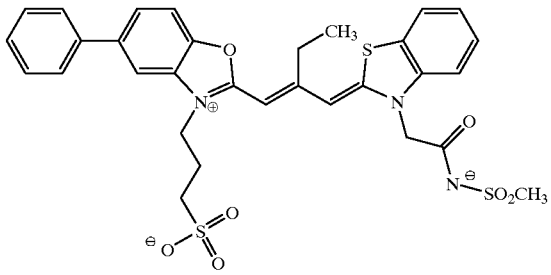

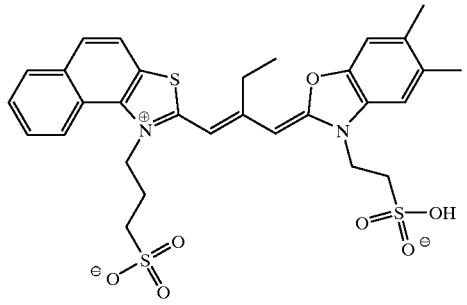

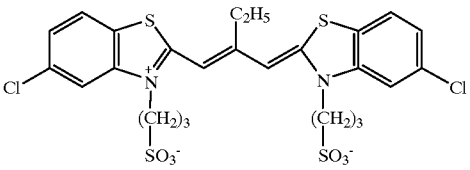

-continued
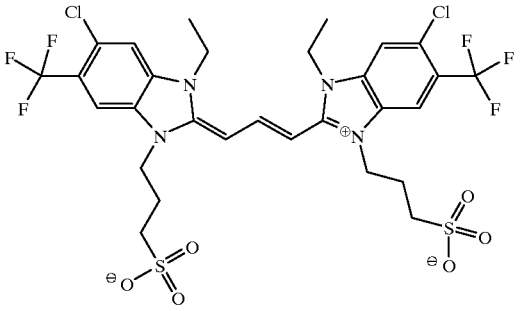
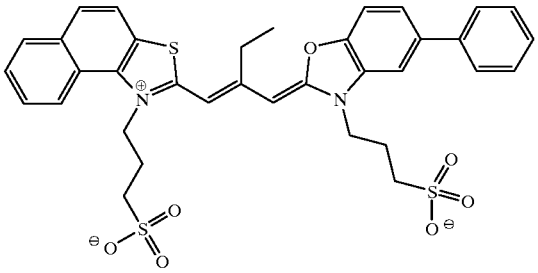
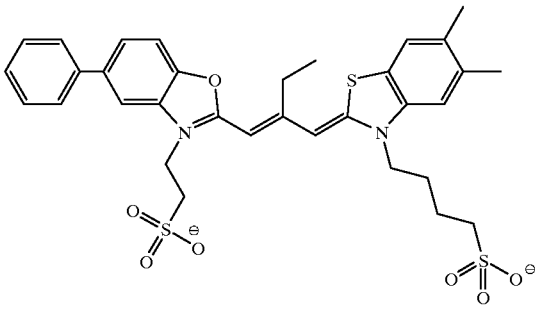
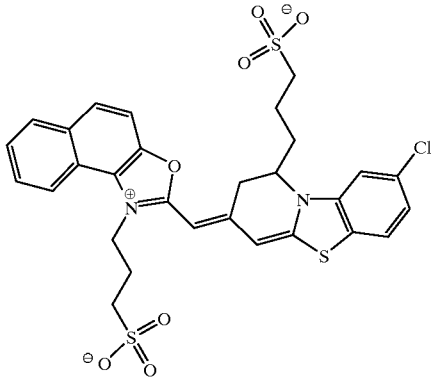
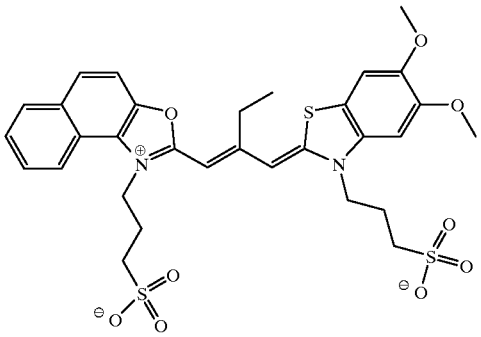
-continued
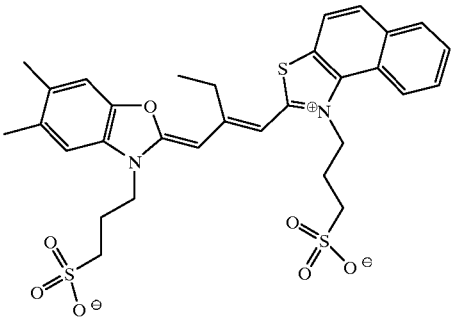
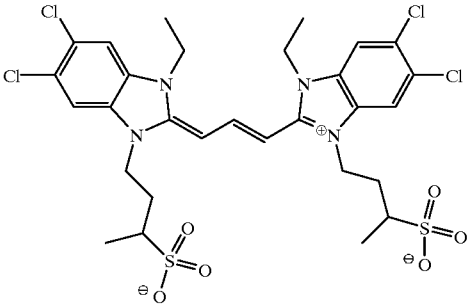
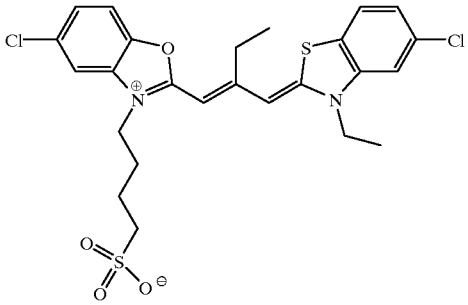
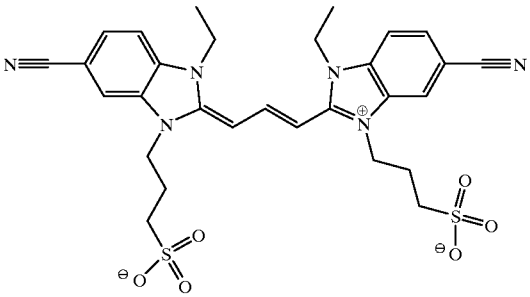
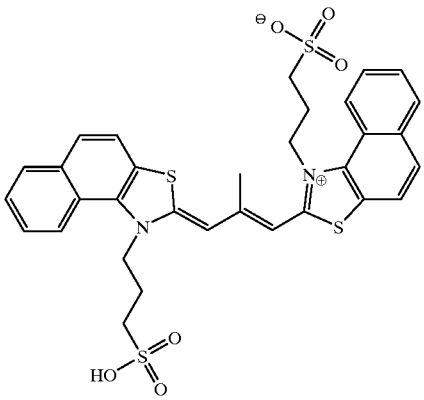

-continued

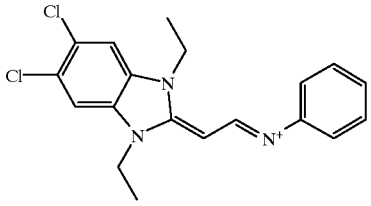

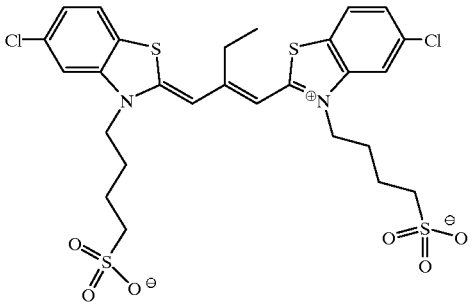

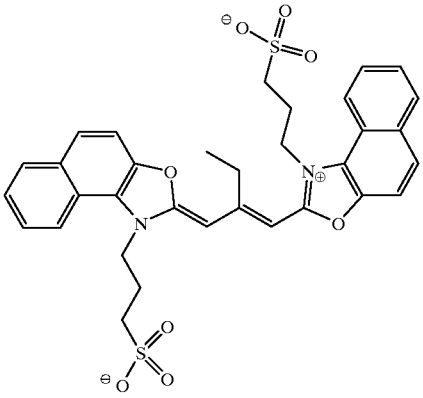

and

-continued

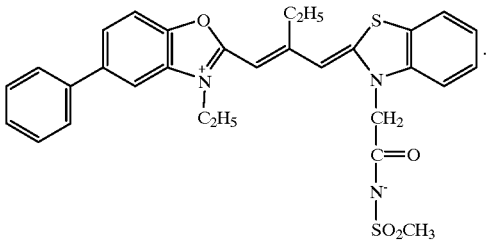

19. A photographic element according to claim 18, wherein the green-red emulsion contains at least two of said dyes.

20. A photographic element according to claim 18, wherein the green-red emulsion contains at least three of said dyes.

21. A photographic element according to claim 1, wherein the element is a color reversal film.

22. A photographic element according to claim 1, wherein the green-red silver halide emulsion has a silver iodide content of between zero and 12%, based on silver.

23. A photographic element according to claim 1, capable of producing dye images suitable for digital scanning with subsequent conversion to an electronic form.

* * * * *